US007326020B2

(12) United States Patent
Thomas et al.

(10) Patent No.: US 7,326,020 B2
(45) Date of Patent: Feb. 5, 2008

(54) MULTI-PURPOSE VESSEL AND METHOD FOR RECOVERING, STORING AND/OR OFFLOADING MATERIAL IN A DREDGING OPERATION

(75) Inventors: Dennis R. Thomas, Peoria, IL (US); Michael D. Platt, Yates City, IL (US); Edward S. Kress, Brimfield, IL (US)

(73) Assignee: Mudhen, LLC, Yates City, IL (US)

( * ) Notice: Subject to any disclaimer, the term of this patent is extended or adjusted under 35 U.S.C. 154(b) by 0 days.

(21) Appl. No.: 11/097,483

(22) Filed: Apr. 1, 2005

(65) Prior Publication Data

US 2005/0204589 A1 Sep. 22, 2005

Related U.S. Application Data

(63) Continuation of application No. 09/486,280, filed on Feb. 24, 2000, now Pat. No. 7,025,553.

(51) Int. Cl.
*B63B 27/00* (2006.01)
*B65G 67/60* (2006.01)

(52) U.S. Cl. ..... 414/137.7; 414/139.4; 414/139.3; 414/142.1; 414/142.3

(58) Field of Classification Search ..... 414/139.4, 414/142.2, 140.8, 140.9, 142.1, 142.4, 137.6, 414/138.5, 138.6, 138.7, 138.8, 139.3, 141.9; 37/337–338, 345; 114/26, 27, 31; 405/195.2, 405/222

See application file for complete search history.

(56) References Cited

U.S. PATENT DOCUMENTS 808,800 A 1/1906 Wright
1,153,851 A 9/1915 Menzles
1,196,426 A 8/1916 Bowling
1,249,555 A 12/1917 Towsend
1,323,611 A * 12/1919 Ream ..... 37/338
1,460,558 A 7/1923 Olden (Continued)

FOREIGN PATENT DOCUMENTS

FR 2 580 693 4/1985

(Continued)

OTHER PUBLICATIONS

International Search Report concerning International Application Serial No. PCT/US99/16972, European Patent Office, dated Apr. 11, 1999, 8 pages.

(Continued)

*Primary Examiner*—Patrick Mackey
*Assistant Examiner*—Gregory Adams
(74) *Attorney, Agent, or Firm*—Husch & Eppenberger LLC; Robert C. Haldiman

(57) ABSTRACT

A method of building a levee or an island is disclosed. The method includes dredging material from a surface of a body of water with a dredge assembly mounted to a hull and supporting a hopper with the hull. The hopper is adapted to receive the material. The hopper includes a floor with a portion of the floor moveable to permit movement of the material in the hopper, and depositing at a desired location dredge material from the dredge using a transfer conveyor.

21 Claims, 42 Drawing Sheets

U.S. PATENT DOCUMENTS

| | | | | | |
|---|---|---|---|---|---|
| 1,839,929 | A | | 1/1932 | Powell | |
| 2,309,741 | A | | 2/1943 | Rudow | |
| 2,628,727 | A | * | 2/1953 | Anschutz | 414/139.1 |
| 2,731,741 | A | | 1/1956 | Kaufmann | |
| 3,086,305 | A | | 4/1963 | West | |
| 3,146,537 | A | * | 9/1964 | Von Bolhar | 37/308 |
| 3,160,966 | A | | 12/1964 | Skakel | |
| 3,313,041 | A | | 4/1967 | Sova | |
| 3,392,464 | A | | 7/1968 | MacDonald | |
| 3,476,498 | A | | 11/1969 | Bolhar | |
| 3,578,186 | A | | 5/1971 | Thomas | |
| 3,640,238 | A | | 2/1972 | Stockdale | |
| 3,650,238 | A | | 3/1972 | Stockdale | |
| 3,690,023 | A | | 9/1972 | Peterson | |
| 3,782,317 | A | | 1/1974 | Kriedt et al. | |
| 3,783,626 | A | | 1/1974 | Hansen | |
| 3,845,631 | A | | 11/1974 | Malan | |
| 4,070,978 | A | | 1/1978 | Virgilio | |
| 4,162,584 | A | | 7/1979 | Slatterwhite | |
| 4,214,387 | A | | 7/1980 | Boehme et al. | |
| 4,257,178 | A | | 3/1981 | Spradlin | |
| 4,362,436 | A | | 12/1982 | Harmstorf | |
| 4,394,841 | A | * | 7/1983 | Lundback | 114/26 |
| 4,397,587 | A | * | 8/1983 | Op den Velde et al. | 405/222 |
| 4,412,587 | A | | 11/1983 | van der Lely | |
| 4,483,655 | A | * | 11/1984 | Snow et al. | 414/803 |
| 4,592,155 | A | | 6/1986 | Mustonen | |
| 4,677,930 | A | * | 7/1987 | Ortloff | 114/230.14 |
| 4,702,023 | A | | 10/1987 | McDowen | |
| 4,713,896 | A | | 12/1987 | Jennens | |
| 5,049,021 | A | | 9/1991 | Pole et al. | |
| 5,058,294 | A | | 10/1991 | Bryan, Jr. | |
| 5,115,751 | A | | 5/1992 | Copson | |
| 5,259,130 | A | | 11/1993 | Rohr | |
| 5,311,682 | A | | 5/1994 | Sturdivant | |
| 5,404,696 | A | | 4/1995 | Vasby | |
| 5,456,551 | A | | 10/1995 | Saxon | |
| 5,479,869 | A | | 1/1996 | Coudon et al. | |
| 5,490,339 | A | | 2/1996 | Accettola | |
| 5,573,363 | A | | 11/1996 | Rohr | |
| 5,638,620 | A | | 6/1997 | Van Der Kooy | |
| 5,642,684 | A | | 7/1997 | Aker | |
| 5,853,264 | A | | 12/1998 | Treveloni | |
| 5,903,989 | A | | 5/1999 | Satzler | |
| 5,907,915 | A | | 6/1999 | Satzler | |
| 5,960,570 | A | | 10/1999 | Satzler | |
| 6,520,720 | B1 | * | 2/2003 | Boldurev | 405/195.1 |

FOREIGN PATENT DOCUMENTS

| | | | |
|---|---|---|---|
| GB | 1 538 389 | | 1/1979 |
| JP | 56039988 | | 4/1981 |
| JP | 58 150633 | | 9/1983 |
| JP | 61053921 | | 3/1986 |
| JP | 62004695 | | 1/1987 |
| JP | 04106228 | | 4/1992 |
| JP | 05 17958 | | 1/1993 |
| JP | 05339930 | | 12/1993 |
| JP | 10018345 | | 1/1998 |
| WO | WO 95/21303 | | 8/1995 |
| WO | WO 9521303 | A1 * | 8/1995 |
| WO | WO 98/44204 | | 8/1998 |

OTHER PUBLICATIONS

International Search Report for PCT/US2006/023577.

* cited by examiner 198
192
204
132
205
202
200
218
216
214
172c
144
130
172
172a
172b
160
165
162
163
170
173
158
159
146
142
171
171a
163a
164
222
220
224
226
180
176
174
138
203
206
208
194

198
192
200
202
205
209
180
144
172
174
176
20
165
162
163
163a
164
170
155
150
140
171
178
163b 550
552
554
556
558
560
562
564
566
568
570
572
574
576
578
580
582
584
586
588
590
592
594
596
598
600
602
604
606
608
610
612
614
616
618
620
622
624
626
628
630

550
880
881
890
846
840
800
816
817
812
870
888
820
822
830
818
814
880
881
890
880
881
880
881
880
881

MULTI-PURPOSE VESSEL AND METHOD FOR RECOVERING, STORING AND/OR OFFLOADING MATERIAL IN A DREDGING OPERATION

CROSS-REFERENCE TO RELATED APPLICATIONS

This application is a continuation of U.S. patent application Ser. No. 09/486,280 filed on Feb. 24, 2000 which is a Section 371 application based upon PCT/US98/16972 filed on Jul. 28, 1999, now abandoned, which claimed priority to U.S. Provisional Application Nos. 60/094,378 filed Jul. 28, 1998, 60/094,633 filed Jul. 30, 1998, 60/095,797 filed Aug. 7, 1998, 60/098,160 filed Aug. 27, 1998 and 60/102,654 filed Oct. 2, 1998.

BACKGROUND OF THE INVENTION

Field of the Invention

The invention relates generally to dredging, and, more particularly, to a multi-purpose vessel and method for recovering, storing and/or transporting, and off-loading material in a dredging operation.

Due largely to erosion, the waterways of many areas of the world are becoming choked with silt and the like. As the waterways become more and more shallow, certain problems arise. For example, navigation through the waterways becomes difficult or altogether impossible. In addition, the risk of flooding adjoining areas of a waterway increases as the depth of the waterway decreases.

Over the years, many dredging techniques have been devised. Perhaps the most popular dredging technique involves a vacuuming dredge which sucks silt and the like from the bottom of the waterway through a conduit or a hose. This technique is disadvantageous in several respects. For example, it collects large volumes of water in the dredging process. As a result, the material recovered by this dredging technique is largely a liquid mixture that is difficult to handle and dispose of. By way of another example, the vacuuming technique mentioned above tends to disturb the bed of the waterway in a manner that mixes silt and impurities imbedded in the silt into the water. Some of these impurities may be toxic lead and mercury). Dredging with this old technique can, therefore, pose an environmental hazard. Due to these and other difficulties, dredging a waterway using the vacuuming technique is an expensive, time-consuming and hazardous proposition.

Recently, Caterpillar® has invented a new dredging assembly. The dredging assembly is a large wheel that rolls along and slices into the bed of a waterway. The wheel is compartmentalized by slicing blades that slice and pick-up segments of the bed of the waterway as the wheel turns in a fashion similar to a cookie cutter slicing cookies from dough. The development of this new dredging technology has made it possible to dredge waterways in a much more efficient, cost-effective manner. Specifically, because the dredging wheel lifts large segments of silt from the waterway bed, the material it recovers is largely solid and undisturbed, is not mixed with much (if any) additional water during dredging, and, thus, can be more efficiently handled than material recovered by the prior art vacuuming system discussed above.

While the development of the Caterpillar® dredging wheel offers a significant opportunity to recover material from the Waterways of the world and to restore those waterways to navigable depths, it has also given rise to a new set of technological problems from the material handling perspective. Specifically, now that it is possible to quickly dredge large volumes of substantially solid material from a waterway, it is necessary to develop apparatus and systems for handling, transporting and/or disposing of the material recovered by the dredge.

SUMMARY OF THE INVENTION

In accordance with an aspect of the invention, a multi-purpose vessel for use when recovering material from a bottom surface of a body of water comprises a hull, a dredge assembly mounted to the hull, a hopper, and a transfer conveyor. The dredge assembly is adapted to recover the material from the bottom surface and the hopper is supported by the hull and is adapted to receive the material. The transfer conveyor is adapted to receive the material from the dredge assembly, and is shiftable between a first position in which the transfer conveyor is operable to convey the material toward the hopper, and a second position in which the transfer conveyor is operable to convey the material off the vessel.

In further accordance with a preferred embodiment, the hull may be provided with a propulsion system, and the hopper may include a moveable floor adapted to move the material in the hopper. The moveable floor may include a slat conveyor, such as comprising a plurality of cleats attached to the moveable floor, The moveable floor may include a flexible belt mounted on a plurality of rollers, or the moveable floor may include an ejector blade moveably mounted within the hopper, with the ejector blade being adapted to move the material in the hopper.

The vessel preferably includes a distribution conveyor mounted to the hull. The distribution conveyor includes a first end and a second end, and a discharge conveyor may be provided having a portion extending into the hopper and being adapted to discharge the material from the hopper to the distribution conveyor adjacent the first end. The distribution conveyor second end is moveable to a desired position to thereby unload the material at a desired location. The distribution conveyor may include an extendable portion, such as by slidably mounting the extendable portion in a housing, and may include a rack and pinion assembly mounted to the housing and engaging the extendable portion for extending and retracting the extendable portion. Still preferably, the distribution conveyor is mounted on a turret assembly, and a rack and pinion assembly may be provided, which is arranged to rotate the distribution conveyor on the turret assembly.

Preferably, the transfer conveyor is moveably mounted to the hull, such as by mounting the transfer conveyor on a turret assembly. A rack and pinion may be provided which is arranged to rotate the transfer conveyor on the turret assembly.

The hopper may be generally rectangular, and preferably a discharge auger or other discharge assembly is mounted to the hull and includes a portion extending into the hopper to discharge the material from the hopper. The discharge assembly may include a pair of counter rotating augers, with each of the augers including a portion extending into the hopper.

The hull may be provided with a propulsion system for moving the hull through the water. The propulsion system may include a tractive element which is adapted to engage the bottom surface of the body of water. Preferably, the tractive element is moveably mounted to the hull and is shiftable between a retracted position in which the tractive element is disposed toward the hull and an extended position in which the tractive element engages the bottom surface. The propulsion system may also include a plurality of positioning jets.

Preferably, the distribution conveyor is provided with a moveable counterweight. The counterweight is positionable relative to the distribution conveyor so as to counteract the forces applied to the distribution conveyor by the material.

In accordance with another aspect of the invention, a multi-purpose vessel for use when recovering material from a bottom surface of a body of water comprises a hull, with a dredge assembly being mounted to the hull. The dredge assembly is adapted to recover the material from the bottom surface. A conveyor system is provided, with the conveyor system including a first portion adapted to receive the material from the dredge assembly, a moveable second portion, and a distribution conveyor. The second portion is moveable to a first position in which the second portion is adapted to receive the material from the first portion and to convey the material to a first desired location disposed a first distance away from the hull. The second portion is further moveable to a second position in which the second portion is adapted to convey the material to the distribution conveyor. The distribution conveyor is adapted to convey the material a second distance greater than the first distance away from the hull.

In accordance with a still further aspect of the invention, a multipurpose vessel for use on a body of water vessel comprises a hull, a dredge assembly mounted to the hull, with the dredge assembly being adapted to recover material from a bottom surface of the body of water, a hopper supported by the hull, with the hopper being adapted to receive the material, and a conveyor system. The conveyor system includes a first portion adapted to receive the material from the dredge assembly, and further includes a moveable second portion adapted to receive the material from the first portion and to convey the material along a plurality of desired paths. A first of the desired paths being away from the hull and a second of the desired paths being toward the hopper.

In accordance with yet another aspect of the invention, a method of conveying material recovered in a dredging operation to a desired location comprises the steps of positioning a water4iorne vessel having a dredge assembly and a distribution conveyor at a first position in a waterway, recovering the dredged material from the waterway and conveying the material to a first end of the distribution conveyor, positioning a second end of the distribution conveyor at a desired location, and conveying the material along the distribution conveyor to the second end for deposition therefrom as the vessel proceeds along the waterway.

In accordance with another aspect of the invention, a method is provided for transporting material recovered in a dredging operation from a dredge to a material distribution center. The method includes the step of loading a hopper of a water-borne material transportation vessel with recovered material at a dredging site. It also includes the steps of driving the material transportation vessel to a material distribution center; ejecting the recovered material from the hopper by moving a floor and an ejector blade; and delivering the ejected recovered material to the material distribution center.

In accordance with another aspect of the invention, a method of forming a working channel in a silt4aden waterway comprises the steps of moving a water-borne vessel having a dredge assembly and a distribution conveyor through the waterway, recovering the silt material from the waterway and conveying the silt material to a first end of the distribution conveyor, positioning a second end of the distribution conveyor at a desired location, and conveying the material along the distribution conveyor to the second end for deposition therefrom as the vessel proceeds along the waterway.

In accordance with a further aspect of the invention, a method of forming an emergency levee in a waterway comprises the steps of moving a water-borne vessel having a dredge assembly and a distribution conveyor through the waterway, recovering the material from a bottom surface of the waterway and conveying the silt material to a first end of the distribution conveyor, positioning a second end of the distribution conveyor at a desired levee location, and conveying the material along the distribution conveyor to the second end for deposition therefrom as the vessel proceeds along the waterway.

In accordance with yet a further aspect of the invention, a method of repairing a breach in a levee comprises the steps of moving a water-borne vessel having a dredge assembly and a distribution conveyor through a waterway adjacent the levee, recovering material from a bottom surface of the waterway and conveying the material to a first end of the distribution conveyor, positioning a second end of the distribution conveyor at a desired location adjacent the breach, and conveying the material along the distribution conveyor to the second end for deposition therefrom as the vessel proceeds along the waterway.

Other features and advantages are inherent in the disclosed apparatus or will become apparent to those skilled in the art from the following detailed description and its accompanying drawings.

BRIEF DESCRIPTION OF THE DRAWINGS

The present invention will become more fully understood from the detailed description and the accompanying drawings, wherein:

FIG. 42 is a left, side view of the vessel of FIG. 41 showing the distribution conveyor in its extended position.

DETAILED DESCRIPTION OF THE PREFERRED EMBODIMENTS

Figure 1:
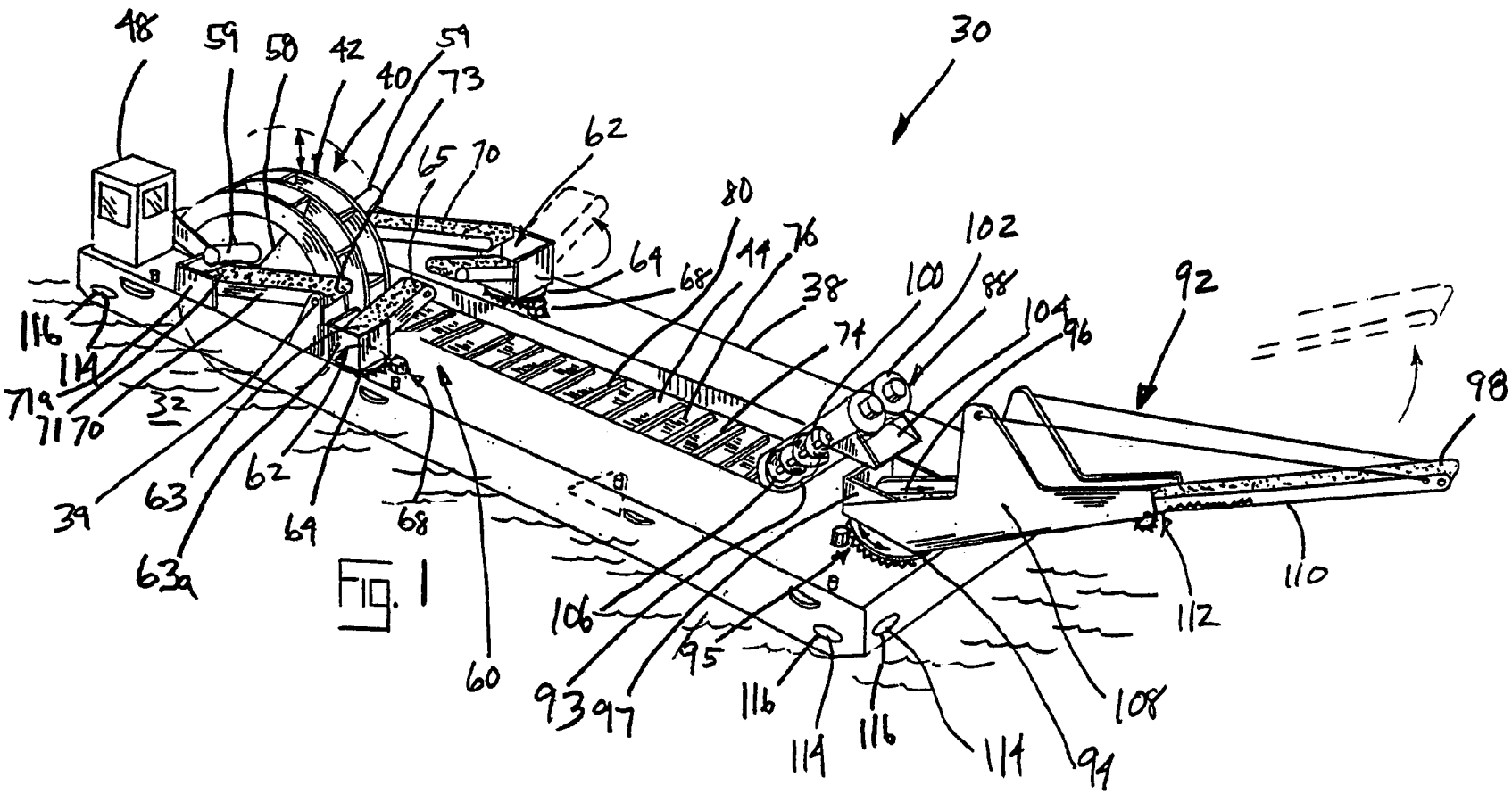
FIG. 1 is a perspective view of a multi-purpose vessel for use in a dredging operation which has been constricted in accordance with the teachings of the present invention.

The following description of the preferred embodiments is not intended to limit the scope of the invention to the precise forms disclosed, but instead is intended to be illustrative of the principles of the invention so that others may follow its teachings.

Referring now to FIGS. 1 through 11 of the drawings, an exemplary water-borne multi-purpose vessel constructed in accordance with the teachings of the present invention is generally referred to by the reference numeral. 30 and is shown afloat on a body of water 32 having a bottom surface 34 (viewable in FIGS. 4 and 7-9), which bottom surface may have deposited thereon a layer of silt material 36. The vessel 30 includes a hull 38 to which is mounted a dredge assembly 40. The hull 38 is designed with a low draft for operation in shallow water. Preferably, the dredge assembly 40 mounted to the hull 38 is a dredge wheel 42 developed by Caterpillar®, which dredge wheel 42 is shown in greater detail in FIGS. 7-9. The Caterpillar® dredge wheel 42 may be used to rapidly dredge large amounts of the material 36 from the bottom surface 34 of a waterway, such as rivers, lakes, etc.

A further description of an exemplary dredge wheel 42 will be provided in greater detail below.

A hopper 44 and a conveyor system 60 are also mounted to the hull. As shown to advantage in FIGS. 1-3 and 10, the hopper 44 is preferably rectangular in shape and is preferably substantially centered with respect to the hull 38 and extends substantially along the length thereof. Persons of ordinary skill in the art will readily appreciate that hoppers of other shapes, sizes and locations can be utilized without departing from the scope or spirit of the invention. In any event, the size of the hopper 44 is preferably selected along with the hull dimensions to provide a desired payload capacity. The hull 38 is powered by a propulsion system (not shown) which is controlled by an operator located in a cab 48 in a conventional manner.

The dredge wheel 42 is located in a well or aperture 50 (FIGS. 3, 8 and 9) which is formed generally centrally relative to the hull 38. The dredge wheel 42 is supported by hydraulic jacks 43 (See FIGS. 8 and 9) or the like which can be powered to raise or lower the dredge wheel 42 to a desired depth for dredging or transport.

Figure 7:
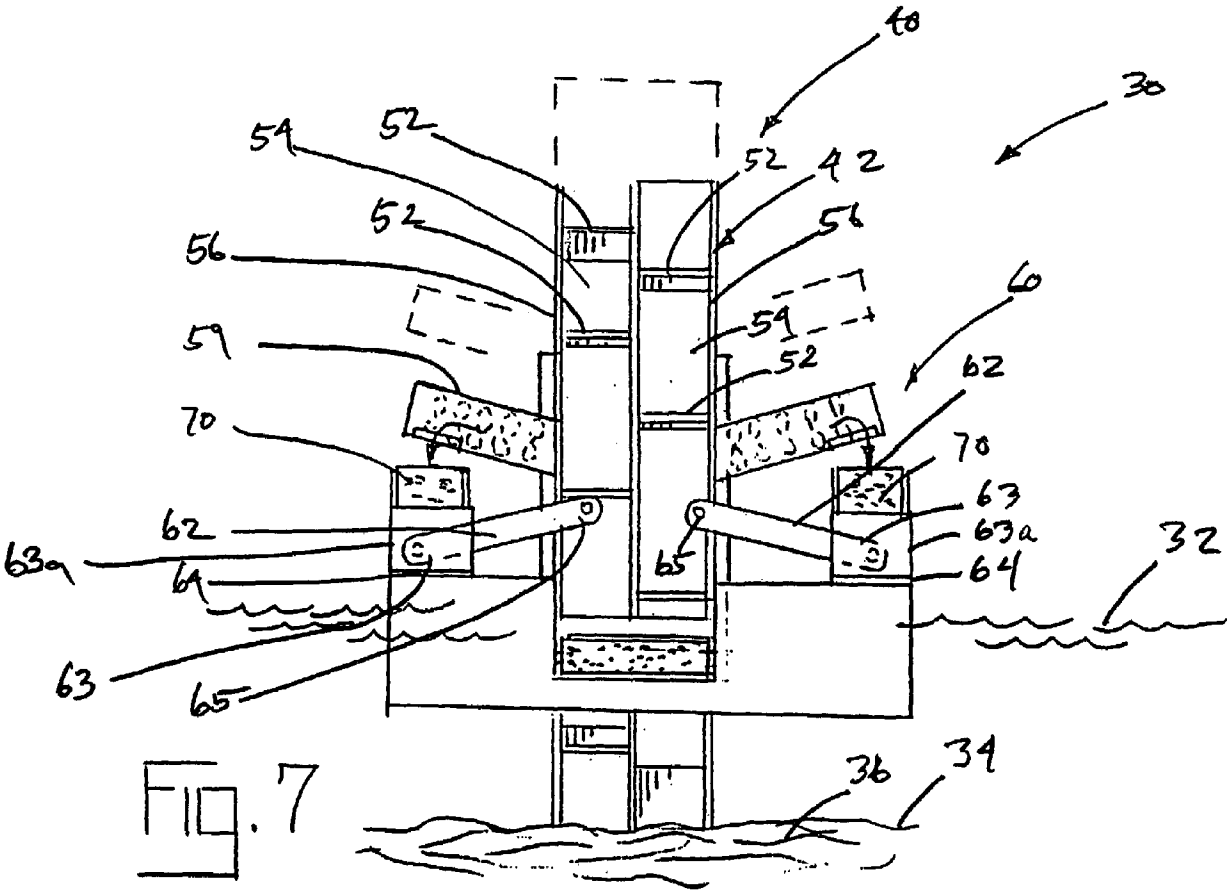
FIG. 7 is a bow end elevational view of the vessel of FIG. 1 providing an end view of the dredging assembly.
Figures 8, 9:
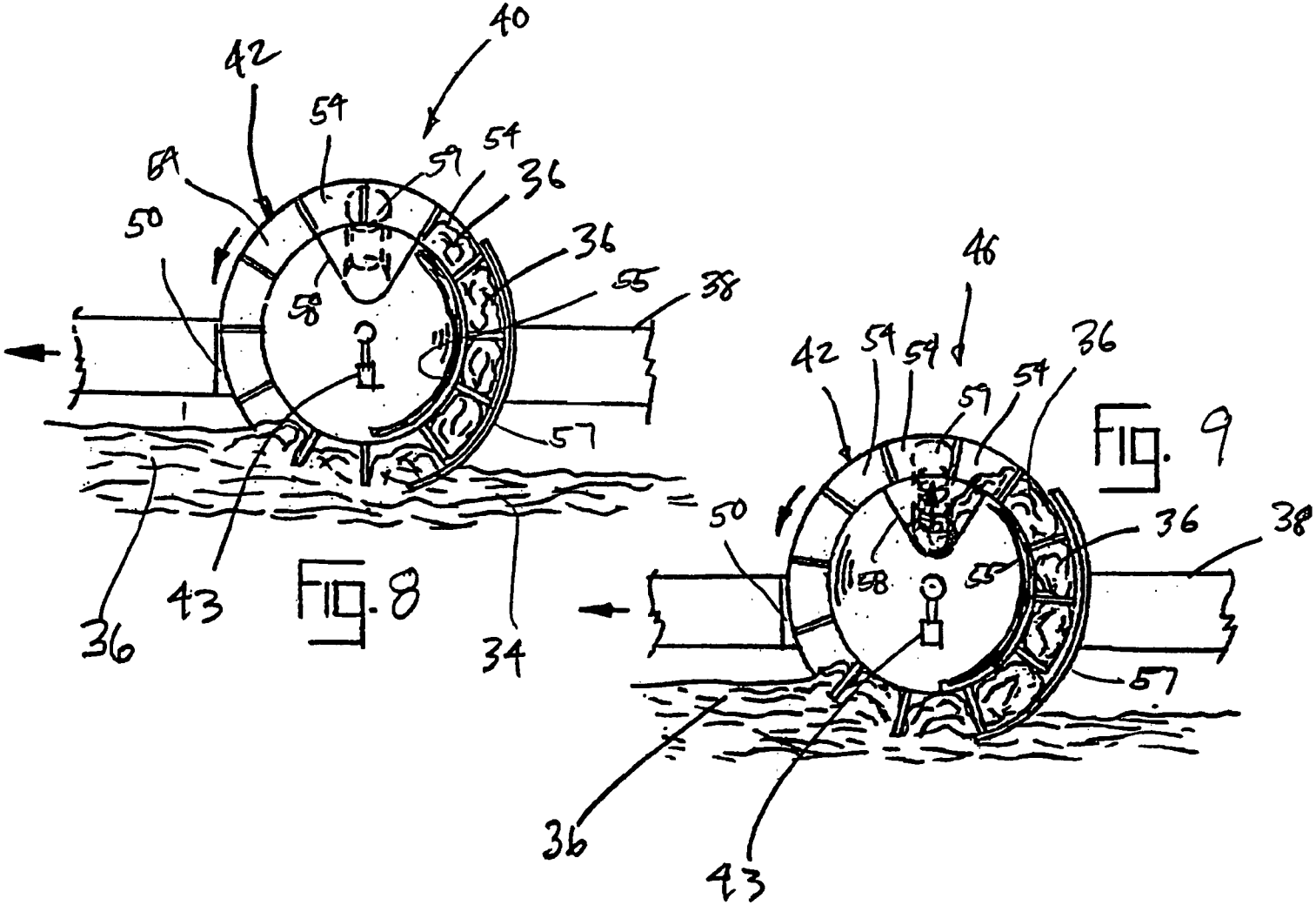
FIG. 8 is a fragmentary cress-sectional view taken along line 8-8 of FIG. 7 and illustrating the manner of operation of one possible dredge assembly for use on the vessel of FIG. 1.
FIG. 9 is a fragmentary cross-sectional view similar to FIG. 9 and illustrating recovered material exiting the dredge wheel and being deposited into a collection trough.

Referring now to FIGS. 7-9, for the purpose of capturing the recovered material 3$ to be dredged from the bed or bottom surface 34 of the waterway, the dredge wheel 42 is provided with a number of generally evenly spaced blades 52. The blades 52 divide the outer perimeter of the dredging wheel 42 into a plurality of capture cavities 54. Two of the blades 52 cooperate to form two, oppositely disposed sides of each capture cavity 54. The other two opposite sides of the cavities 54 are formed by generally parallel, circular wheel plates 56. The top and bottom (i.e., the radially outward and radially inward sides, respectively) of each capture cavity 54 are open.

In operation, as the vessel 30 moves forward (i.e.~, to the left when viewing FIGS. 8 and 9), the dredging wheel 42 rotates such that a capture cavity 54 digs into the waterway bottom and collects a slab of material 36 to be dredged (See FIGS. 8 and 9). As the wheel 42 continues to rotate, the filled capture cavity 54 rotates between an inner capture plate 55 and an outer capture plate 57 formed at the back of the wheel 42. The capture plates 55, 57 seal the radially inner and outer openings of the capture cavity 54 to ensure the recovered material 36 remains in the cavity 54 as the cavity 54 rotates toward the top of the wheel 42.

As the filled capture cavity 54 reaches the top of the wheel 42, the inner capture plate 55 terminates such that, when the filled cavity 54 reaches the top of the wheel 42, the dredged material 36 falls out of the capture cavity 54 under the influence of gravity (and, optionally, under the influence of a mechanical assist (not shown)) and into a hopper or trough 58 disposed toward the center of the wheel 42. As shown in FIGS. 1-3 and 5-7, the trough 58 is serviced by two, oppositely disposed angers 59 which function independently to discharge the recovered material 36 from the trough 58. A more detailed description of the structure and function of an exemplary dredge wheel 42 may be found in Satzler, U.S. Pat. No. 5,903,989, Satzler, U.S. Pat. No. 5,907,915, and U.S. patent application Ser. No. 08/834,676, the entire disclosures of which are hereby incorporated by reference herein in their entirety.

Figure 2:
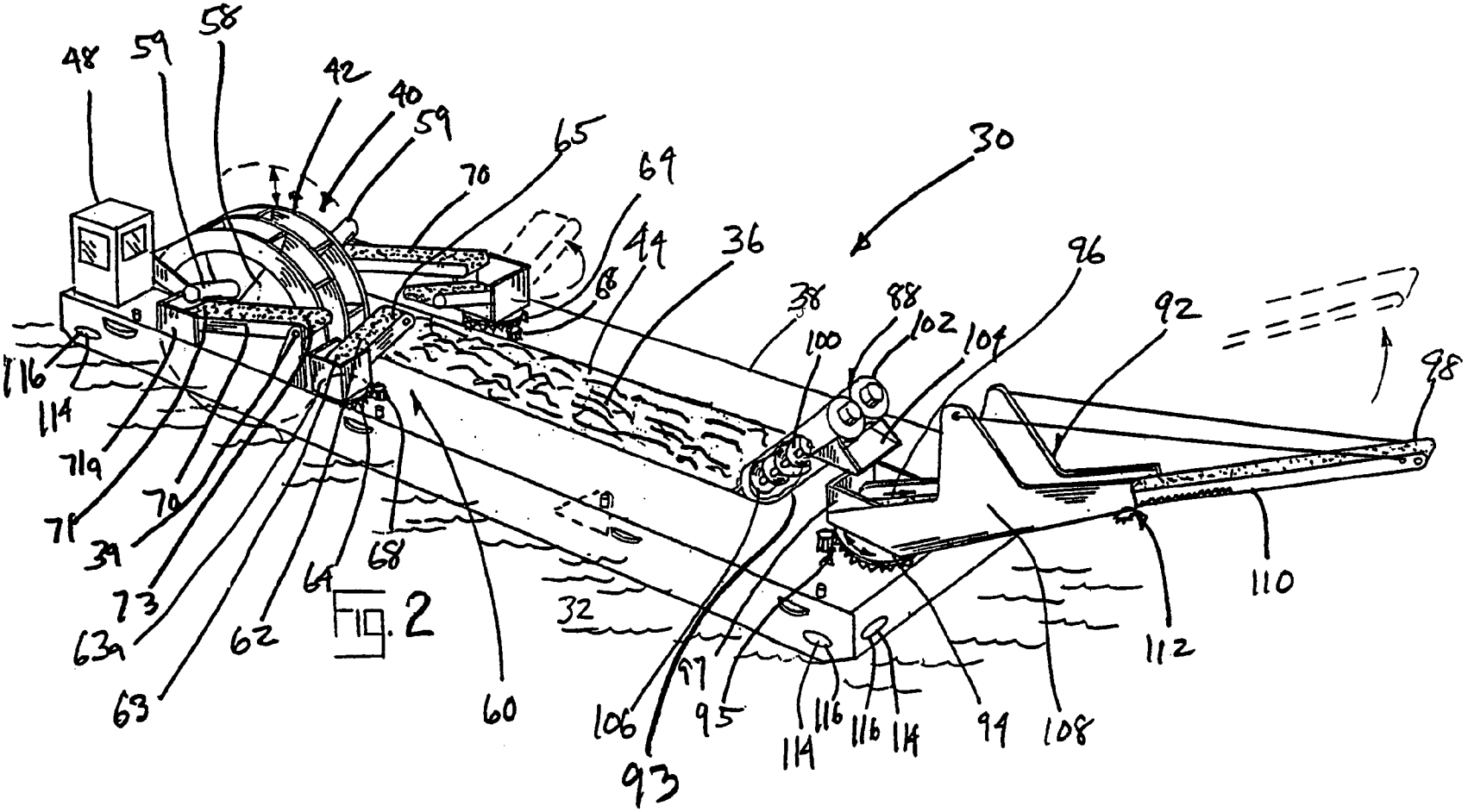
FIG. 2 is a perspective view of the vessel of FIG. 1 and illustrating the vessel in one possible state of operation in which the recovered material is being transferred to a nearly full hopper.
Figure 3:
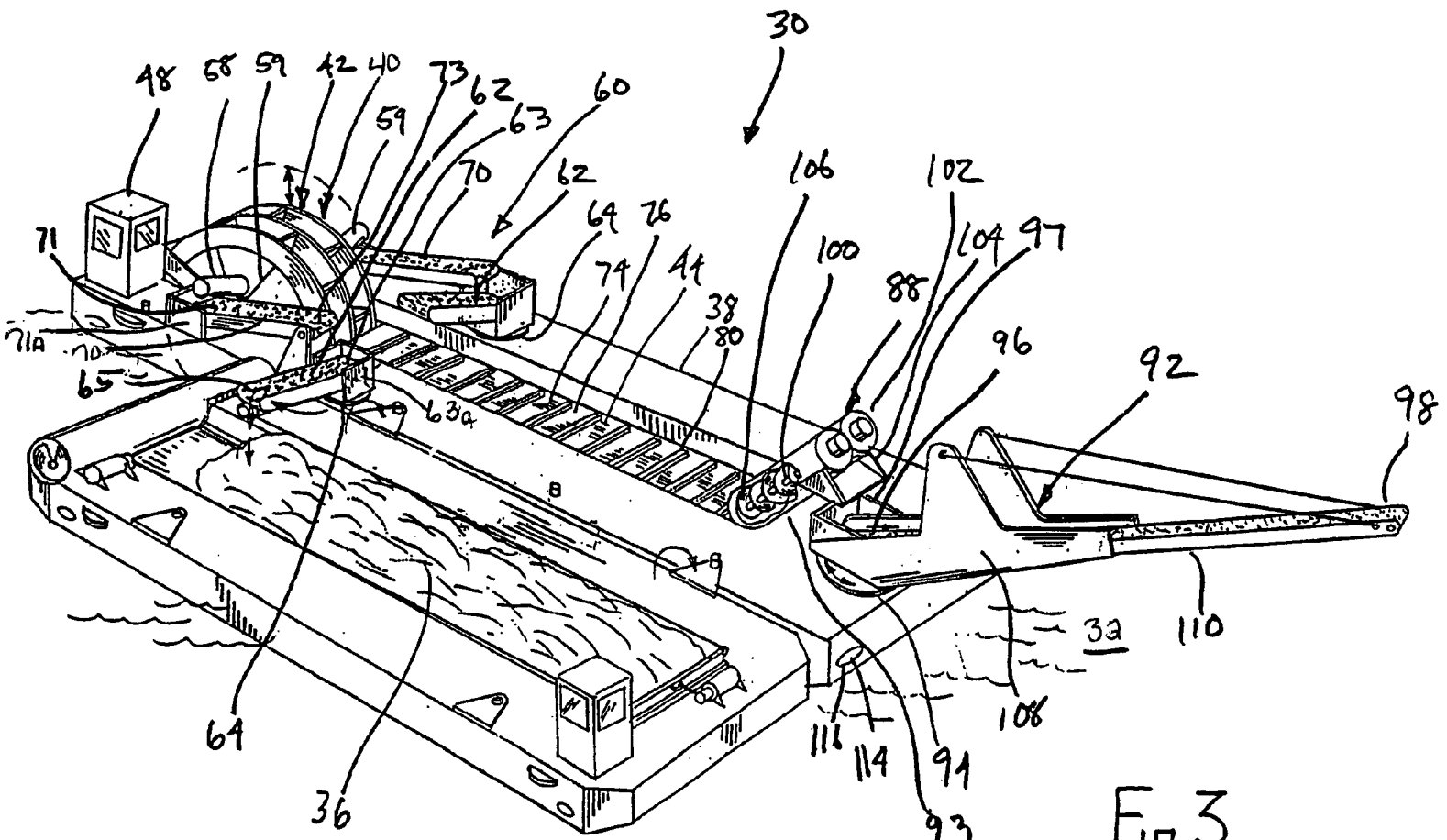
FIG. 3 is a perspective view of the vessel of FIG. 1 but illustrating the vessel in another possible state of operation in which the recovered material is being offloaded onto an adjacent transport vessel.
Figure 4:
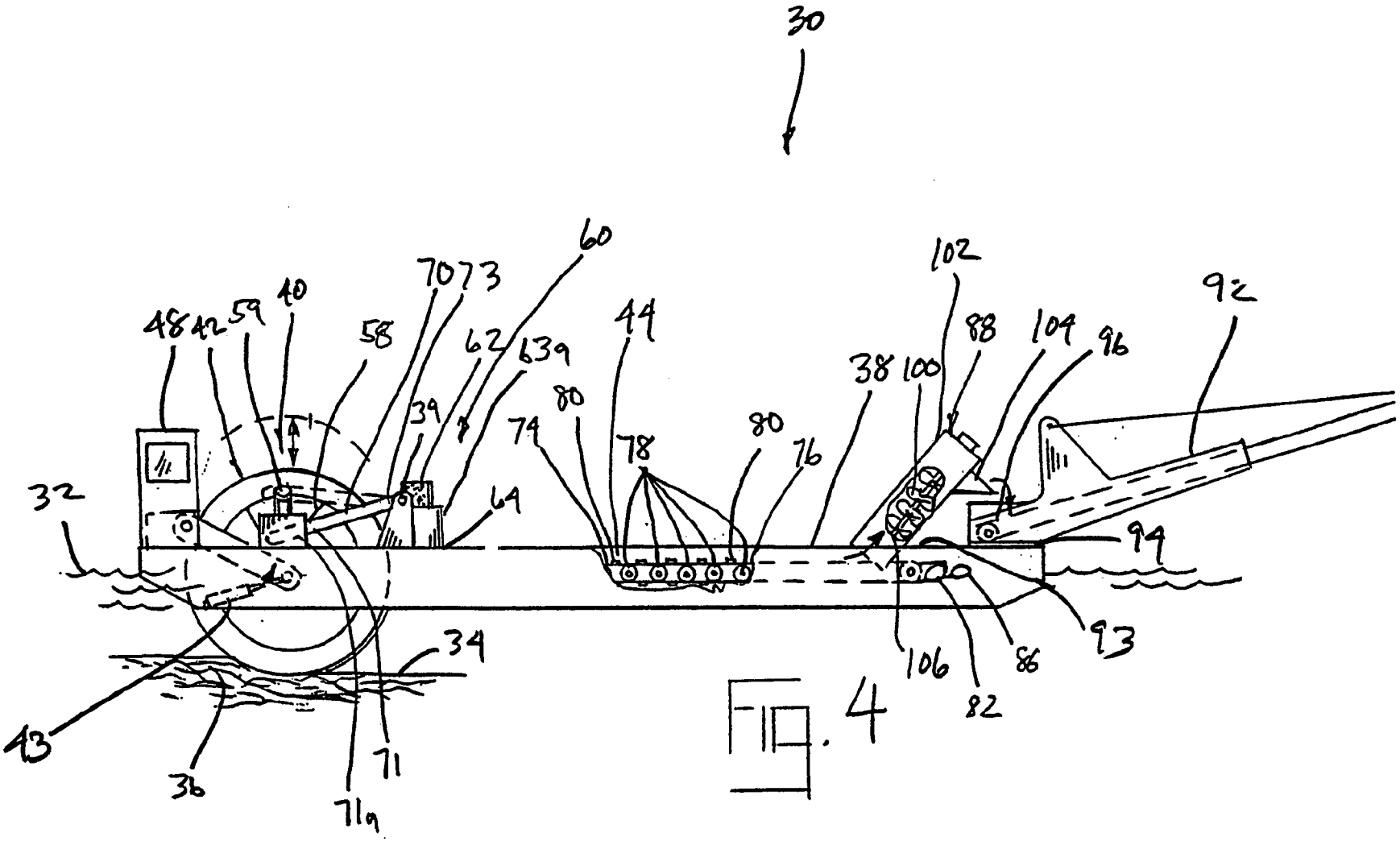
FIG. 4 is a right side elevational view, partly in section, of the vessel illustrated in FIG. 1.
Figure 5:
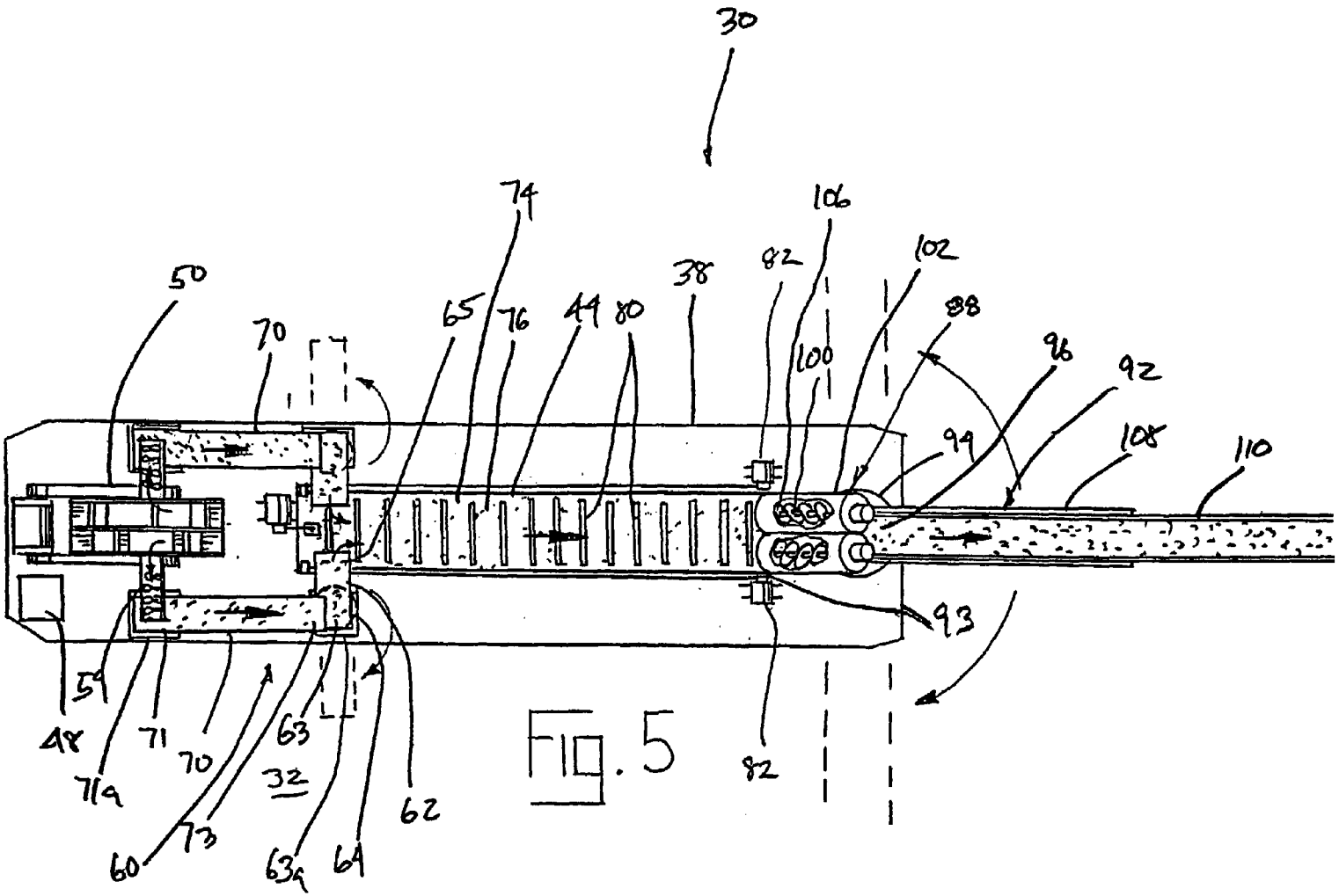
FIG. 5 is a top plan view of the vessel illustrated in FIG. 1.

For the purpose of handling the material 36 recovered by the dredge assembly 40, the vessel 30 is further provided with a conveyor system 60. The conveyor system 60 may include a transfer conveyor 62, which is mounted on a turret 64 of conventional design. It will be understood that the vessel 30 is preferably provided with a pair of transfer conveyors 62, one on each side of the hull 38. The transfer conveyor 62 may be a rotatable belt conveyor, and includes a first end 63 and a second end 65. A receiving box **63*a* is provided adjacent the first end 63 in order to contain material 36 deposited thereon. A rack and pinion assembly 68 is provided, which enables the transfer conveyor to be rotated or pivoted between the position shown in FIG. 2, in which the second end 65 of the transfer conveyor is disposed over the hopper, and the position shown in FIG. 3, in which the second end 65 of the transfer conveyor 62 is disposed over an adjacent transport vessel. As shown in FIGS. 1-3, the transfer conveyor 62 is preferably upwardly inclined to facilitate loading into the hopper or the adjacent vessel. Note that as an alternatively, hydraulic cylinders may be employed in place of the rack and pinion assembly 68 in order to pivot the transfer conveyor 62** on the turret. Additional details concerning the structure and function of the adjacent transport vessel can be found in the vessel and method for transporting and offloading section below.

Another conveyor 70 is disposed on the hull 38 generally adjacent to the dredge wheel 42, and includes a first end 71 having a receiving box **71*a*, and a second end 72 disposed generally adjacent to the first end 63 of the transfer conveyor 62. The receiving box 71 is disposed generally below the auger 59 so as to receive material. 36 ejected thereby. The second end 73 of the conveyor 70 is pivotally mounted to the hull 38 by a pivot 39 (FIGS. 1-3), to accommodate upward and downward movement of the wheel 42 as the cylinders 43 raise and lower the wheel 42** to adjust the dredge assembly for different working depths.

Each turret 64 permits the corresponding receiving box **63*a* and transfer conveyor 62 to rotate approximately 180°. Persons of ordinary skill in the art will readily appreciate that both the turrets 64 and the belts of the conveyors 62, 70** can be driven in many ways without departing 1 mm the scope or spirit of the invention. By way of examples, not limitations, the conveyor belts and/or the turrets can be driven by electrical motors or hydraulic motors.

Figure 10:
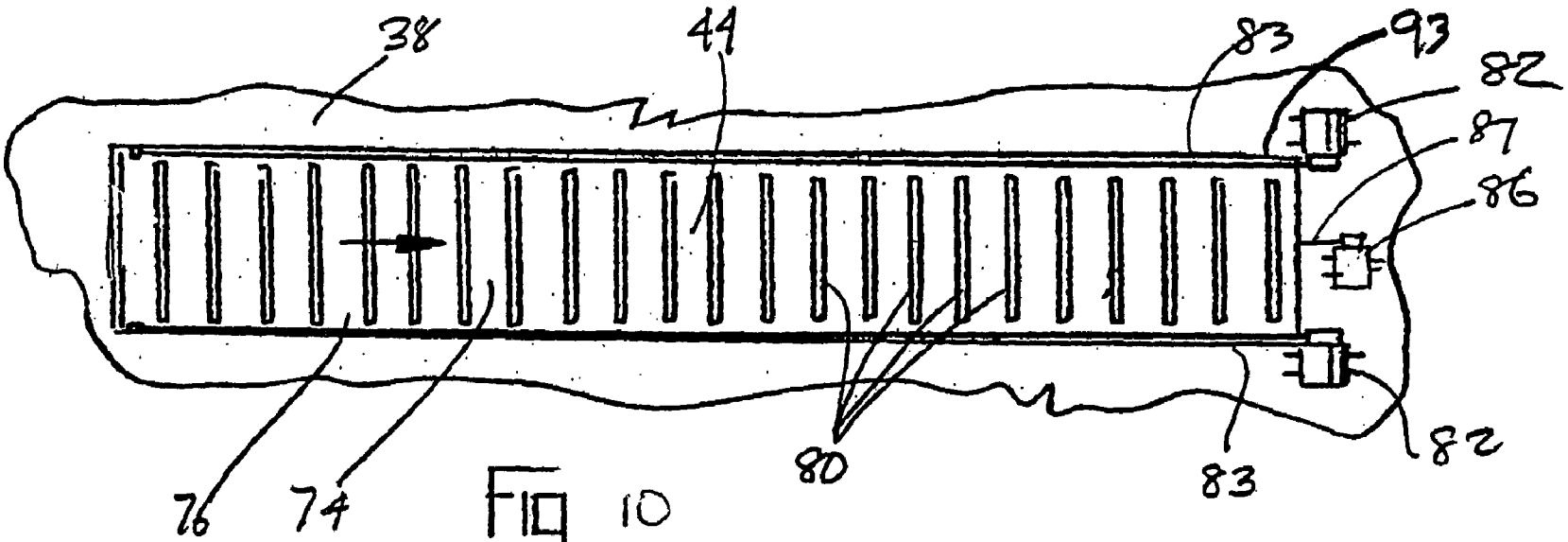
FIG. 10 is a top plan view of the hopper having a moveable floor.
Figure 11:
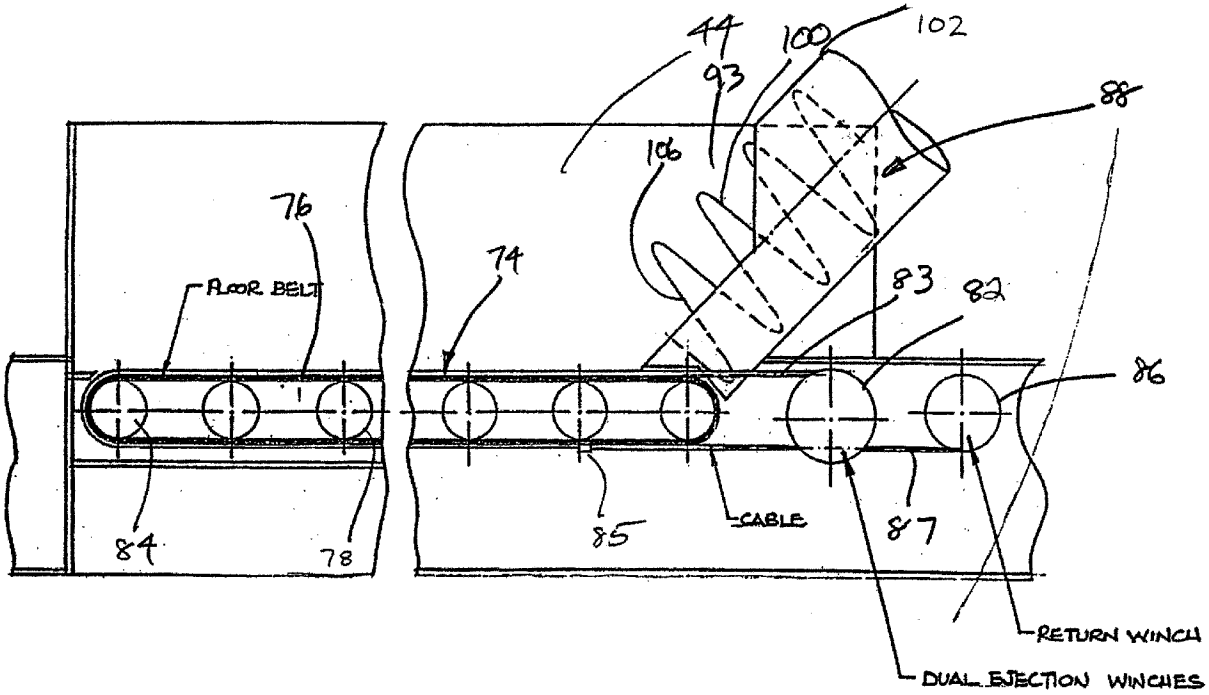
FIG. 11 is an enlarged, fragmentary side elevational view taken along line 11-11 of FIG. 10 showing the moveable floor and the ejection augers.

Referring now to FIGS. 10 and 11, the hopper 44 is provided with a movable floor 74. The movable floor 74 preferably extends over substantially the entire length and width of the hopper 44 and supports the material recovered in the dredging operation within the hopper 44. As most easily seen in FIG. 11, the movable floor 74 is preferably implemented by a conveyor belt 76 mounted upon a plurality of idler rollers 78 journalled between the side walls of the hopper 44. The idler rollers 78 are preferably mounted in low friction bearings (not shown) of conventional design and are closely spaced, but do not touch one another to minimize friction during movement of the floor 74.

The belt 76, which is preferably endless, is preferably implemented by commercially available conveyor belting material such as steel or nylon reinforced rubber. As shown in FIG. 10, the belt 76 is also preferably provided with steel cleats 80 to reduce, and preferably prevent, slippage between the moving floor 74 and the recovered material the floor supports as the material is being conveyed or moved by the floor 74.

The belt 76 is driven by a pair of ejection winches 82, which are operatively connected to a pair of cables 83 which extend along the top length of the belt 76, over an end roller 84, and back along the length of the belt 76 to an attachment point 85 (FIG. 11). A return winch 86 is provided, which also has a cable 87 secured to the attachment point 85. The arrangement of the winches 82, 86 and their associated cables 83, 87, respectively, makes possible a dual mode operation as follows. As material 36 is being deposited in the hopper 44 on the floor 74, the winches 82 gradually draw in their cables 83 and the winch 86 gradually lets out its cable 87. Thus, as the hopper 44 is loaded, the attachment point traverses the bottom of the hopper 44 (i.e., toward the left when viewing FIG. 11), to a point adjacent the end roller 84, at which point the hopper 44 is full of material 36. When it is desired to empty the hopper 44 (such as with the assistance of an ejection or discharge assembly 88 which will be described in greater detail below), the winches 82 continue to pull the belt 76 via the attachment point 85, such that the attachment point 85 travels up over the end roller 84, and traverses the hopper 44 again (i.e., this time to the right when viewing FIG. 11), as the discharge assembly 88 draws the material out of the hopper 44. When the hopper 44 is empty, the return winch 86 is used to reverse the motion of the belt 76.

Figure 12:
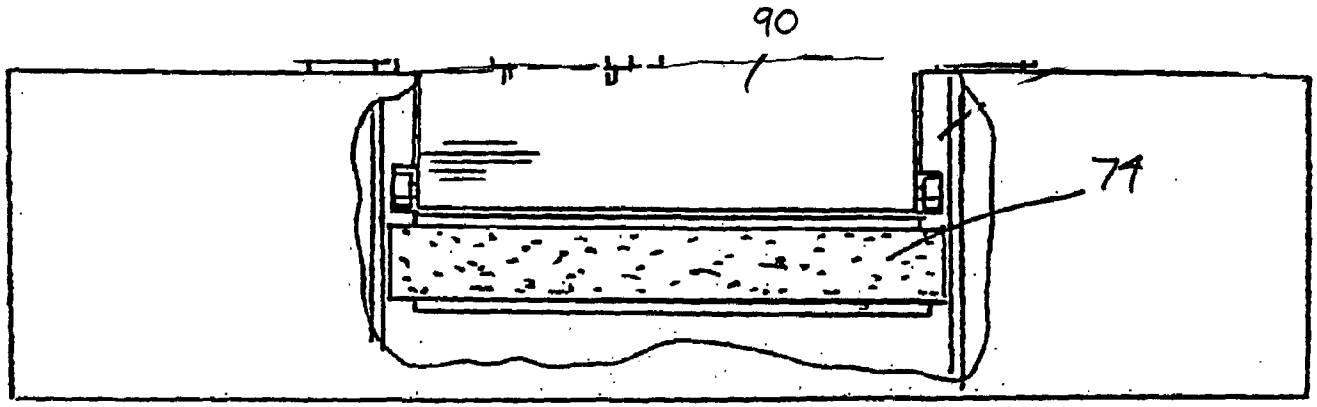
FIG. 12 is an enlarged fragmentary top plan view showing an alternative configuration for the hopper in which the slat conveyor floor of the hopper is supplemented by an ejector blade assembled in accordance with the teachings of the present invention.
Figure 13:
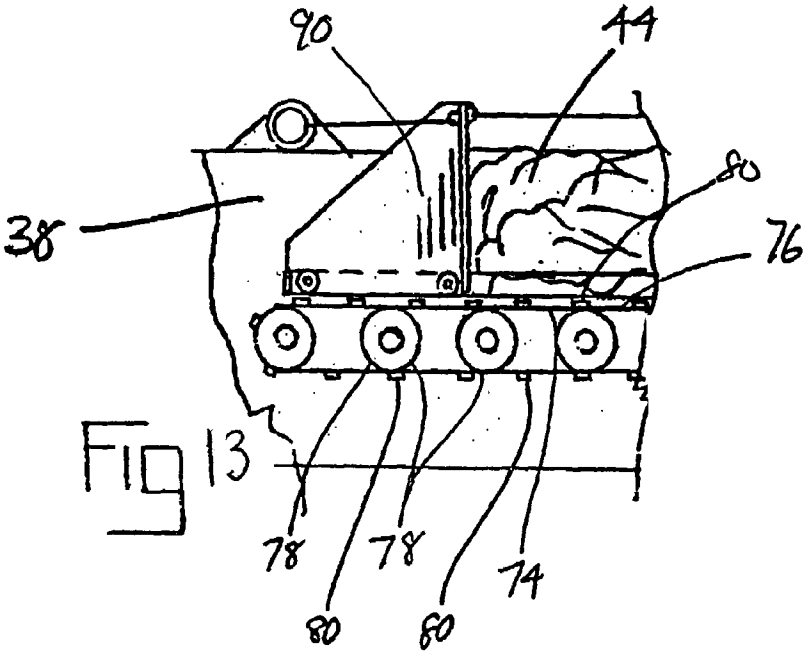
FIG. 13 is an enlarged fragmentary end view taken along line 1343 of FIG. 12, partly in cut away, illustrating the ejector blade.

As an alternative, the hopper 44 may be equipped with an ejector blade 90 as shown in FIGS. 12 and 13. The ejector blade 90 is preferably mounted within a pair of guides defined in the sidewalls of the hopper 44 and secured to the belt 76. The structure and function of the ejector blade 90 is described more fully in the the vessel and method for transporting and offloading section below. Note that in the present application, and by way of example rather than limitation, the blade 90 may be de-coupled from the flexible belt 16, such that the above-described dual mode operation is still possible. The blade 90 may then be operable independently to assist in clearing the material 36 from the hopper 44.

Referring now to FIGS. 1-6, a distribution conveyor 92 is preferably a faxed length conveyor and is mounted to the hull 38 adjacent an end 93 of the hopper 44. The distribution conveyor 92 is preferably mounted to a turret 94 of conventional design, and is rotatable on the turret 94 by a rack and pinion assembly 95. The distribution conveyor 92 includes a first end 96 disposed in a receiving box 97, and further includes a second end 98. As shown for example in FIG. 4, 5 or 6, the second end 98 can be placed at a desired location a substantial distance away from the hull 38, and can further be rotated or slewed by operation of the turret 94.

The discharge assembly 88 preferably includes a pair of counter-rotating augers 100, each of which is rotated by conventional electric or hydraulic motors as would be known. The augers 100 are disposed in a housing 102 having an ejection chute 104 generally adjacent to the receiving box 97. A bottom portion 106 of each auger 100 extends into the hopper 44, such that the material 36 may be extracted therefrom and conveyed through the housing 102 to the ejection chute 104, from where the material is conveyed to the first end 96 of the distribution conveyor 92 via the receiving box 97. The distribution conveyor 92 includes a flexible and rotatable belt and suitable drive motors, all of which are of conventional design and which are carried by a suitable support 108 mounted on the turret 94. The distance the second end 98 is disposed from the vessel 30 may typically be controlled simply by slewing the distribution conveyor 92 on its turret 94.

As shown in FIG. 1, the distribution conveyor 92 may optionally be extensible, such as by slidably mounting an extensible portion 110 in a suitable housing 111 defined in the support 108. A rack and pinion assembly 112 may be provided for extending and retracting the extensible portion 110.

In order to enhance the maneuverability of the vessel 30, the vessel 30 is further provided with stem and bow thrusters 114 on each of its sides as can be seen in each of FIGS. 1-3. The thrusters 114 are preferably implemented as low power water jets or impellers of conventional design. In other words, they are implemented by hydraulically or electrically driven impellers located in transverse tubes having preferably oval shaped outlet ports 116 to ensure the thrusters create a fan-shaped water stream (as opposed to a circular water jet which might be less effective than the fan-shaped jet in shallow water). A more detailed description of the thrusters may be found in the vessel and method for transporting and offloading section below.

The vessel 30 is also provided with a rudder (not shown) of conventional design, which enhances the steerability provided by the side thrusters 114. Suitable engines (not shown) are provided for primary propulsion, preferably twin engines having suitably spaced, high pitch low diameter screws. The engines along with the side thrusters 114, the rudder and the various other systems of the vessel 30 are preferably àontrolied from a control panel located in the cab 48.

While as described above, twin engines 58 are preferred as the primary source of propulsion for the vessel 50, persons of ordinary skill in the art will appreciate that water jets could be used in place of the engines 58 without departing from the scope or spirit of the invention.

In operation, the vessel proceeds along under power in a direction generally to the upper left when viewing FIG. 1. As described above, the rotating dredge wheel 42 continually deposits recovered material 36 into the trough 58, from where the material 36 is extracted by the augers 59 and deposited into the receiving box 71*a* of the conveyor 70. The material is then conveyed from the first end 71 to the second end 73, from where it is deposited into the receiving box 63*a* of the transfer conveyor 62.

The transfer conveyor 62 enables the conveyor system 60 to operate in a number of modes. One such mode is shown in FIG. 3, in which an adjacent transport vessel of the type described above is disposed alongside the vessel 30 and secured thereto by a suitable docking pins and capture anus of the type described more fully in the the vessel and method for transporting and offloading section below. By operation of the rack and pinion assembly 68, the transfer conveyor 62 maybe rotated on its turret 64 such that the second end 65 is disposed over the hopper of the adjacent vessel. According, the material 36 recovered by the dredge wheel 42 may be deposited along a path directly into the adjacent vessel for transport.

Another such operational mode is illustrated in FIG. 1, wherein the second end 65 of the conveyor 62 is positioned directly over the hopper 44 of the vessel 30. In this mode, the material may be directed along a path into the hopper 44. As the material 36 is deposited on the moveable floor 74, the winches 82 are activated such that the hopper 44 is gradually loaded as the moveable floor 74 carries the material 36 toward the discharge assembly 88. Further in this operational mode, once the hopper 44 is full it may be emptied by continuing to operate the winches 82. As the belt 76 proceeds as described above, the material 36 is conveyed toward the augers 100 of the discharge assembly 88, which augers 100 draw the material 36 from the hopper 44 and convey the material 36 to the receiving box 97 of the distribution conveyor 92 via the discharge chute 104. The material is then conveyed along the distribution conveyor 92 to the second end 98 thereof, from where the material is deposited at a desired location.

It will be understood that the vessel 30 may also load an adjacent vessel simultaneously with loading its own hopper 44, simply by independently positioning the transfer conveyors 62 on both sides of the vessel as required. It will also be understood that the vessel 30 may load the hopper 44 until full, cease dredging operations, and then travel to a designated location to deposit the material 36 (such as at a levee to be constructed, at an island to be constructed, or at a designated truck loading station if it is desired to haul the material 36 away). Other possible modes of operation will become readily apparent to those skilled in the art.

Referring now to FIGS. 14 through 21, a multi-purpose vessel constructed in accordance with the teachings of a second embodiment of the present invention is shown and is referred to by the reference numeral 130. To the extent possible, those elements that are the same or similar to the elements outlined above with respect to the first embodiment have the same or similar reference numerals, but increased by 100. The vessel 130 includes a hull 138, a dredge assembly 140, such as the same dredge wheel 142 construction, and a conveyor system 160. A trough 158 is disposed toward the center of the wheel 142, and is serviced by two, oppositely disposed augers 159 which function independently to discharge the recovered material 136 from the trough 158.

The conveyor system 160 includes first and second conveyors 170 and 172, as well as an intermediate transfer conveyor 162. The conveyor 170 includes a first end 171, a second end 173, and a receiving box 171*a*, while the second conveyor includes a receiving box 172*a* at a first end 172*b*, and further includes a second end 172*c*. The receiving boxes 171*a*, 172*a* work to contain the material 136 received at their respective ends. The conveyor system 160 also includes a transfer conveyor 162, which is mounted on a turret 164 of conventional design. Again, it will be understood that the vessel 130 is preferably provided with substantially similar conveyor systems 160 on both sides of the hull 138. The transfer conveyor 162 may be a rotatable belt conveyor, and includes a first end 163 and a second end 165. A receiving box 163*a* is provided adjacent the first end 163 in order to contain material 136 deposited thereon. A rack and pinion assembly 168 is provided, which enables the transfer conveyor 162 to be rotated or pivoted between the position shown in FIG. 14, in which the second end 165 of the transfer conveyor 162 is disposed over the receiving box 172*a* of the conveyor 172, to the position of FIG. i~ in which the second end 165 of the transfer conveyor 162 is disposed over the hopper 144, and to the position of FIG. 16 in which the second end 165 of the transfer conveyor is disposed over the hopper of an adjacent transport vessel. Again, each turret 164 permits the corresponding receiving box 163*a* and transfer conveyor 162 to rotate approximately 180°.

Figure 14:
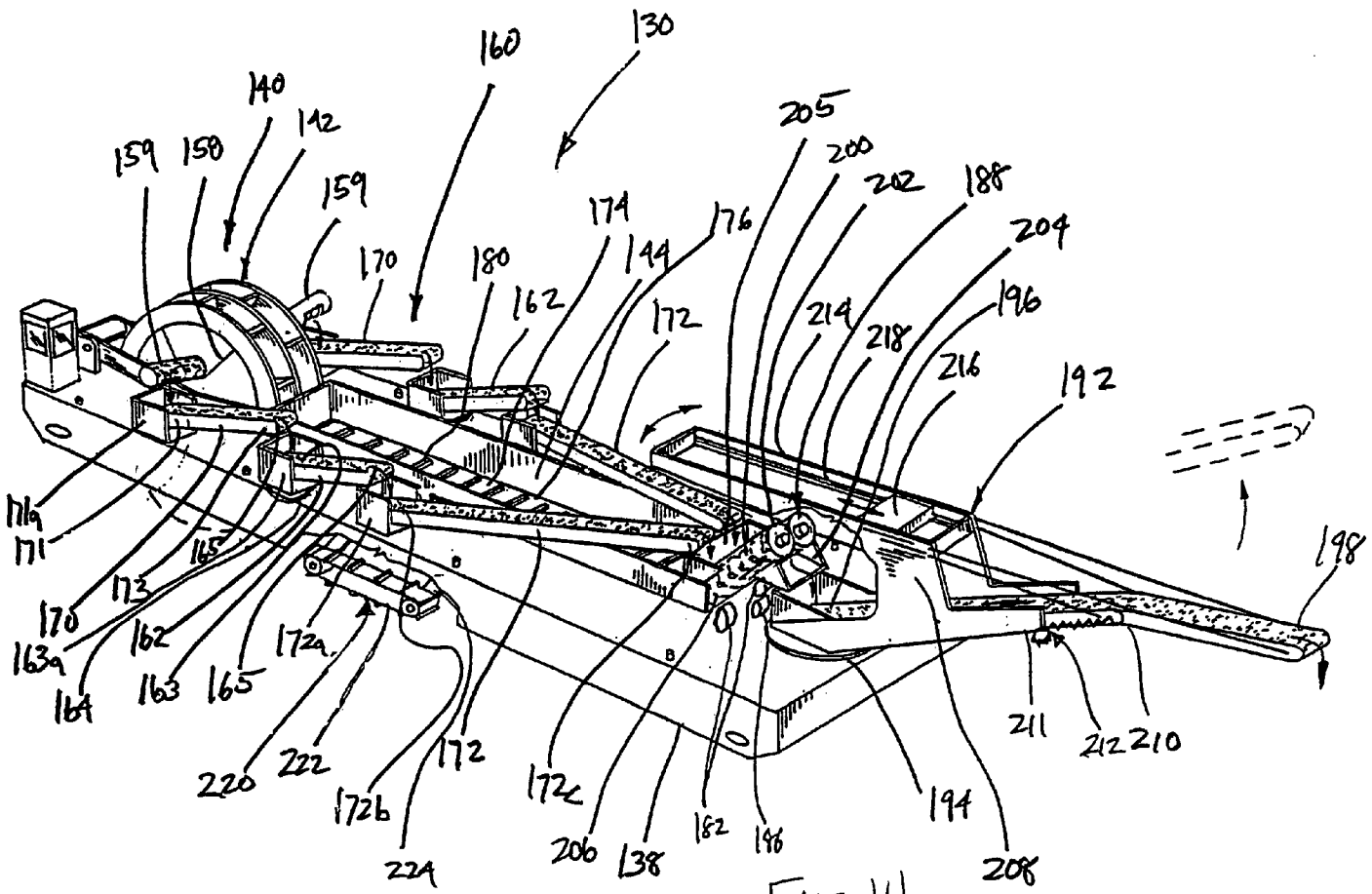
FIG. 14 is a perspective view of another multi-purpose vessel for use in a dredging operation which has been constructed in accordance with the teachings of the present invention, the vessel is shown in one possible state of operation in which recovered material is being conveyed directly toward a distribution conveyor for deposition therefrom at a desired location.

The hopper 144 includes a moveable floor 174 of the type described above with respect to the first embodiment. The movable floor 174 preferably extends over substantially the entire length and width of the hopper 144 and supports the material recovered in the dredging operation within the hopper 144. The movable floor 174 is preferably implemented by an endless conveyor belt 176 mounted upon a plurality of idler rollers (not shown). As shown in FIG. 14, the belt 176 is also preferably provided with steel cleats 180 to reduce, and preferably prevent, slippage between the moving floor 174 and the recovered material the floor supports as the material is being conveyed or moved by the floor 174. The belt 176 is driven by a pair of ejection winches 182 and a retracting winch 186, so as to be capable of the dual mode operation described above.

Referring now to FIGS. 14-18, a distribution conveyor 192 is mounted to the hull 138 adjacent an end 193 of the hopper 144. The distribution conveyor 192 is preferably mounted to a turret 194 of conventional design, and is rotatable on the turret 194 by a rack and pinion assembly 195. The distribution conveyor 192 includes a first end. 196 disposed in a receiving box 197, and further includes a second end 198. As shown to advantage in FIGS. 17-19, the second end 198 can be placed at a desired location a substantial distance away from the hull 138, and can further be rotated or slewed by operation of the turret 194.

Figure 17:
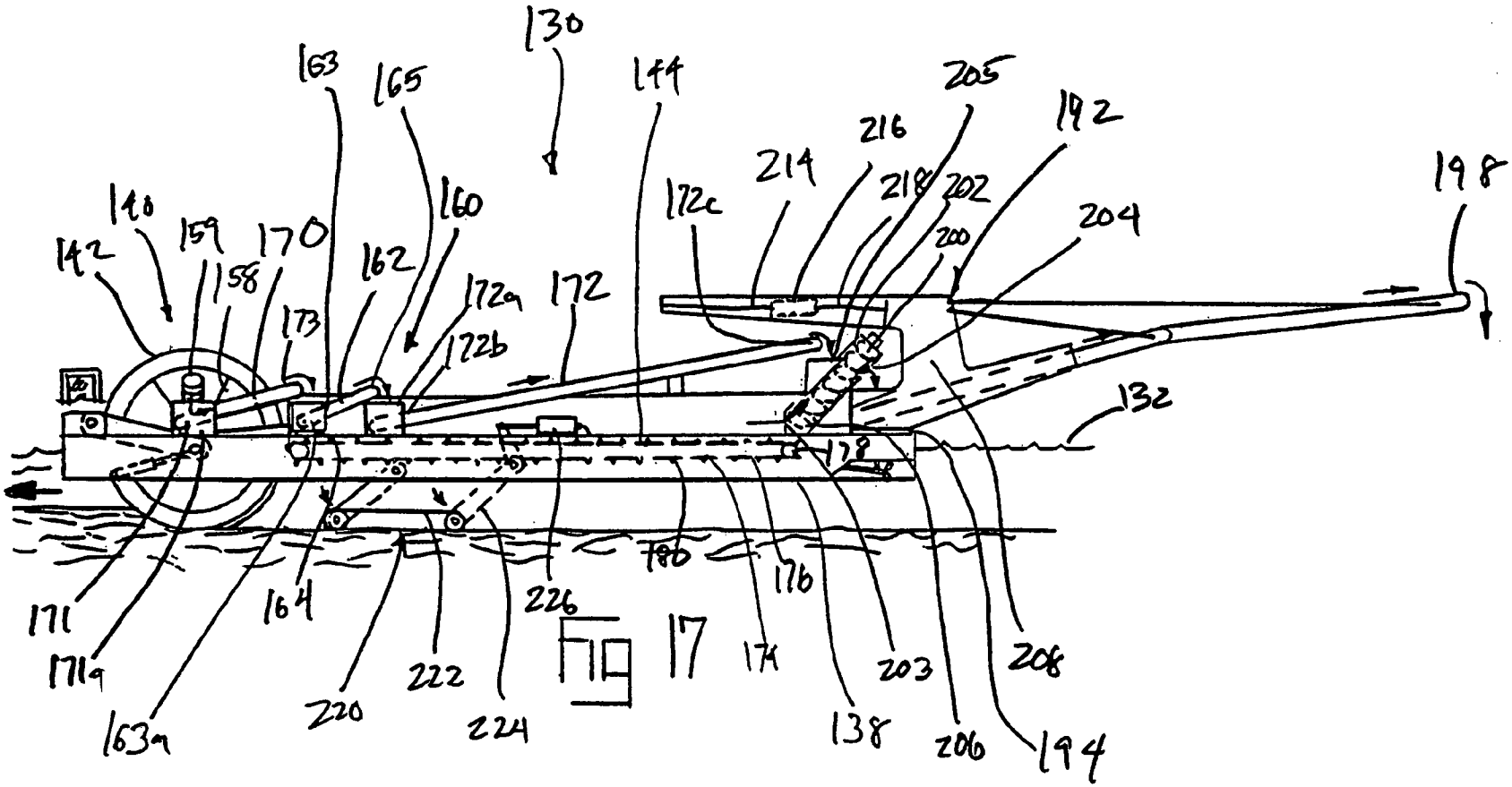
FIG. 17 is a side elevational view of the vessel of FIG. 14.
Figure 18:
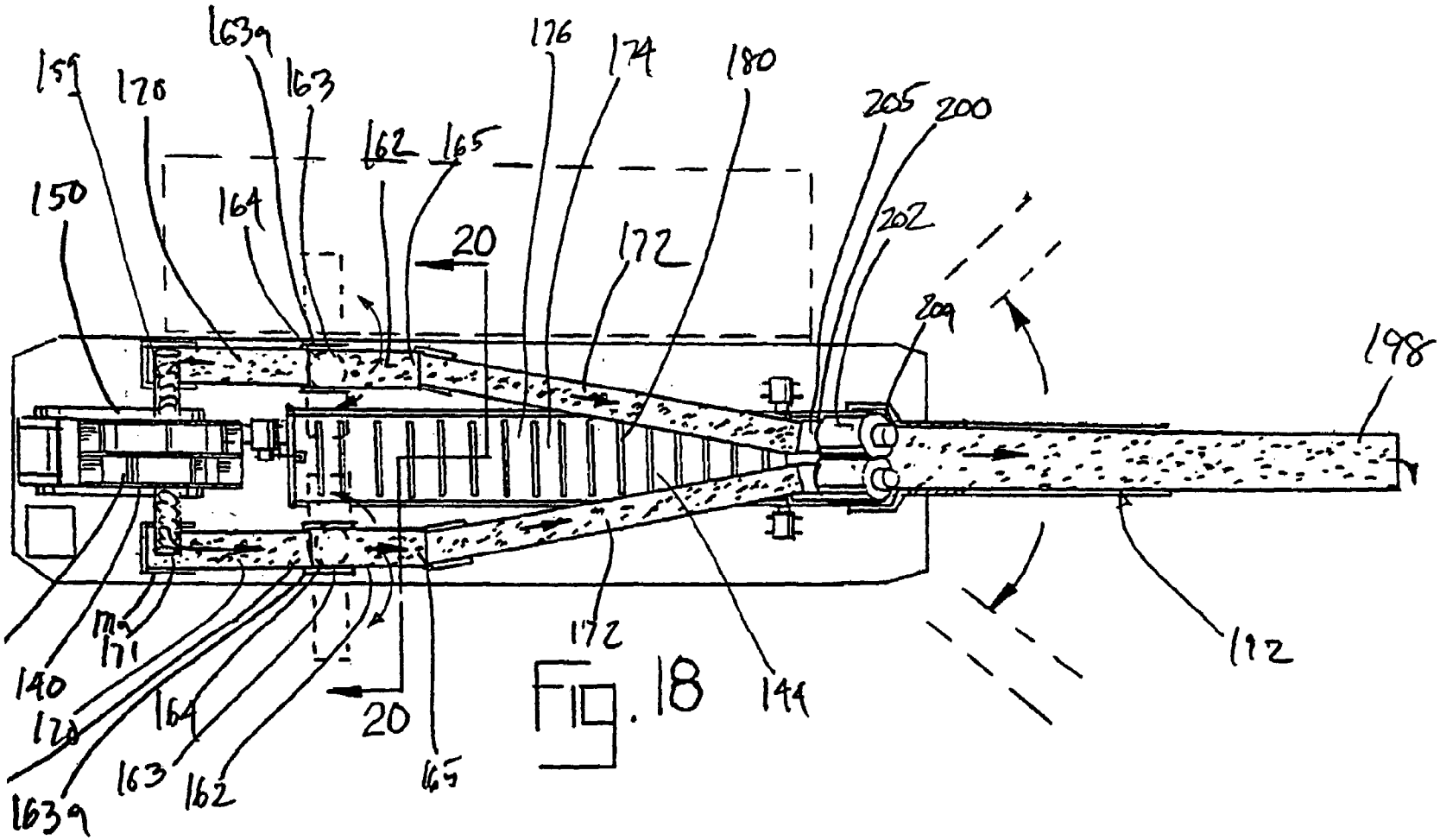
FIG. 18 is a top plan view thereof illustrating the manner by which portions of the conveyor system and the distribution conveyor may be rotated or slewed.

The discharge assembly 188 preferably includes a pair of counter-rotating augers 200, each of which is rotated by conventional electric or hydraulic motors as would be known. The augers 200 are disposed in a housing 202 having an ejection chute 104 generally adjacent to the receiving box 197. A bottom portion 206 of each auger 200 extends into the hopper 144, such that the material 136 may be extracted therefrom and conveyed through the housing 202 to the ejection chute 204, from where the material is conveyed to the first end 196 of the distribution conveyor 192 via the receiving box 197. As can be seen in FIG. 17, the housing 202 includes a lower inlet 203, through which material 136 may be drawn from the hopper 144, and further includes an upper inlet 205, through which material 136 may be received from the second end 172*e* of the conveyor 172. Material entering through either inlet 203 or 205 will be conveyed by the augers 200 to the discharge chute 204, for deposition onto the first end 96 of the distribution conveyor 192. The distribution conveyor 192 includes a flexible and rotatable belt and suitable drive motors, all of which are of conventional design and which are carried by a suitable support 208 mounted on the turret 194. The distance the material 136 is deposited away from the hull 138 may typically be controlled by slewing the distribution conveyor 192 on its turret 194.

As shown in FIG. 17, the distribution conveyor 192 may optionally be extensible, such as by slidably mounting an extensible portion 210 in a suitable housing 211 defined in the support 208. A rack and pinion assembly 212 may be provided for extending and retracting the extensible portion 210.

The distribution conveyor 192 includes a support 208 which includes an extending cantilevered portion 214. The cantilevered portion 214 includes a moveable counterweight 216 (FIGS. 14-16) which is slidably mounted in a track 218 defined in the cantilever portion 214. The counterweight 216 is slidable within the track, such as by a rack and pinion arrangement or a winch and cable assembly (not shown), so as to counteract the significant weight of the material, on the conveyor 192.

Figure 21:
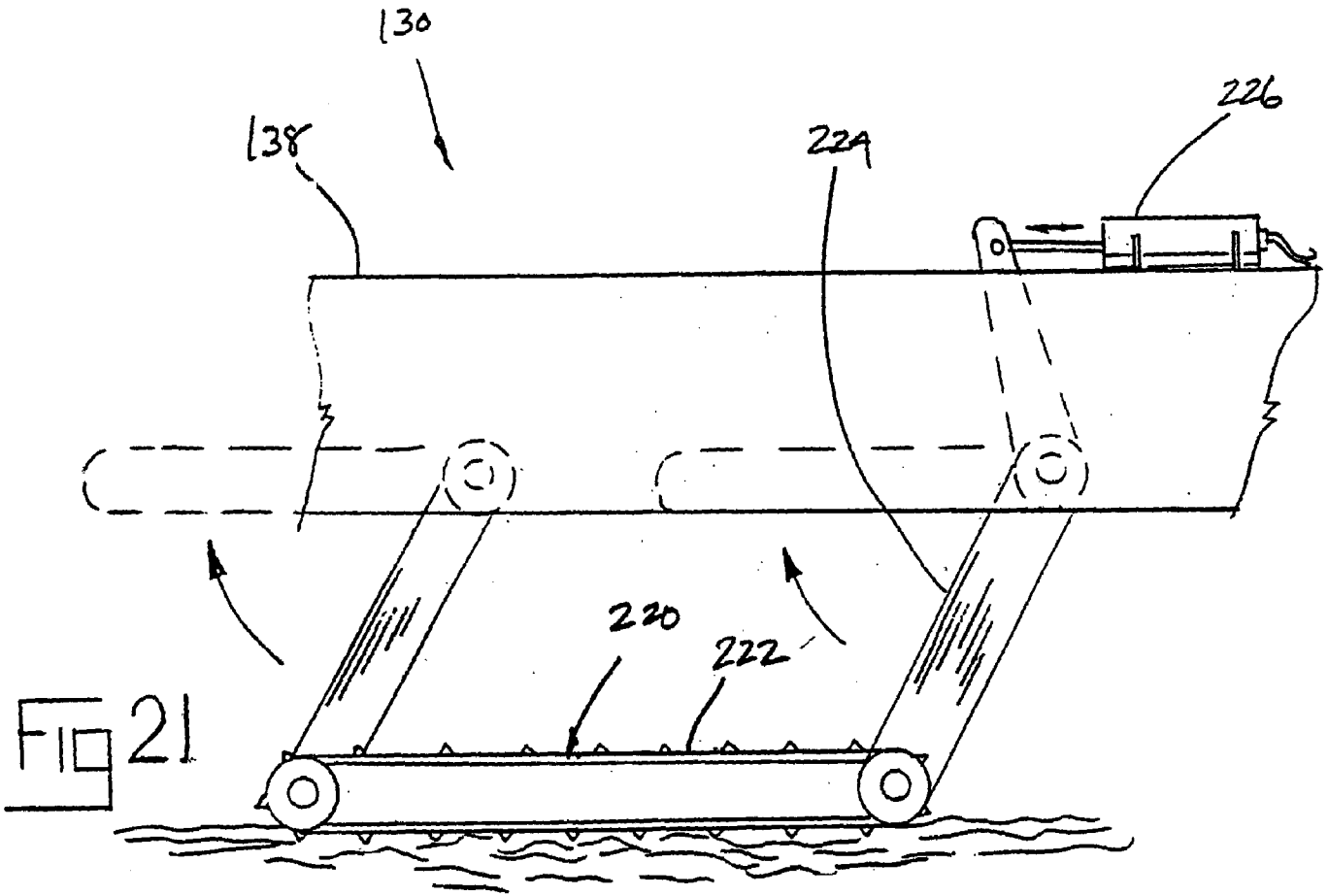
FIG. 21 is an enlarged fragmentary side elevational view of an alternate retractable tractive propulsion element constructed in accordance with the teachings of the present invention.

Referring now to FIGS. 14, 15, 17 and 19-21, a propulsion system 220 having a flexible tractive belt is mounted to the underside of the hull 1.38. Such a propulsion system 220 may be used in place of or in addition to a more traditional propulsion system (not shown) such as water jets or propeller drive systems. The propulsion system 220 includes a flexible, cleated track 222, and is mounted to a retractable linkage assembly 224 actuated by a hydraulic cylinder 226 (FIG. 21). The linkage assembly 224 permits the track 222 to be raised and lowered between the drive position of FIG. 21 and the retracted position shown in phantom in FIG. 21. The track 222 is preferably driven by hydraulic motors having suitably sealed operating systems. Such a flexible track 222 having a hydraulic drive system is manufactured by Caterpilar®.

In operation, the vessel 130 proceeds along under power in a direction generally to the upper left when viewing FIG. 14. As described above, the rotating dredge wheel 142 continually deposits recovered material 136 into the trough 158, from where the material 136 is extracted by the augers 159 and deposited into the receiving box 171*a* of the conveyor 170. The material is then conveyed from the first end 171 to the second end 173, from where it is deposited into the receiving box 163*a* of the transfer conveyor 162.

Figure 16:
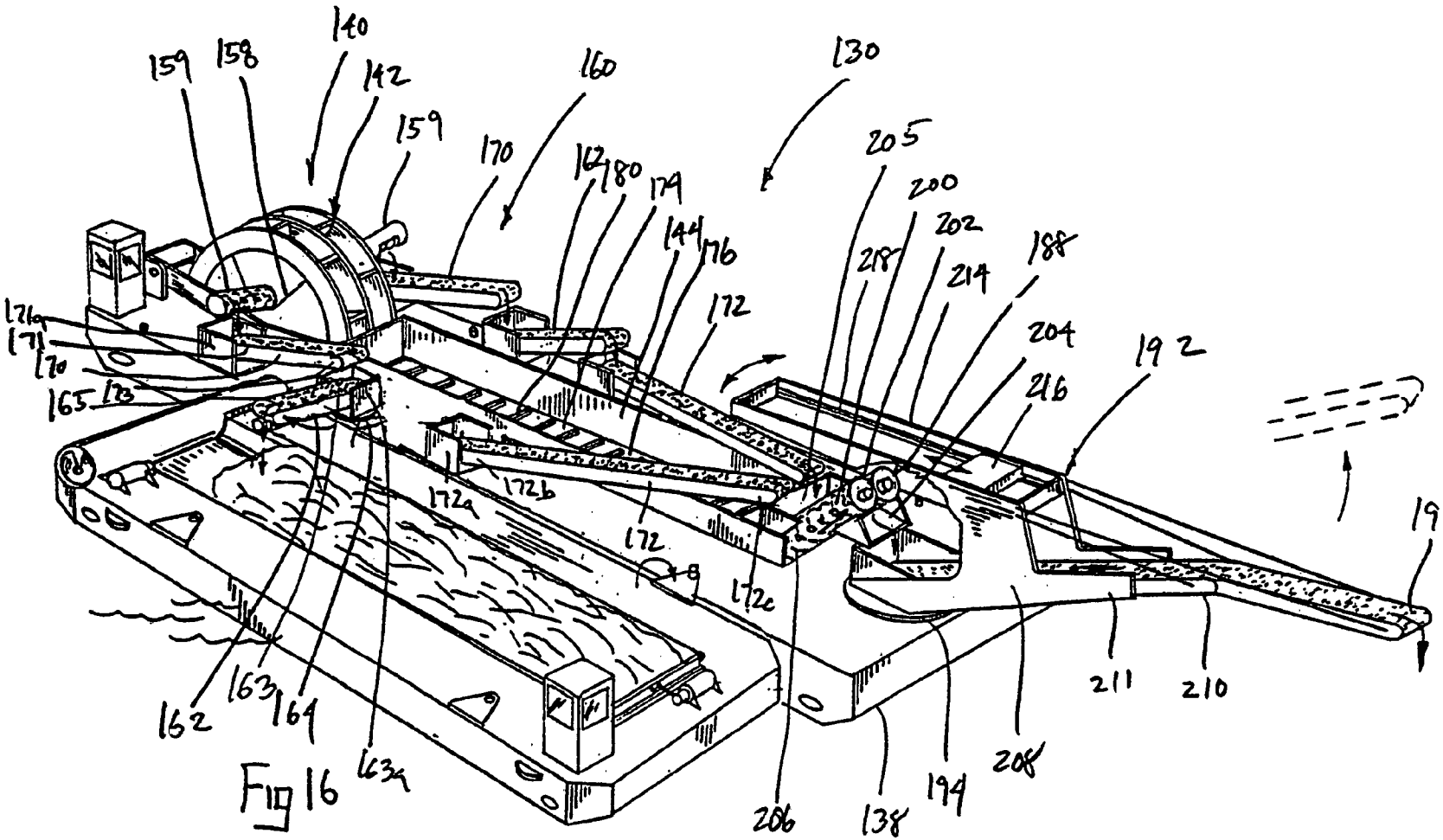
FIG. 16 is a perspective view of the vessel of FIG. 14, but shown in a third possible state of operation in which the recovered material is being directed toward a storage hopper.

The transfer conveyor 162 enables the conveyor system 160 to operate in a number of modes. One such mode is shown in FIG. 16, in which an adjacent transport vessel of the type described above is disposed alongside the vessel 130 and secured thereto by a suitable docking pins and capture arms of the type described more fully in the vessel and method for transporting and offloading section below. By operation of the rack and pinion assembly 168, the transfer conveyor 162 maybe rotated on its turret 164 such that the second end 165 is disposed over the hopper of the adjacent vessel. Accordingly, the material 136 recovered by the dredge wheel 142 may be deposited along a path directly into the adjacent vessel for transport.

Figure 15:
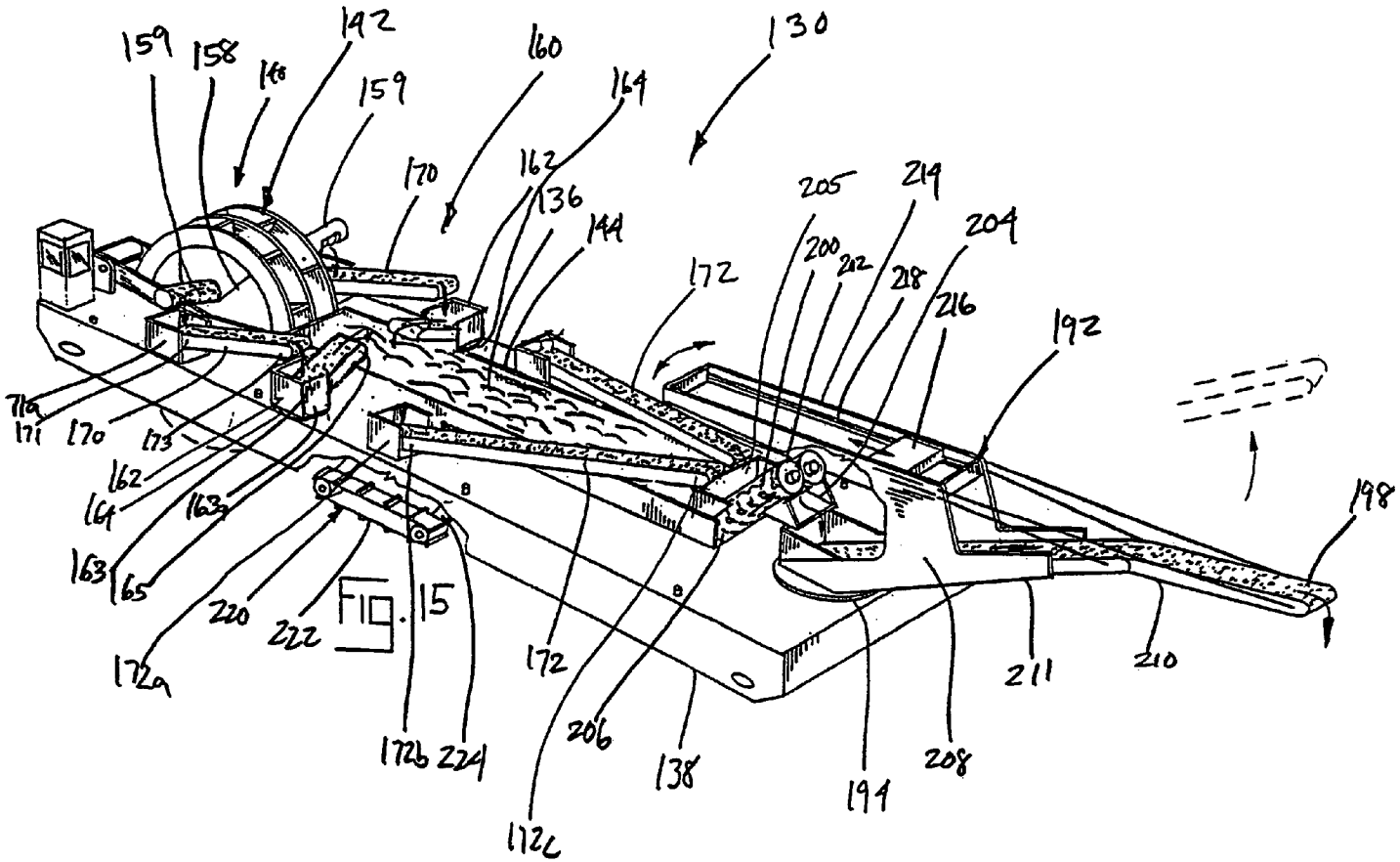
FIG. 15 is a perspective view of the vessel of FIG. 14, hut shown in a second possible state of operation in which the recovered material is being conveyed to an adjacent transport vessel.

Another such operational mode is illustrated in FIG. 15, wherein the second end 165 of the conveyor 162 is positioned directly over the hopper 144 of the vessel 130. In this mode, the material may be directed along a path into the hopper 144. As the material 136 is deposited on the moveable floor 174, the winches 182 are activated such that the hopper 144 is gradually loaded as the moveable floor 174 carries the material 136 toward the discharge assembly 188. Further in this operational mode, once the hopper 144 is full it may be emptied by continuing to operate the winches 182. As the belt 176 proceeds as described above, the material 136 is conveyed toward the augers 200 of the discharge assembly 188, which augers 200 draw the material 136 from the hopper 144 through the lower inlet 203 and convey the material 136 to the receiving box 197 of the distribution conveyor 192 via the discharge chute 204. The material 136 is then conveyed along the distribution conveyor 192 to the second end 198 thereof, from where the material is deposited at a desired location.

It will be understood that the vessel 130 may also load an adjacent vessel simultaneously with loading its own hopper 144, simply by independently positioning the transfer conveyors 162 on both sides of the vessel as required it will also be understood that the vessel 130 may load the hopper 1.44 until full, cease dredging operations, and then travel to a designated location to deposit the material 136 (such as at a levee to be constructed, at an island to be constructed, or at a designated truck loading station if it is desired to haul the material 136 away).

Figure 19:
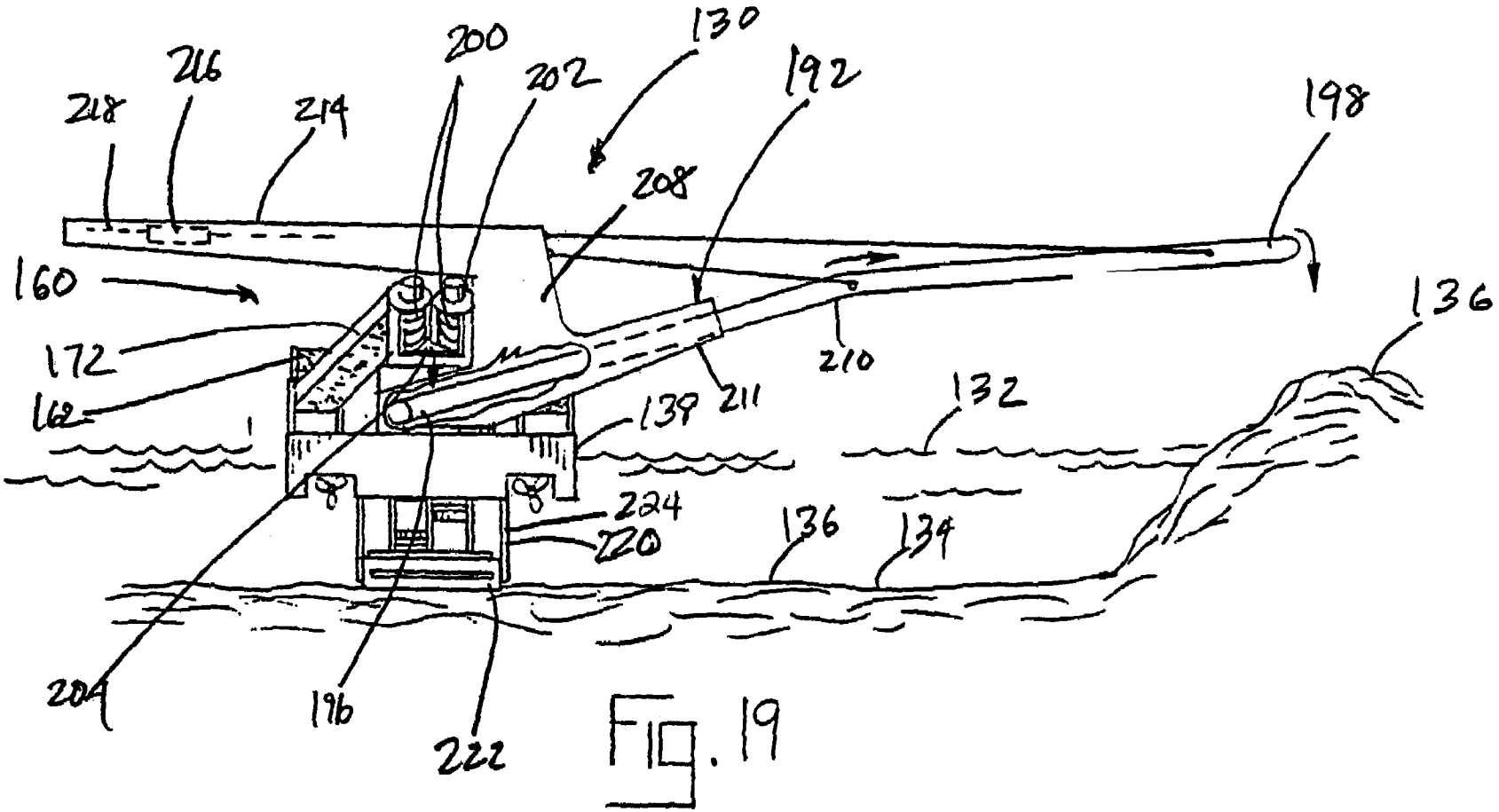
FIG. 19 is stem end elevational view of the vessel illustrating the manner by which the distribution conveyor may be slewed to deposit recovered material at a desired location away from the vessel.
Figure 20:
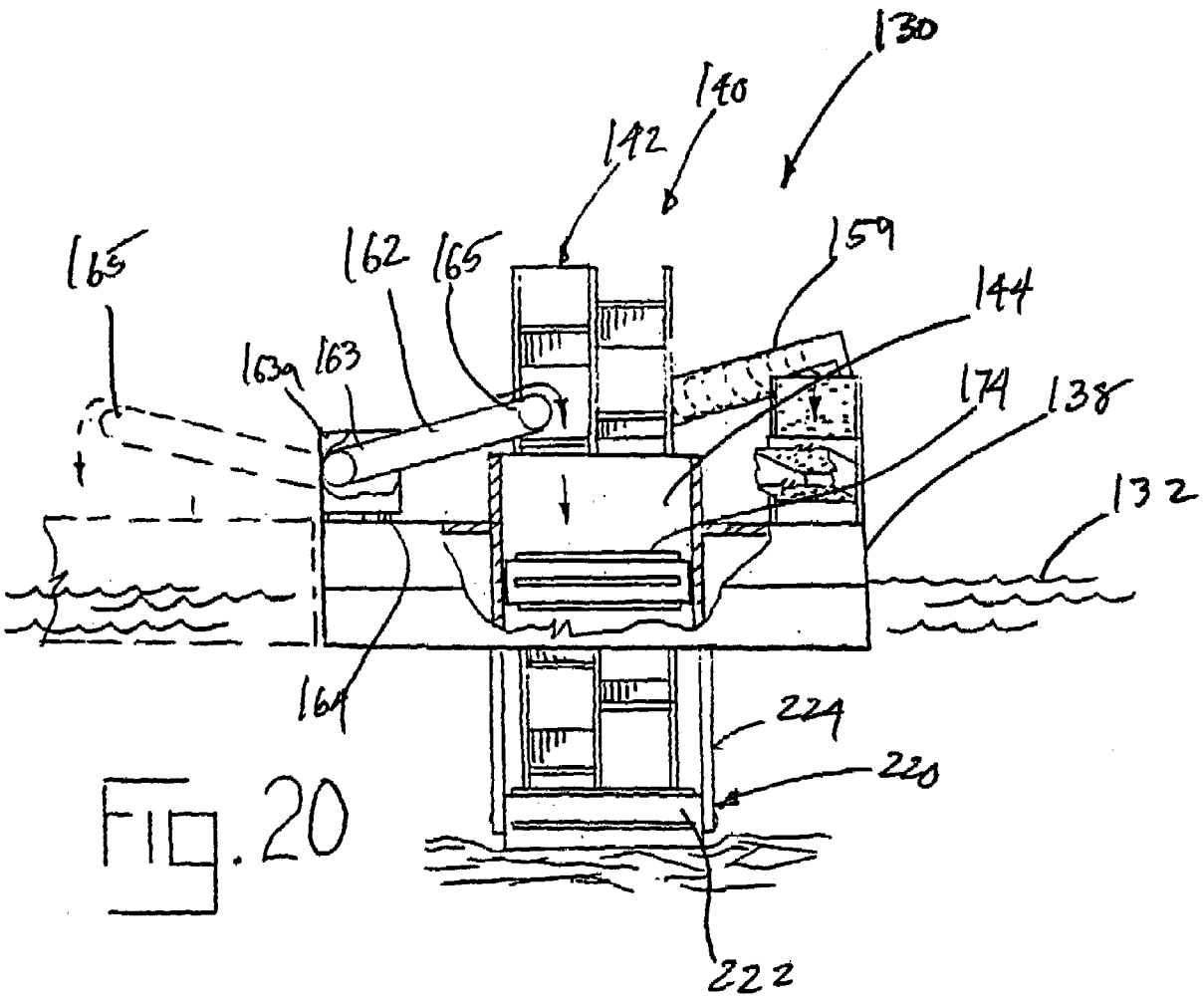
FIG. 20 is an enlarged fragmentary cross-sectional view taken along line 20-20 of FIG. 18.

Another possible mode of operation is illustrated in FIGS. 14 and 19. With the transfer conveyor 162 positioned as shown with the second end 16.5 disposed over the receiving box 172*a* of the conveyor 172, the material 136 may be routed directly and continuously to the distribution conveyor as the vessel 130 operates. As shown in FIG. 19, with the distribution conveyor 192 slewed by rotating the conveyor on its turret 194, the vessel may deposit the material on the riverbank, on a levee, or build an island as the vessel 130 continues through the waterway in certain circumstances wherein there is not enough room in a channel top operate adjacent transport vessels, the vessel 130 can directly transport the material 136 sideways for deposit until a working channel has been created. Alternatively, the vessel 130 can create a levee as it travels through the waterway, and can even repair a breach in a levee as it travels by slewing, advancing, and/or retracting the conveyor 192 as required to continuously deposit material 136 at a designated location. Accordingly, the vessel 130 can operate quickly to construct a levy using on-site materials, namely, materials dredged from the bottom of a waterway threatening to flood, In view of the large volumes of material that can be recovered and deposited quickly by the vessel 130, levies can be constructed or repaired in a very short thne frame to address a potentially dangerous situation. Again, other possible modes of operation, including operating in a number of modes simultaneously, will: become readily apparent to those of skill in the art.

VESSEL AND METHOD FOR TRANSPORTING AND OFFLOADING

In the following description and drawings, like reference numerals are generally used to refer to like structures. With the exception of the dredging vessel 510, in the case of different vessels having similar structures, whenever possible the last two digits of reference numerals to similar structures are identical. Thus, for example, the hull of the vessel 550 is labeled with reference numeral "52" and the hull of the vessel 800 is labeled with reference numeral "852". While this nomenclature has been used for ease of understanding, it is not intended to suggest identity between corresponding structures in different vessels unless exactly the same reference numeral is employed to refer to the corresponding structures in both vessels.

Figure 22:
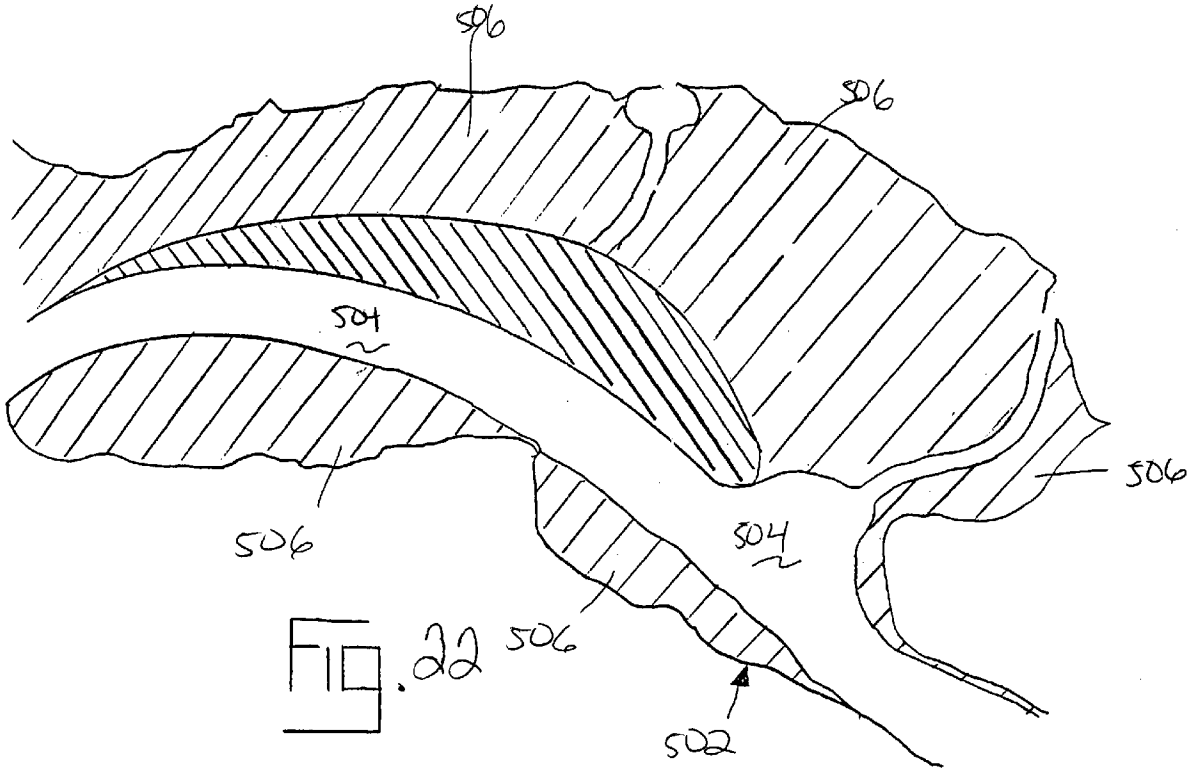
FIG. 22 is an illustration of an exemplary environment of use for the disclosed methods and vessels.

A portion of a river 502 is shown in FIG. 22. The illustrated river 502 is exemplary of many rivers of the world in that it includes a main channel 504 through which vessels such as barges pass and shallower areas 506 around the channel 504 wherein at best only smaller, low draft vessels can pass. Both the main channel 504 and the surrounding areas 506 are shallower than their historic levels due to erosion.

A. Exemplary Dredging Vessel

Figure 23:
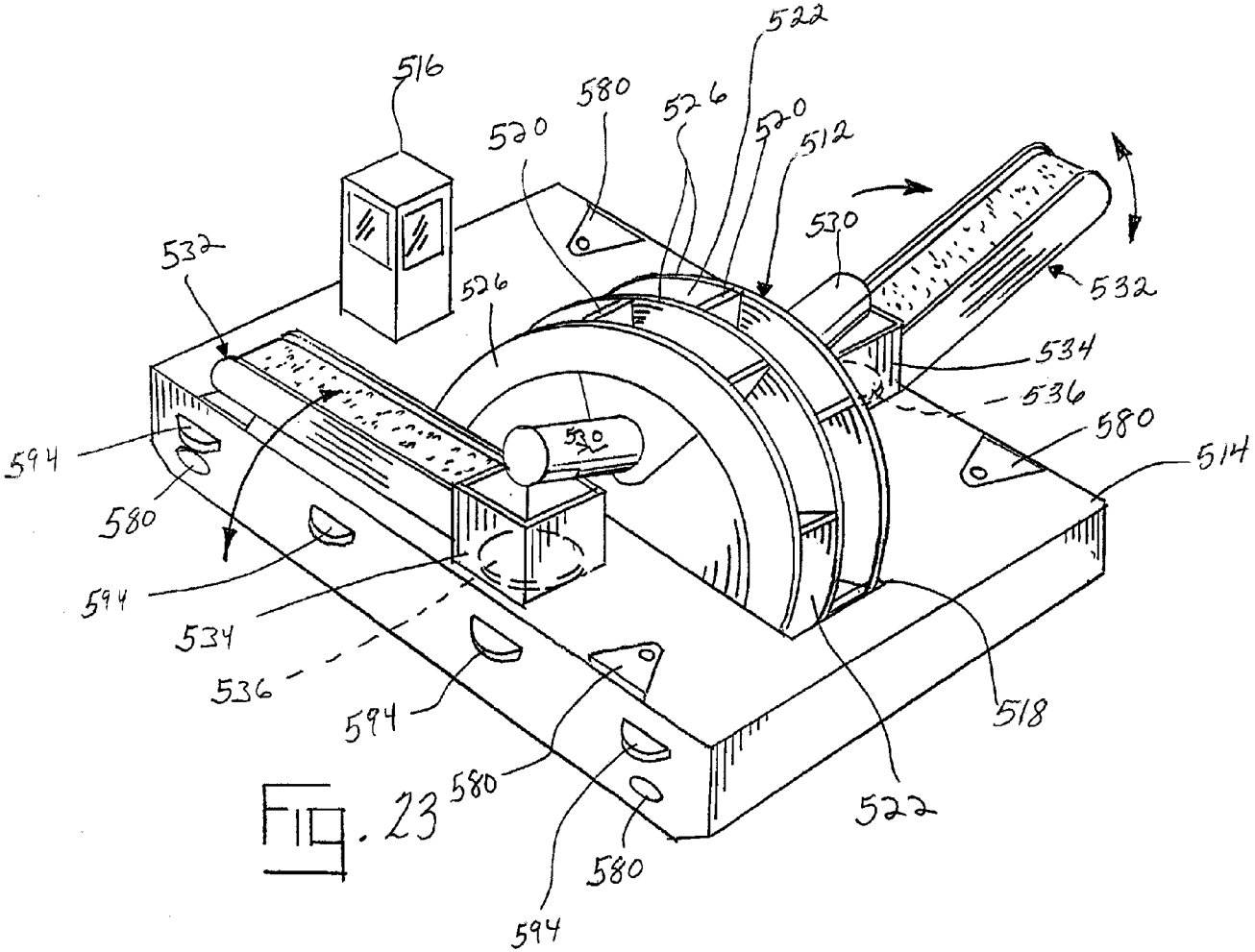
FIG. 23 is a right, front perspective view of an exemplary dredging vessel.

As mentioned above, a dredging wheel has been developed that can be used to rapidly dredge large amounts of solid material from the bottom of a waterway such as the river shown in FIG. 22. An exemplary dredging vessel 510 incorporating dredging wheel 512 is shown in FIG. 23. The dredging vessel 510 includes a hull 514 which is designed with a low draft for operation in shallow water. The hull 514 is powered by a propulsion system (not shown) which is controlled by an operator located in a cab 516 in a conventional manner. The dredging wheel 512 is located in a well or aperture 518 which is formed generally centrally relative to the hull 514. The wheel 512 is supported by hydraulic jacks 519 (See FIGS. 24-25) or the like which can be powered to raise or lower the dredging wheel 512 to a desired depth for dredging or transport.

For the purpose of capturing material to be dredged from the bed of the waterway (hereinafter "recovered material"), the dredging wheel 512 is provided with a number of generally evenly spaced blades 520. The blades 520 divide the outer perimeter of the dredging wheel 512 into a plurality of capture cavities 522. Two blades 520 form two, oppositely disposed sides of each capture cavity 522. The other two opposite sides of the cavities 522 are formed by generally parallel, circular wheel plates 526. The top and bottom of each capture cavity 522 are open.

Figure 24:
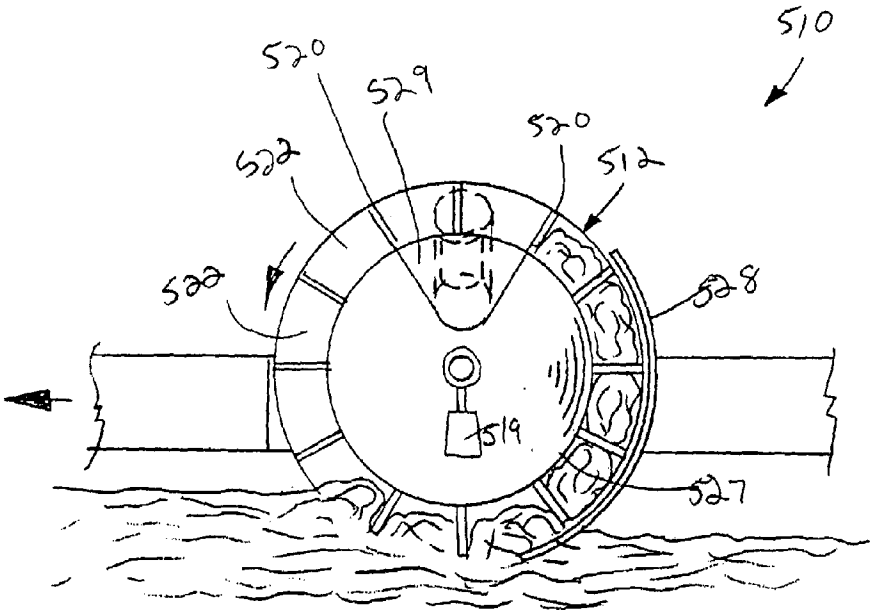
FIG. 24 is a partial, cut-away side view of the dredging wheel of the dredging vessel of FIG. 2 in a first state of operation.

In operation, as the dredging vessel 510 moves forward, the dredging wheel 512 rotates such that a capture cavity 522 digs into the waterway bottom and collects a slab of material to be dredged (See FIG. 24). As the wheel 512 continues to rotate, the filled capture cavity 522 rotates between an inner capture plate 527 and an outer capture plate 528 formed at the back of the wheel 512. (The outer capture plate 528 is not shown in FIG. 23 to provide a better view of the capture cavities 522.) The capture plates 527, 528 seal the top and bottom openings of the capture cavity 22 to ensure the recovered material remains in the cavity 522 as the cavity 522 rotates toward the top of the wheel 512. As the filled capture cavity 522 reaches the top of the wheel 512, the inner capture plate 527 terminates such that, when the filled cavity 522 reaches the top of the wheel 512, the dredged material falls out of the capture cavity 522 under the influence of gravity (and, optionally, under the influence of a mechanical assist (not shown)) and into a hopper 529 in the center of the wheel 512.

Figure 36:
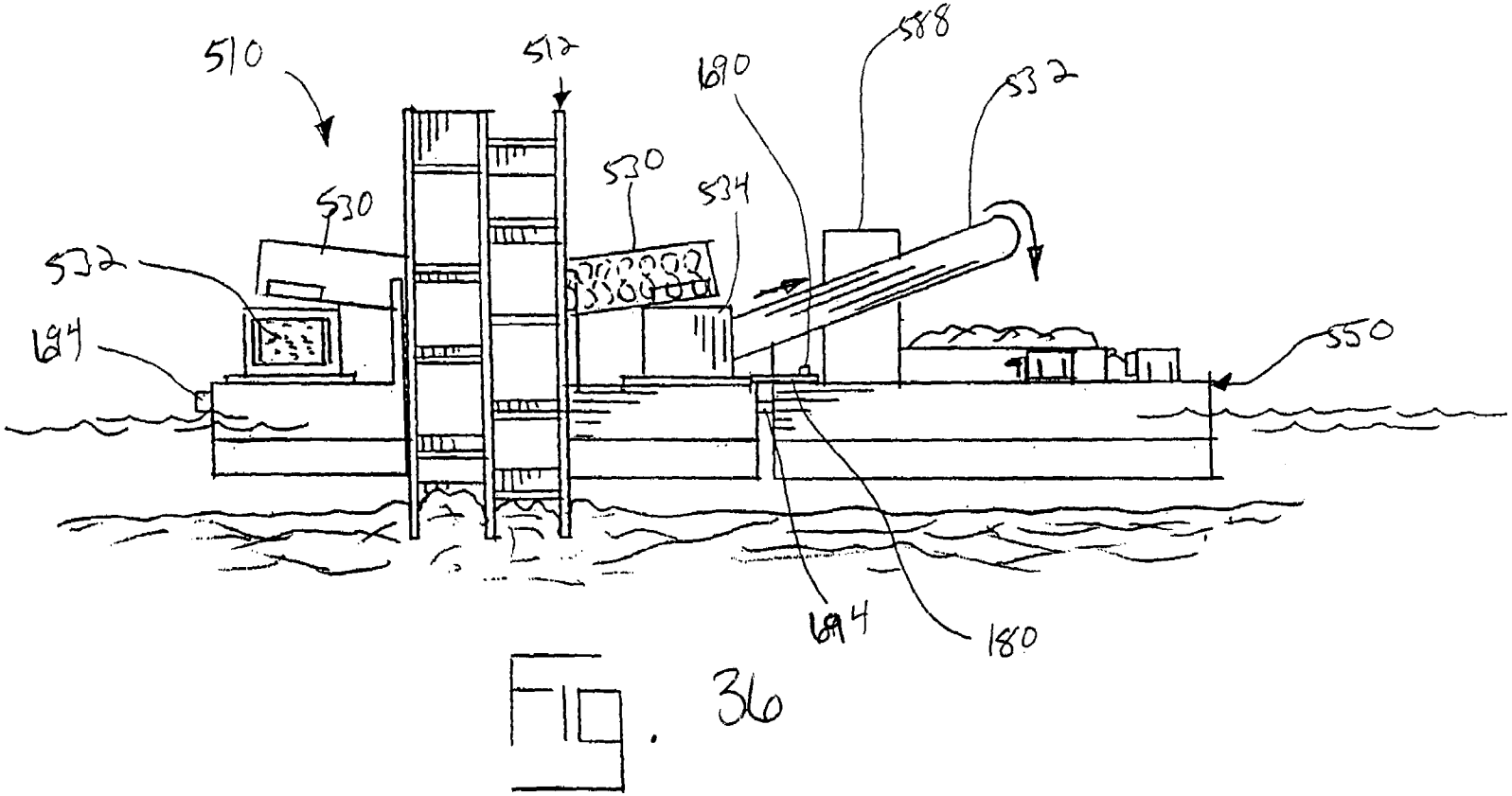
FIG. 36 is a side view of the dredging vessel of FIG. 23 loading the material transportation vessel of FIG. 26.

As shown in FIG. 23, the hopper 529 is serviced by two, oppositely disposed augers 530 which function independently to discharge the recovered material from the hopper 529 at the center of the wheel 512. For the purpose of off-loading material from the dredging vessel 510, the dredging vessel 510 is further provided with rotatable conveyors 532. As shown in FIG. 23. each of the conveyors 532 extends into a receiving box 534 mounted beneath a respective one of the augers 530 of the dredging wheel 512. The receiving boxes 534 act as guides to ensure the dredged material dropped by the corresponding auger 530 stays on the corresponding conveyor 532. As shown in FIG. 36 the conveyors 532 are preferably upwardly inclined to facilitate loading into an adjacent vessel.

Each of the conveyors 532 is supported within its receiving box 534 upon a turret 536 of conventional design. Each turret 536 permits the corresponding receiving box 534 and conveyor 532 to rotate approximately 180 degrees. Persons of ordinary skill in the art will readily appreciate that both the turrets 536 and the belts of the conveyors 532 can be driven in many ways without departing from the scope or spirit of the invention. By way of examples, not limitations, the conveyor belts and/or the turrets 536 can be driven by electrical motors or hydraulic motors.

Additional details concerning the structure and function of the dredging wheel 12 can be found in Saltzer. U.S. Pat. No. 5,903,989, Satzler, U.S. Pat. No. 5,907,915, and U.S. patent application Ser. No. 08/834,676 which are all hereby incorporated by reference in their entirety.

As persons of ordinary skill in the art will appreciate from the foregoing, the dredging wheel 512 provides an efficient, cost effective means for dredging a waterway. By using the dredging wheel 512, a large volume of substantially solid silt and/or other material can be quickly removed from a bed of a waterway such as a river.

B. Material Transportation Vessel

For the purpose of transporting the material recovered in the dredging operation, the applicants have developed a water-borne material distribution vessel 800 and a water-borne material transportation vessel 550 for transporting recovered material from the dredging vessel 510 to the material distribution vessel 800. The structure and function of representative examples of each of these vessels 550, 800 is fully disclosed below. However, before reaching that discussion, it must be noted that, although in the preferred implementation, the disclosed vessels 550, 800 are operated together to form a system for transporting recovered material, the vessels 550, 800 can be operated alone or in combination with different types of vessels and/or other structures without departing from the scope or spirit of the invention. Similarly, although in the presently preferred implementation, the vessels 550, 800 are operated in support of a dredging vessel employing the dredging wheel 12, the vessels 550, 800 can be used with other types of dredges without departing from the scope or spirit of the invention.

Turning to the material transportation vessel 550 shown in FIGS. 26-35, for the purpose of entering shallow water, the vessel 550 is provided with a low draft hull 552. In particular, the surface area of the bottom of the hull 552 is preferably selected to ensure the vessel 550 has a draft of about four feet of water when fully loaded and a draft of about 12 inches when empty. Of course, other drafts can he selected without departing from the scope or spin of the invention.

Figure 26:
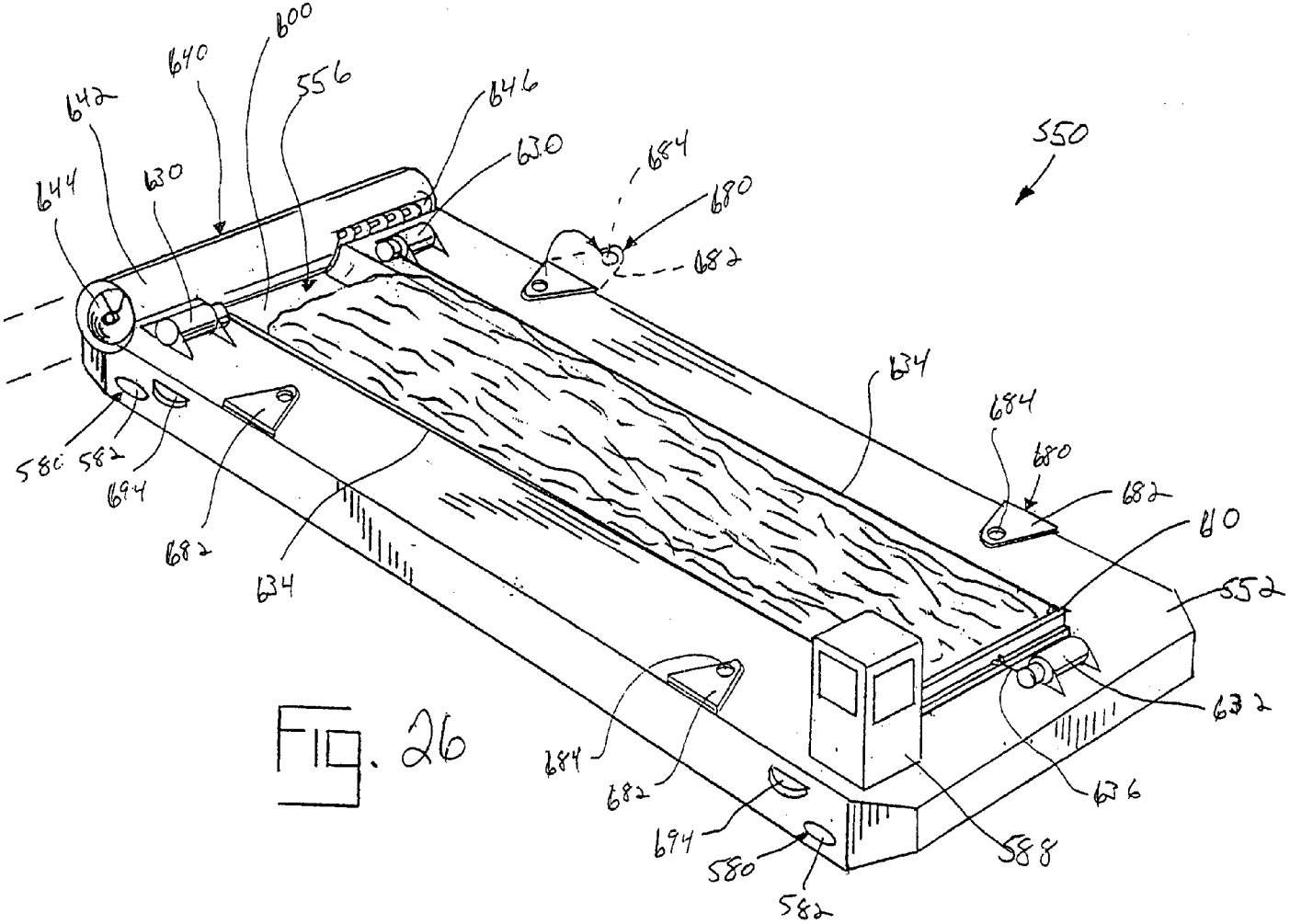
FIG. 26 is a right, front perspective view of a vessel constructed in accordance with the teachings of the invention for transporting and off-loading material recovered in a dredging operation.
Figure 27:
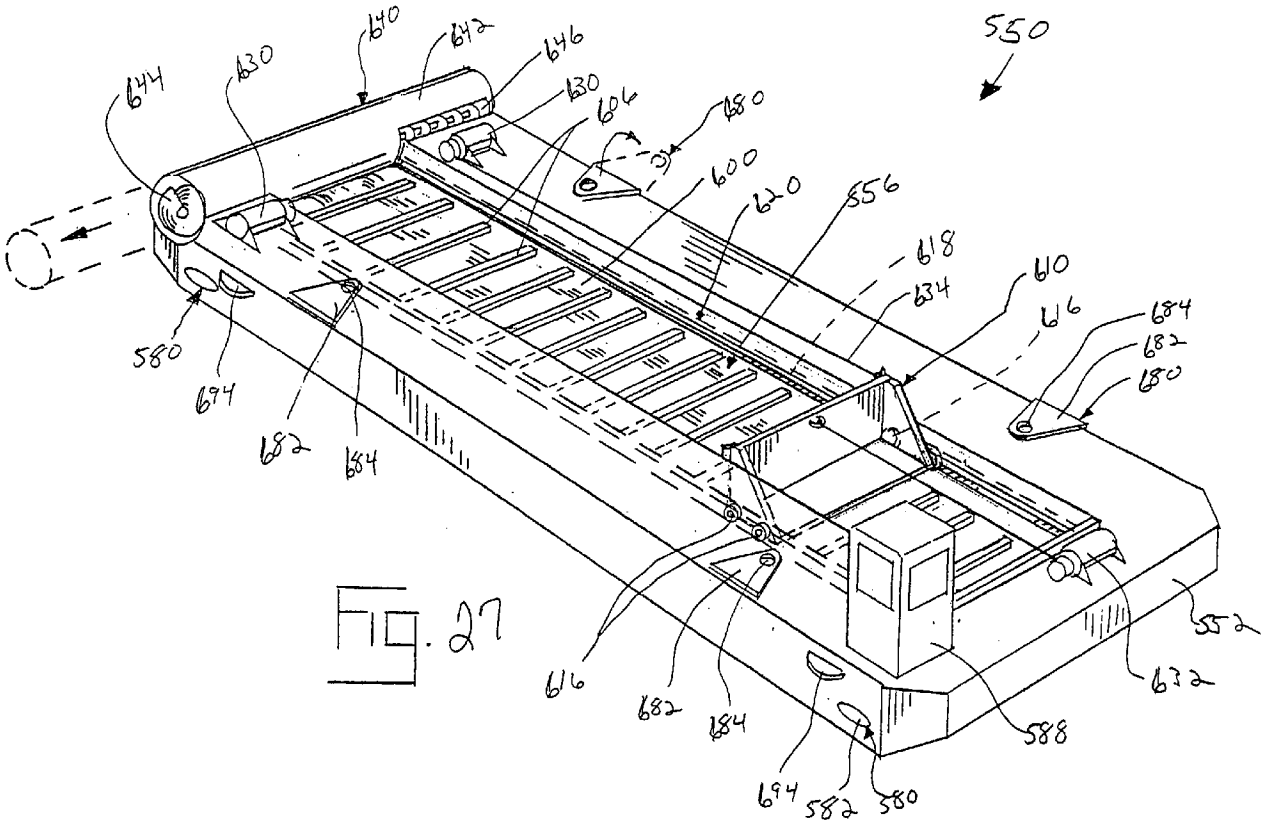
FIG. 27 is a view similar to FIG. 26, but showing the material transportation vessel with an empty hopper and a partially advanced ejector blade.
Figure 28:
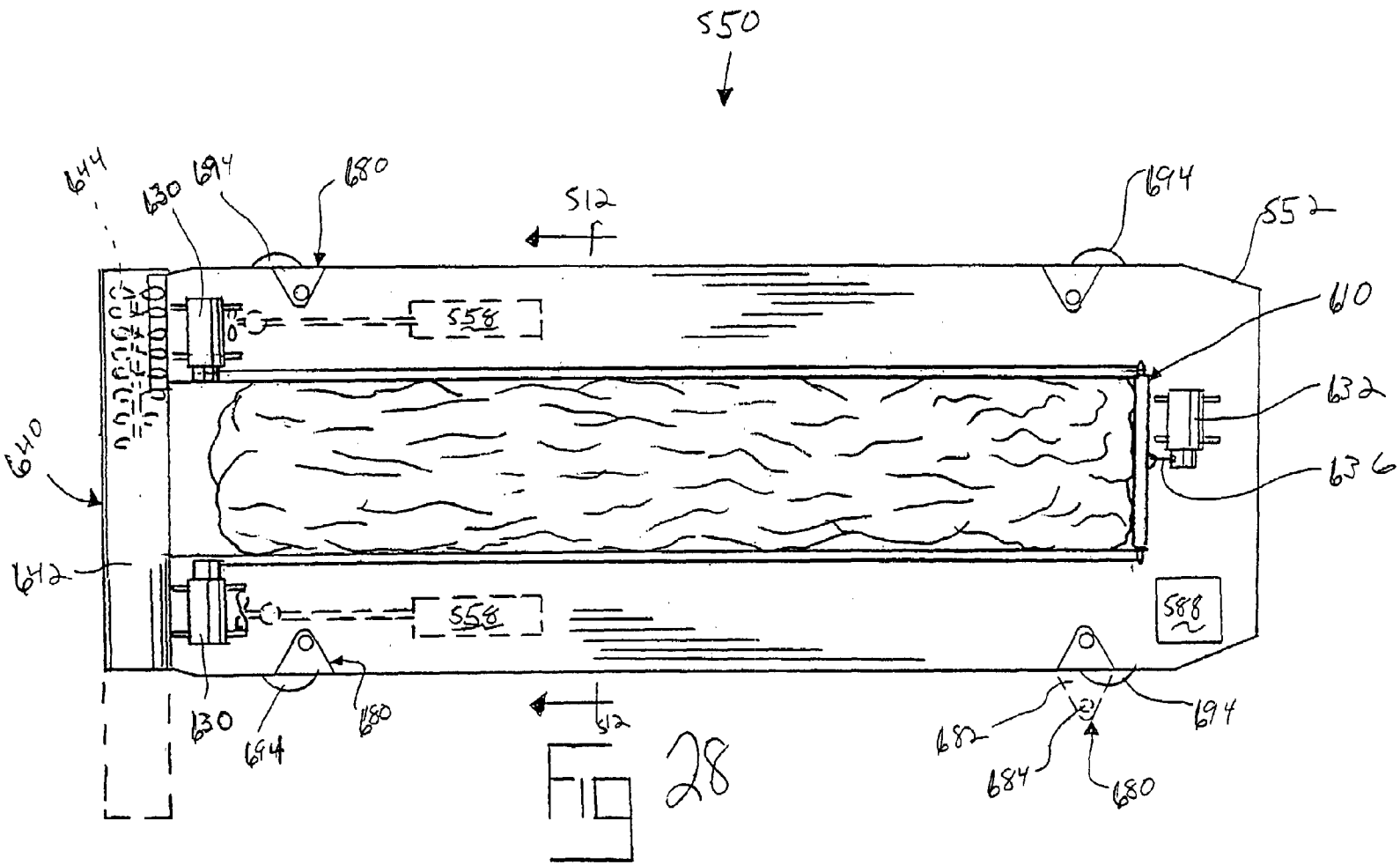
FIG. 28 is a top view of the vessel of FIG. 26.
Figure 29:
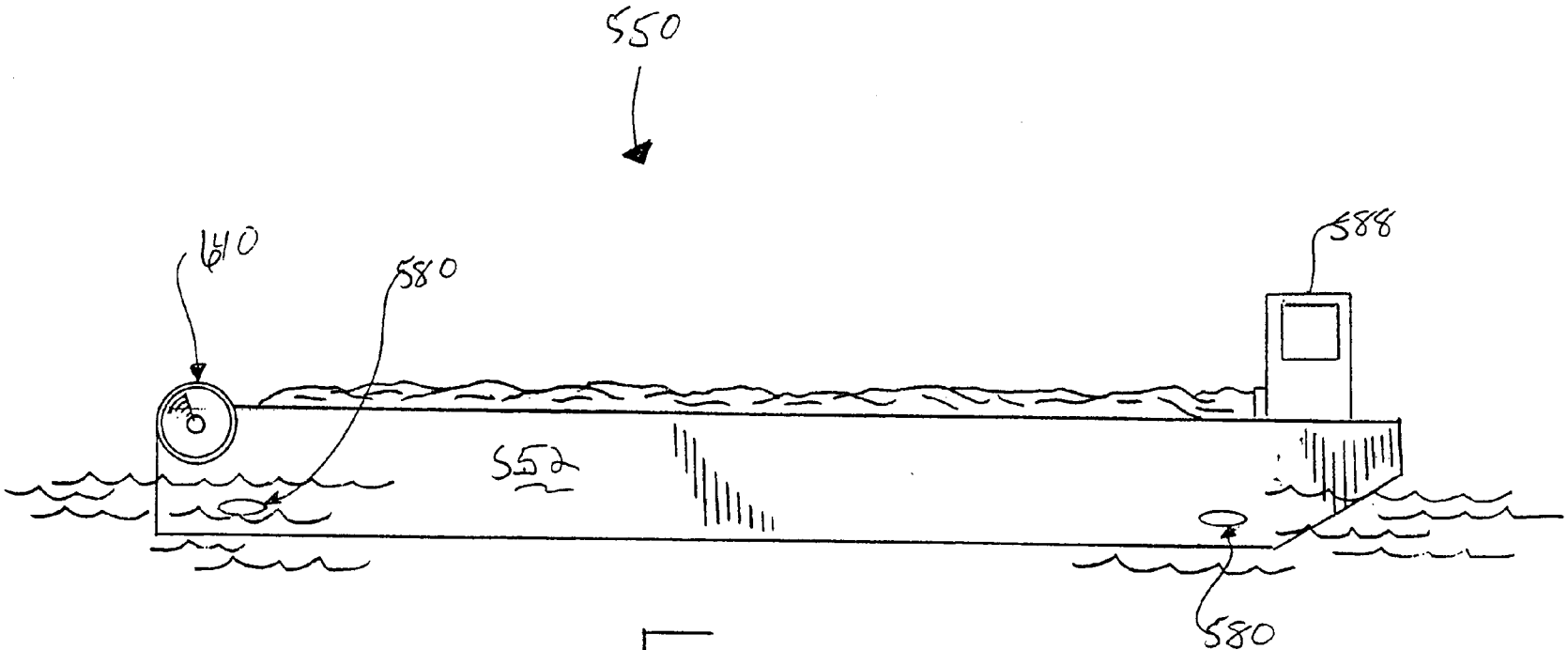
FIG. 29 is a right side view of the vessel of FIG. 26.
Figure 30:
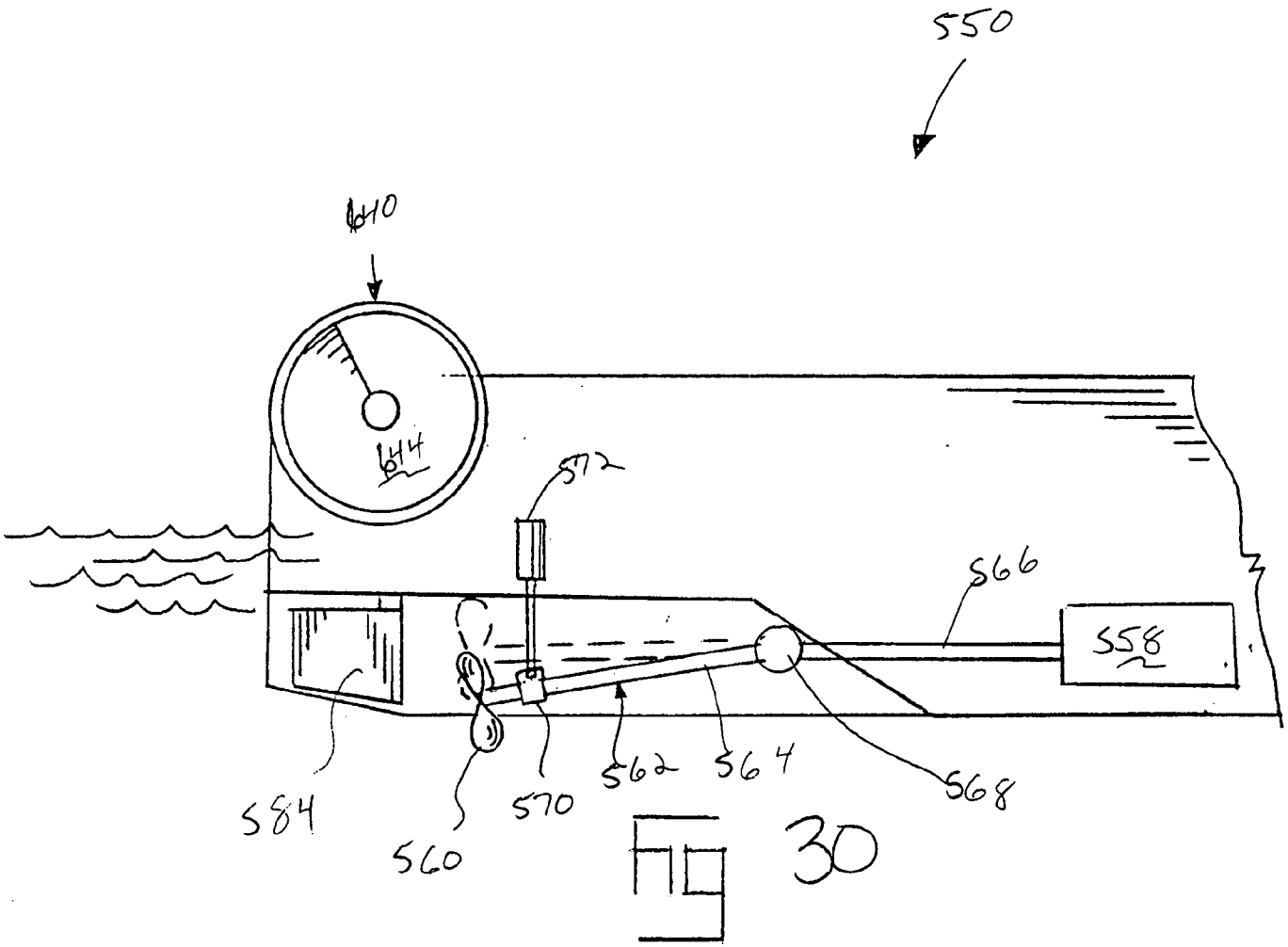
FIG. 30 is an enlarged view showing an exemplary propulsion system for the vessel of FIG. 26.

To provide a storage area for recovered material, the material transportation vessel 550 is further provided with a hopper 556. As shown in FIGS. 26-28, the hopper 556 is preferably rectangular in shape, is preferably substantially centered with respect to the hull 552, and preferably extends for most of the length of the hull 552. However, persons of ordinary skill in the art will readily appreciate that hoppers of other shapes, sizes and locations can be utilized without departing from the scope or spirit of the invention. In any event, the size of the hopper 56 is preferably selected along with the hull dimensions to provide a desired payload capacity within the draft preferences mentioned above.

For the purpose of moving the material transportation vessel 550 through a waterway, the vessel 550 is preferably provided with a propulsion system. Although persons of ordinary skill in the art will readily appreciate that the propulsion system can be implemented in many ways without departing from the scope or spirit of the invention, in the illustrated example, the propulsion system is implemented by twin, counter-rotating diesel engines 558 of conventional design (see FIG. 28). As most easily seen in FIG. 30, each of the engines 558 is operatively coupled to a large diameter propeller 560 via a drive shaft 562 in a conventional, manner. Large diameter propellers 560 are employed to provide enhanced control during low velocity operation.

Because the material transportation vessel 550 is designed to have a very low draft when empty, the propellers 560 are preferably height adjustable. In particular, as most easily seen in FIG. 30, each of the drive shafts 562 preferably includes at least two segments 564, 566 joined by a joint 568 such as a constant velocity joint or a universal joint. The proximal segments 564 of the drive shafts 562 are rotatably mounted within a low friction bearing 570 of conventional design. The bearing 570 is coupled to the hull 552 via a hydraulic cylinder 572 such that, by extending the cylinder 572, one can lower the propeller 560 a further distance beneath the hull 552 to ensure the propeller 560 is completed submerged when, for example, the hopper 556 is empty. Conversely, when the vessel 550 is loaded, the propeller 560 can be raised to avoid contact with the bed of the waterway in shallow water.

In order to enhance the maneuverability of the vessel 550, the vessel 550 is further provided with stern and bow thrusters 580 on each of its sides (see FIGS. 26-29). The side thrusters 80 are preferably implemented as low power water jets or impellers of conventional design. In other words, they are implemented by hydraulically or electrically driven impellers located in transverse tubes. As shown in FIG. 26, each of the transverse tubes preferably terminates in an oval outlet pod 582 to ensure the thrusters create a fan-shaped water stream (as opposed to a circular water jet which might be less effective than the fan-shaped jet in shallow water). As will be appreciated by persons of ordinary skill in the art, the side thrusters 580 render the vessel 550 capable of sideways movement. Indeed, the thrusters 80 preferably enhance the maneuverability of the vessel 550 to such an extent that the vessel 550 can turn 180° within its own length.

Of course, the vessel 550 is also provided with a rudder 584 of conventional design as shown in FIG. 9 to provide steerability apart from and, in addition to, the steerability powered by the side thrusters 580. The operation of the engines 558, the side thrusters 580, the rudder 584 and the various other systems of the vessel 550 are preferably controlled from a control panel located in a cab 588.

Figure 31:
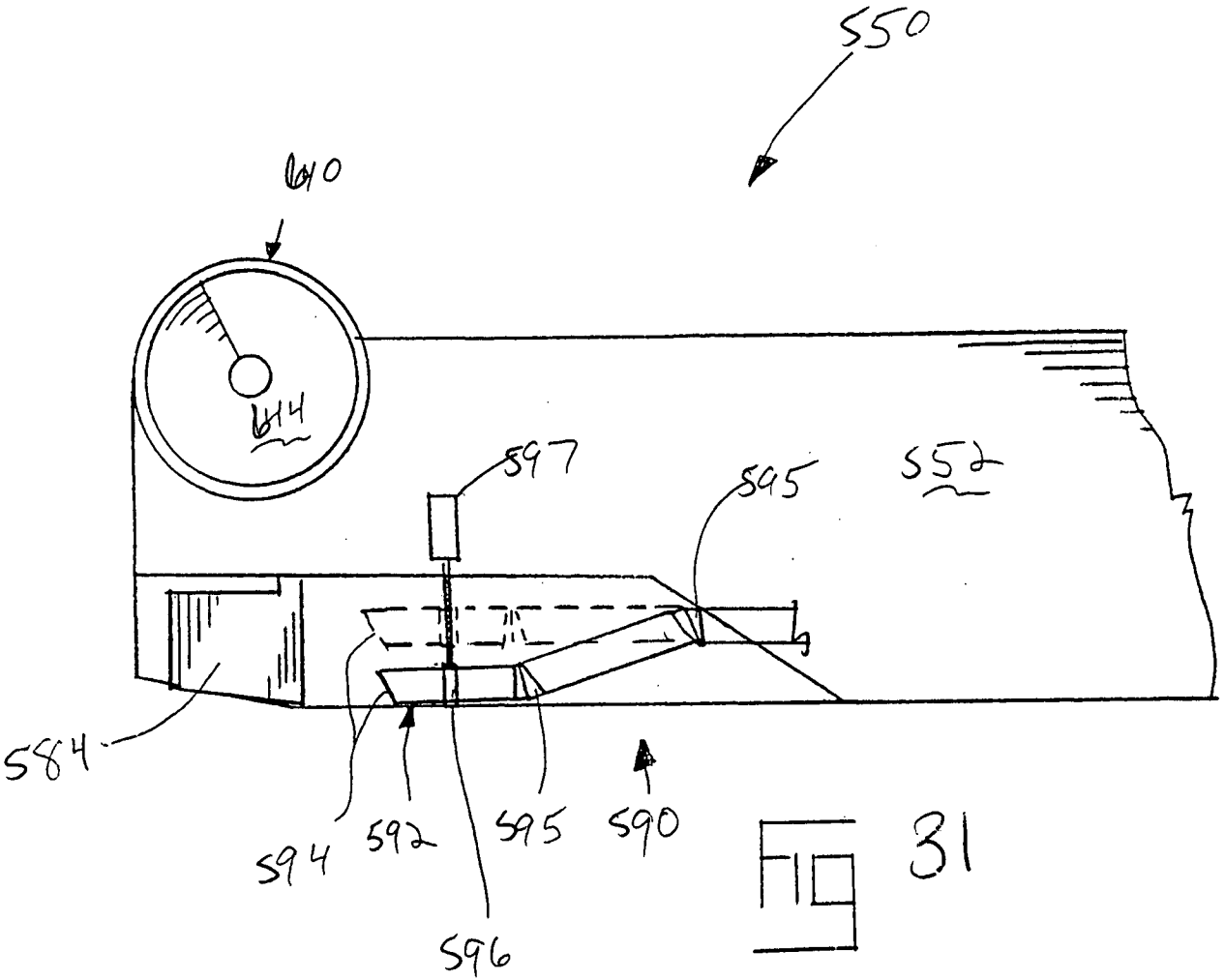
FIG. 31 is a view similar to FIG. 30 but showing an alternative propulsion system.

While as described above, twin engines 558 are preferred as the primary source of propulsion for the vessel 550, persons of ordinary skill in the art will appreciate that water jet could be used in place of the engines 558 without departing from the scope or spirit of the invention. An exemplary water jet 590 that can be used in this role is schematically illustrated in FIG. 31. As is conventional, the water jet 590 comprises a conduit 592 with an intake port (not shown) and an exhaust or discharge port 594. An electrically or hydraulically powered impeller (not shown) of conventional design is mounted within the conduit 592 and functions to draw water into the conduit 592 through the intake port and force it out of the conduit 592 through the exhaust port 593 to create a propulsion force in a direction opposite the flow of water out of the exhaust port 593. As with the side thrusters 580, the conduits 592 of the main water jets 590 are preferably transitioned into oval 520 exhaust openings to thereby produce a fan-shaped water jet stream with a generally lower profile than a circular stream of the same cross-sectional area would have to facilitate use in shallow water.

Since, as mentioned above, the material transportation vessel 550 is preferably designed to have little draft, the conduit 592 of the water jet 590 is preferably provided with two joints 595 and the proximal end of the conduit 592 is preferably supported in a collar 596 connected to a hydraulic cylinder 597. By extending the cylinder 597, the vessel operator can lower the proximal end of the conduit 592 a further distance beneath the hull 552 to ensure the exhaust port 593 is completely submerged even when, for example, the hopper 556 is empty and the vessel 550 has very little draft. Conversely, when the vessel 550 is laden, the conduit 592 can he raised.

Persons of ordinary skill in the art will appreciate that, although in the illustrated example, the material transportation vessel 550 is primarily steered with a rudder 584 when using water jets 590 as its primary source of propulsion force, the rudder 584 could be replaced and/or augmented by making the proximal ends of the conduits 592 of the jets steerable without departing from the scope of the invention. In such an approach, the exhaust ports 593 of the conduits 592 can be pivoted or otherwise directed in a direction opposite the desired direction of movement to steer the vessel 550 through a waterway.

Although either water jets 590 or conventional engines 558 can be utilized as the primary propulsion source, conventional engines are presently preferred because they create less turbulence than water jets and are generally more cost effective.

For the purpose of loading and unloading the vessel 550, the hopper 556 is provided with a movable floor 600 (see FIG. 27). The movable floor 600 preferably extends over substantially the entire length and width of the hopper 556 and supports the material recovered in the dredging operation within the hopper 556. As most easily seen in FIG. 32, the movable floor 600 is preferably implemented by a conveyor belt 602 mounted upon a plurality of idler rollers 604 journalled between the side walls of the hopper 556. The idler rollers 604 are preferably mounted in low friction bearings (not shown) of conventional design and are closely spaced, but do not touch one another to minimize friction during movement of the floor 600.

Figure 6:
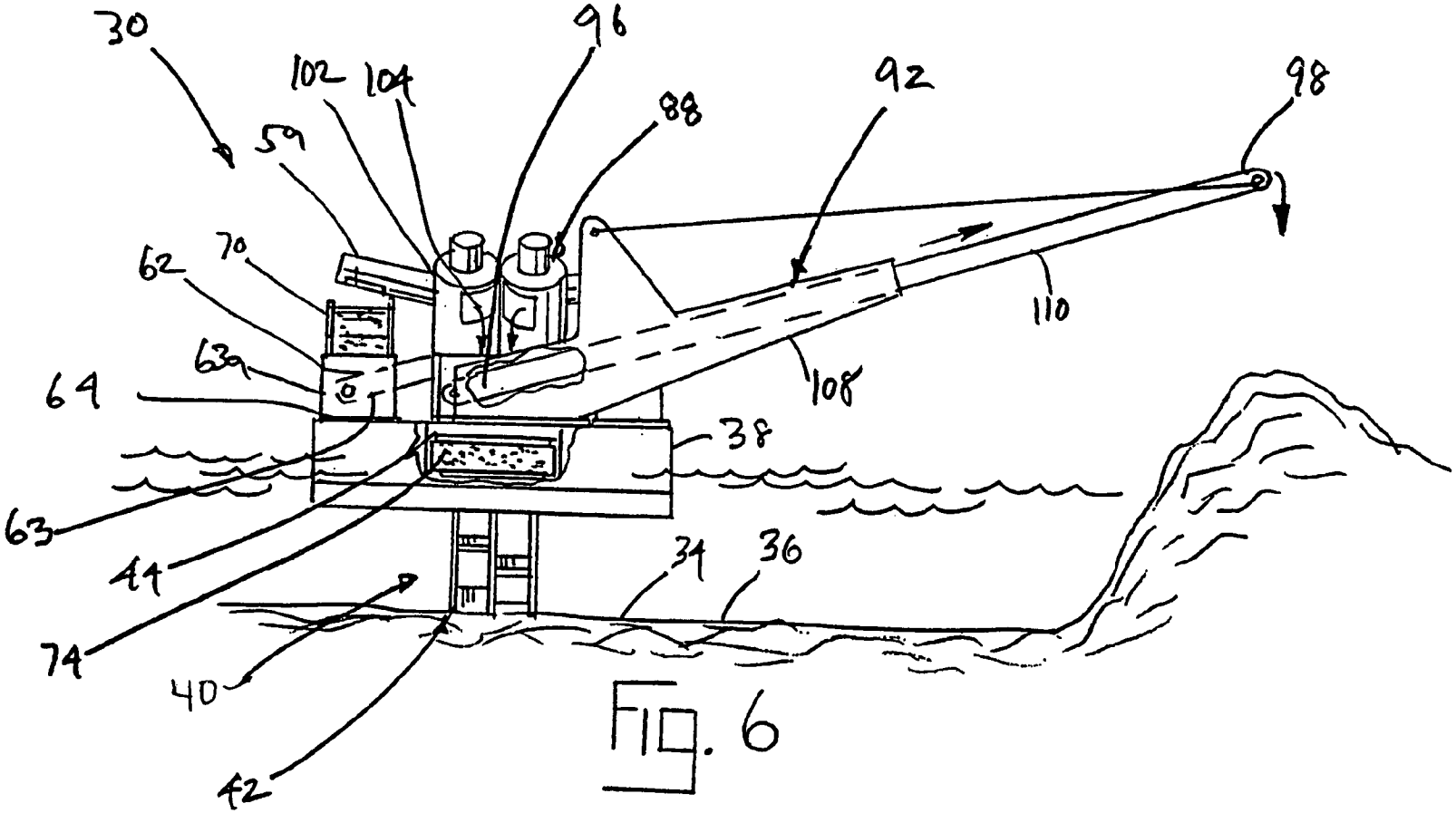
FIG. 6 is an stern end elevational view of the vessel illustrated in FIG. 1 but illustrating the vessel in yet another possible state of operation in which the recovered material is being offloaded at a desired location; the distribution conveyor is shown in a rotated or slewed position.

The belt 602, which is preferably endless, is preferably implemented by commercially available conveyor belting material such as steel or nylon reinforced rubber. As shown in FIGS. 6 and 11, the belt 602 is also preferably provided, with steel cleats 606 to reduce, and preferably prevent, slippage between the floor 600 and the recovered material the floor supports.

To facilitate ejection of the material recovered in the dredging operation from the vessel 550, the hopper 556 is further provided with an ejector blade 610 (see FIG. 27). As shown in FIG. 11, the ejector blade 610 is preferably secured to the belt 102 of the movable floor 100 with conventional fasteners 612 such as bolts or the like. The ejector blade 610 preferably extends the entire width of the hopper 556 and moves with the belt 602 to eject the dredged material from the hopper 556. In particular, like the cleats 606, the ejector blade 610 functions to prevent the floor 600 from slipping under the recovered material and, thus, ensures that the material is conveyed forward by the moving floor 600.

Figure 33:
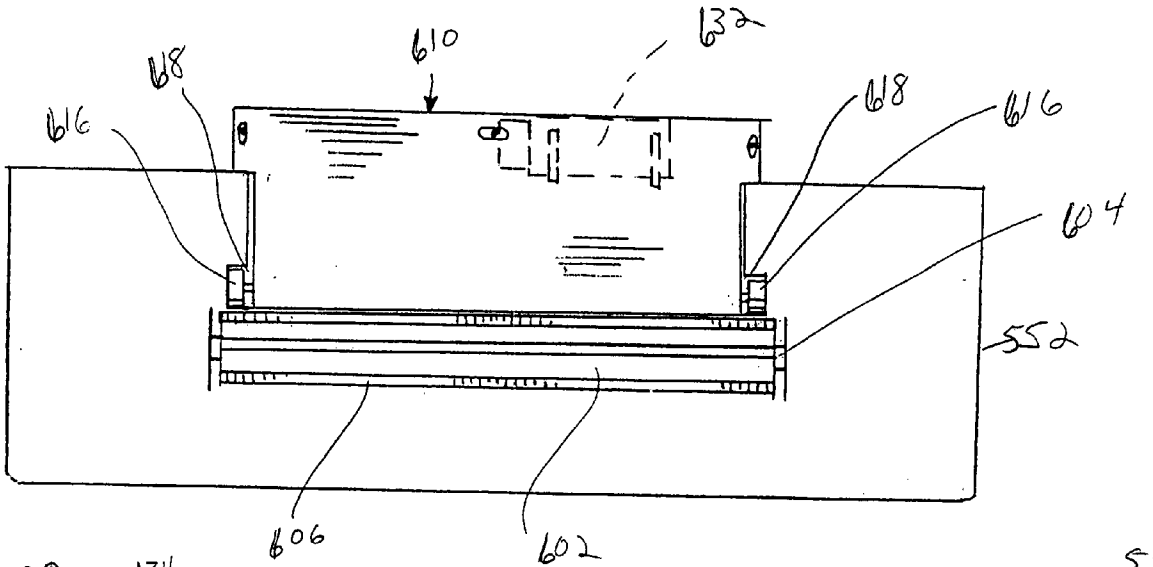
FIG. 33 is a cross sectional view of the vessel of FIG. 26 taken along lines 12-12 of FIG. 28.

As most easily seen in FIGS. 27 and 33 in addition to being bolted to the floor 600, the ejector blade 610 is guided in its reciprocating movement through the hopper 556 by a track system. In particular, the ejector blade 60 is provided with guide rollers 66 mounted for rotational movement on each of its sides. The sides of the hopper 556, on the other band, define oppositely disposed channel 618 which together form a track 620 which is sized to receive the wheels 616 of the ejector blade 610. The wheels 616 of the ejector blade 610 roll back and forth within the track 620 as the ejector blade 610 reciprocates through the hopper 556.

Figure 34:
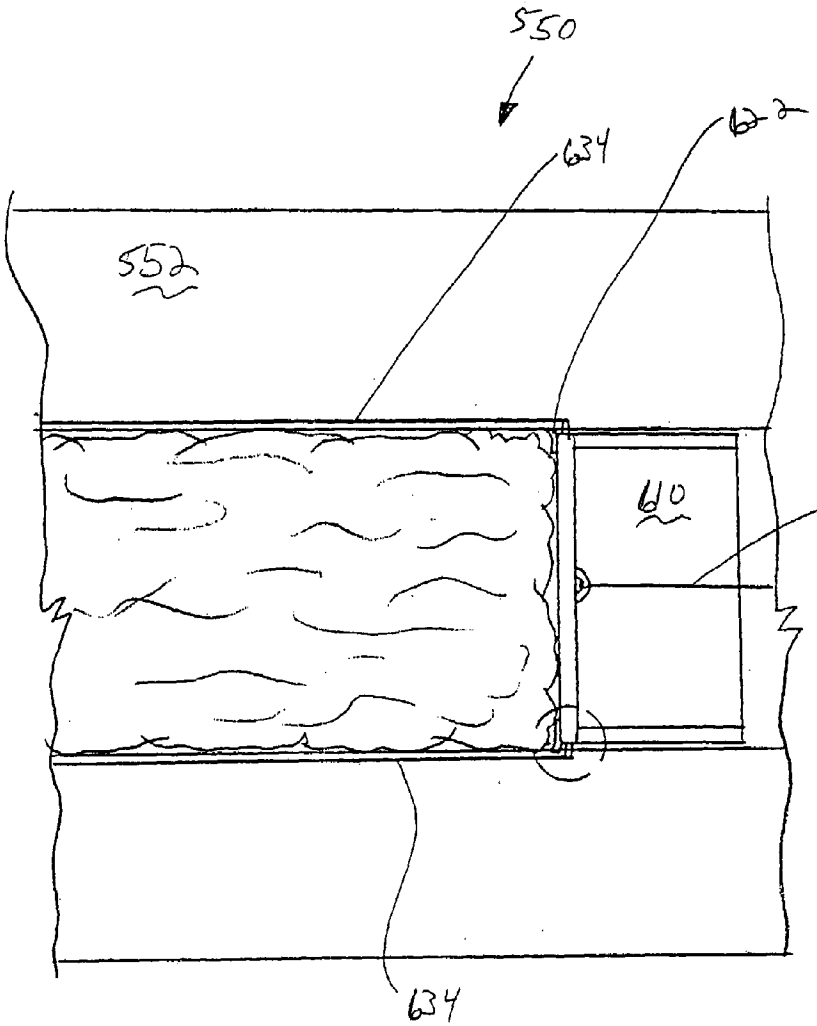
FIG. 34 is a partial top view of the vessel of FIG. 26 showing the ejector blade and floor of the hopper advancing to eject material from the hopper.
Figure 35:
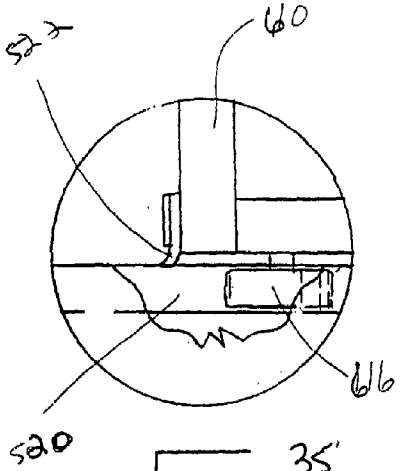
FIG. 35 is an enlarged view of the circled area of FIG. 34.

To prevent silt or other recovered material from interfering with the operation of the wheels 616, deflector plates (not shown) or the like are secured to the ejector blade 610 in front of the front-most wheel 616 to push any recovered material within the track 620 ahead of the rollers 616. Similarly, to prevent recovered material from passing between the sides of the hopper 556 and the ejector blade 610, the front edges of the ejector blade 610 are preferably provided with rubber-tipped wipers 622 that slide along the sides of the hopper 556 (see FIG. 34 and the enlargement of the circled portion of FIG. 34 shown in FIG. 35). Preferably, the wipers 622 wipe the sides of the hopper 556 substantially clean as the ejector blade 610 traverses the hopper 556 to eject the recovered material therefrom. Preferably, the channels 618 of the track 620 include openings which are in communication with the collection chamber 660 discussed below to ensure debris does not collect in the track 620.

Figure 32:
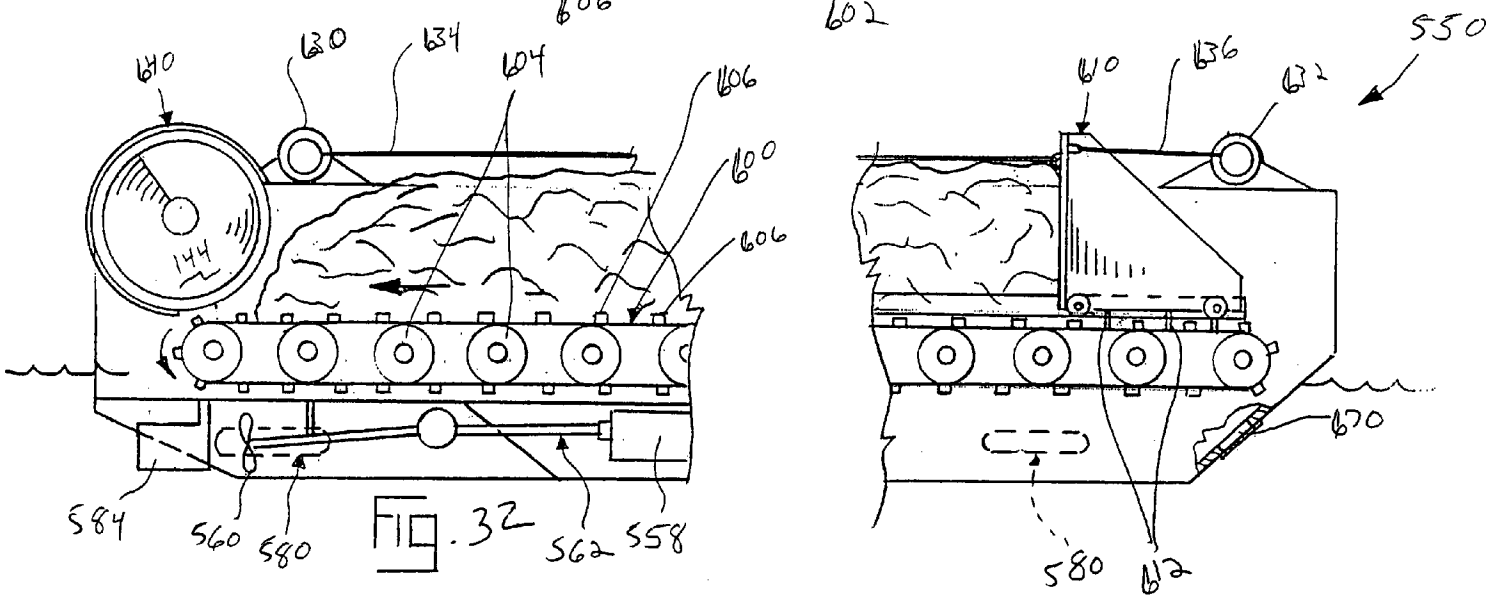
FIG. 32 is a partial cross-sectional side view of the vessel of FIG. 26.

For the purpose of driving the ejector blade 610 and the attached floor 600 through the hopper 556 to eject the recovered material therefrom, the material transportation vessel 550 is provided with a drive system in the illustrated vessel 550, the drive, system is implemented by a pair of ejection winches 630, a return winch 632 and corresponding cables 634, 636 coupled to the ejector blade 610. More specifically, as shown in FIGS. 26-28, an ejector winch 630 is mounted adjacent each side of the hopper 556 near the stem of the vessel 550. Each ejector winch 630 is secured to an ejection cable 634. As shown in FIGS. 32 and 34, the ejection cables 634 run over the sides of the hopper 556 and are bolted or otherwise fastened to opposite sides of the ejector blade 610. When the ejector winches 630 are driven to retrieve the cables 634, the cables 634 pull the ejector blade 610, the attached movable floor 610 and, thus, the recovered material supported by the floor 610 rearward toward the stem of the vessel 550. The only resistance to this rearward movement is the sliding friction caused by contact of the recovered material and the side walls of the hopper 556 and the belt friction experienced by the idler rollers 604. Both of these frictional forces are relatively low.

As shown in FIGS. 26, 27 and 34, the return cable 636 is coupled to the rear of the ejector blade 610. When the ejector winches 630 are driven, the return winch 632 is released to pay out the return cable 634. Conversely, when it is desired to return the ejector blade 610 to the proximal end of the hopper 556, the return winch 632 is driven to retrieve the return cable 136, and, thus, pull the blade 610 and the movable floor 600 in a forward direction (i.e., toward the bow). During this forward movement, the ejector winches 630 are, of course, released to pay out the ejector cables 634.

Although the winch system described above is preferably used to eject recovered material from the hopper 556, persons of ordinary skill in the art will readily appreciate that other drive mechanisms such as, by way of examples, not limitations, chain drive systems and/or hydraulic cylinders could be used in this role without departing from the scope or spirit of the invention. Similarly, although the winches 630, 632 could be powered in many different, well known ways without departing from the scope or the spirit of the invention (e.g., electric motors), in the disclosed vessel 550 the winches 630, 632 are powered by hydrostatic motors.

Figure 44:
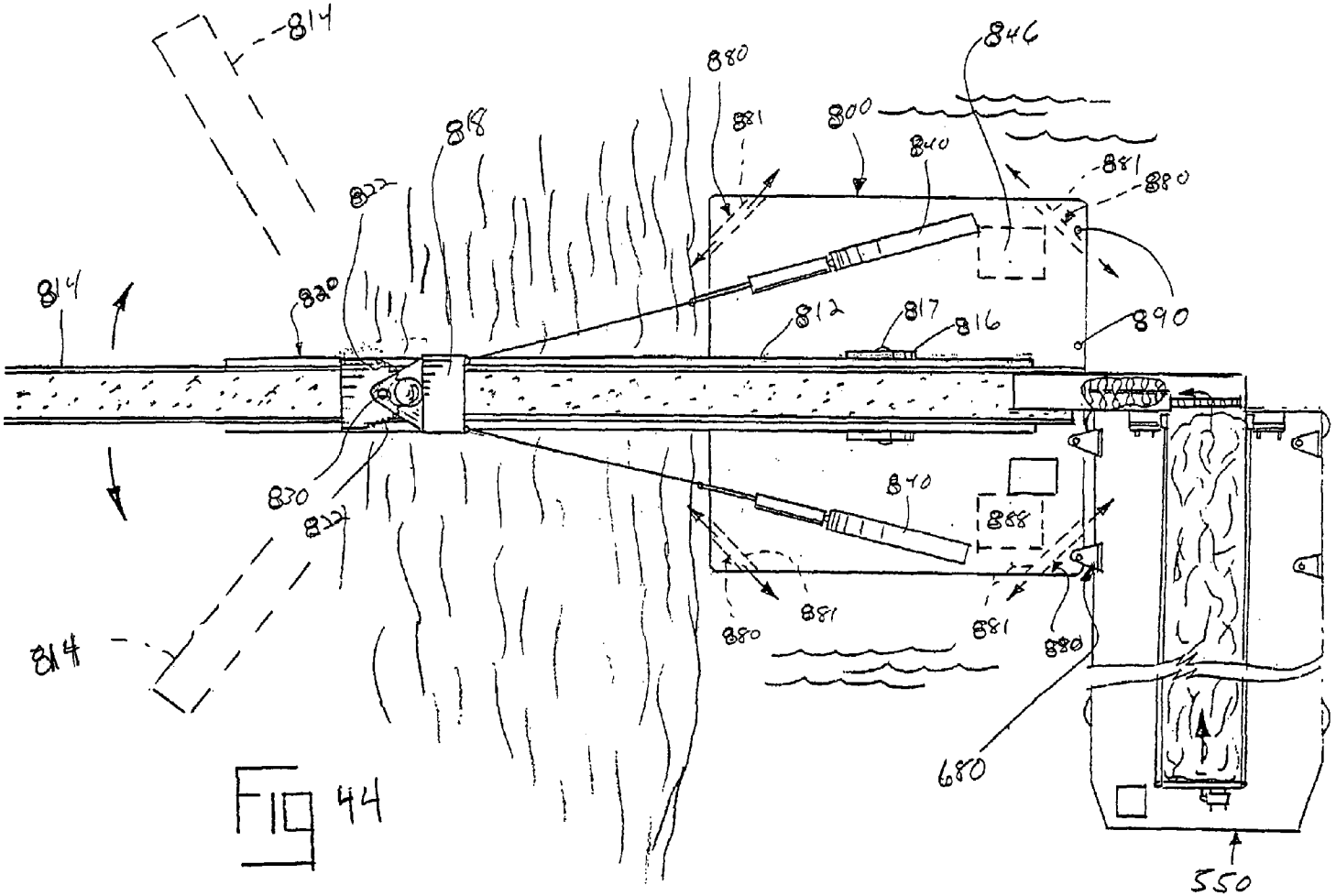
FIG. 44 is a top view of the material distribution vessel of FIG. 41 cooperating with the material transportation vessel of FIG. 26.

For the purpose of discharging the recovered material from the hopper 556, the material transportation vessel 550 is further provided with an auger 640. As shown in FIGS. 26 and 44. the auger 640 is mounted across the stern of the vessel 550. As also shown in those figures, the auger 640 is mounted in a track system for sideways movement between an auger storage position (illustratively, the position shown in solid lines in FIG. 26), and an auger extended position (illustratively, the position shown in dotted lines in FIG. 26 (see also FIG. 44). The auger 640 is preferably positioned in the auger storage position when the hopper 556 of the material transportation vessel 550 is being filled and is preferably positioned in the auger extended position when the hopper 556 is being emptied. When the auger 640 is in the auger extended position, the auger 640 extends beyond the side of the hull 552 to facilitate transporting the recovered material out of the hopper 556 and off of the vessel 550. Preferably, the auger 640 projects about 2 meters past the hull 552.

As shown in FIGS. 26, 27, 28 and 44, the auger is provided with a housing 642 that covers virtually the entire length of the auger blade 644. However, the proximal end of the auger housing 642 defines an opening 646 that exposes the auger blade 644. The opening 646 is sized to be at least as wide as the hopper 556 and is located such that, when the auger 640 is extended to the auger extended position, the opening 646 is aligned with the hopper 556 so that advancement of the floor 600 and ejector blade 610 can feed recovered material from the hopper 556 to the auger blade 644. As shown in FIG. 26, when the auger 640 is in the auger storage position, the opening 646 is displaced from the hopper 556 and a side of the auger housing 642 forms the proximal side of the hopper 556.

As mentioned above, the auger 640 is preferably mounted on a track. Although persons of ordinary skill in the art will readily appreciate that many different track systems can be used in this role without departing from the scope or the spirit of the invention, in the illustrated vessel 550, the track system comprises wheels mounted on the auger 640 and running in tracks mounted on the deck of the vessel 550 similar to those employed with the ejector blade 610. Similarly, although persons of ordinary skill in the art will appreciate that many different types of drive systems can be implemented to move the auger between the storage and extended positions, in the illustrated vessel 550 the auger 640 is reciprocated between these positions by hydraulic cylinders (not shown). Additionally, although it will further be appreciated that the auger blade 644 can be powered in any of a number of conventional ways (e.g., an electric motor), in the illustrated vessel 550 the auger blade 644 is driven by a hydrostatic motor through a chain drive assembly. Preferably, the auger blade 644 drive system is mounted within the auger housing 642 and moves with the auger 640 between the retracted and extended positions.

In order to ensure the recovered material is efficiently discharged from the hopper 556, the rate at which the floor 600 and ejector blade 610 feed the recovered material is preferably substantially matched to the rate at which the auger blade 644 removes the fed material front the hopper 556. Although persons of ordinary skill in the art will readily appreciate that such rate matching can be accomplished in many ways without departing from the scope or spirit of the invention, in the disclosed vessel 550 this rate matching is achieved automatically by tying the speed of the hydrostatic motor driving the auger blade 644 to the speed of the hydrostatic motors driving the ejector winches 630. Although such automatic control is presently preferred, persons of ordinary skill in the art will readily appreciate that the speeds of operation of the auger blade 644 and the ejector winches 630 could be independently controlled (i.e., manual rate matching of the anger feeding process) without departing from the scope or spirit of the invention.

Figure 38:
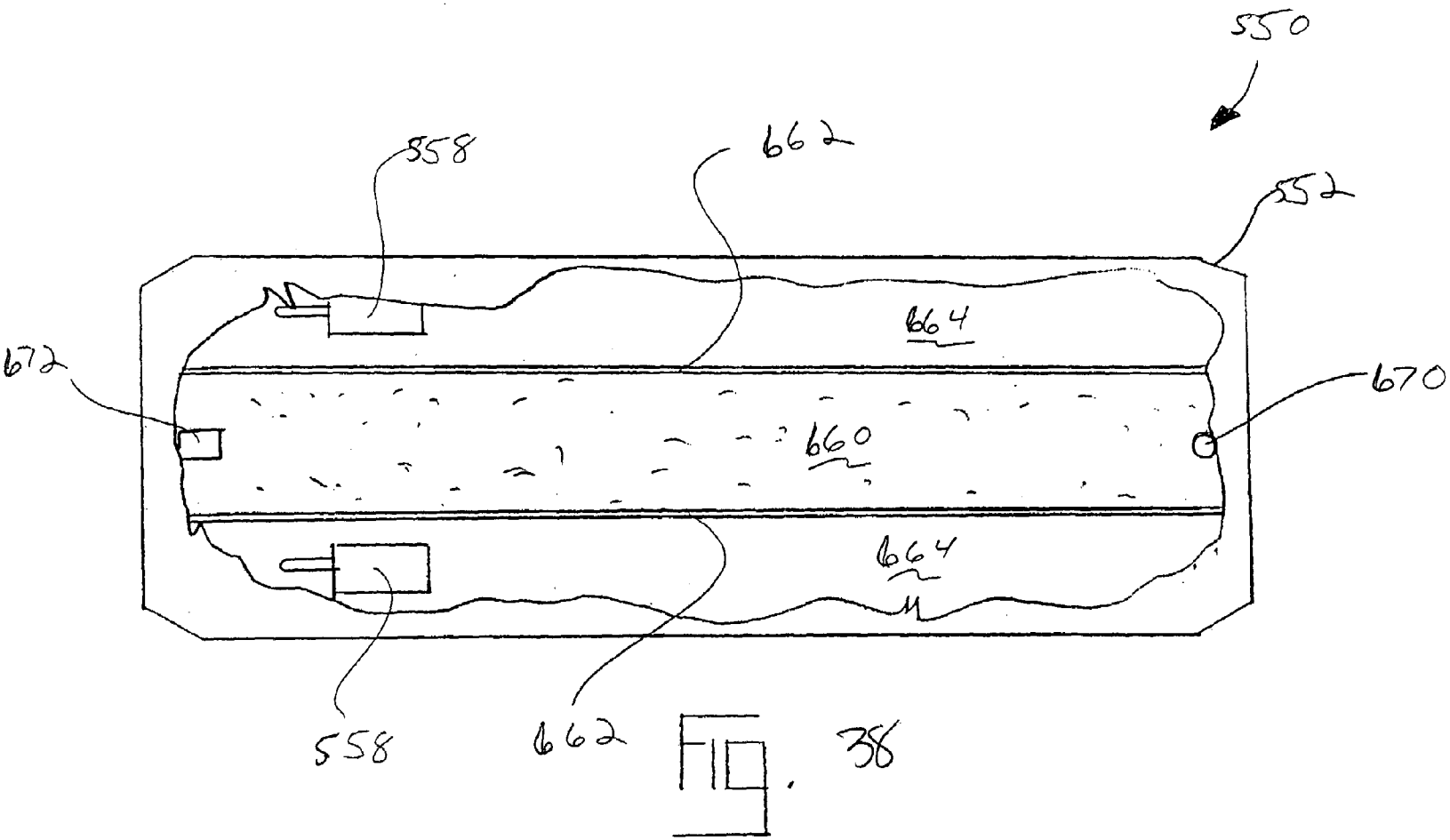
FIG. 38 is a top, cut-away view of the vessel of FIG. 26 showing the compartmentalization of the hull.

Persons of ordinary skill in the art will appreciate that, during use, the movable floor 600 of the material transportation vessel will tend to become soiled. In addition, during emptying of the hopper 556, the revolving floor 600 and its cleats 604 will tend to carry a relatively small amount of recovered material below the floor 600. To address this issue, the hull 552 of the vessel 550 is preferably provided with a collection chamber 660. As shown in FIG. 38, the collection chamber 660 is disposed beneath the movable floor 610 of the hopper 556 and preferably extends the length of the hull 552. Water-tight retaining walls 662 are positioned on either side of the collection chamber 660 and serve to form a water seal between the collection chamber 660 and two opposed main pontoons 664. The collection chamber 660 is open to the top so that the belt 602 of the movable floor 600 is directly exposed to the chamber 660.

As shown in FIGS. 32 and 38, the collection chamber 660 is further provided with a collection port 670 for selectively accepting water into the collection chamber 660, an exit port (not shown) for selectively removing water and/or debris from the collection chamber 660, and a pump 672 mounted within the exit port for discharging water and/or debris from the chamber 660 out of the exit port. When it is desired to clean the belt 602 of the floor 600 and/or to remove the debris collected in the collection chamber 660, the operator opens the cleaning port 670 while driving the vessel 550 forward to blast water into the collection chamber 660. The pump 672 is subsequently activated to pump the water and debris from the collection chamber 660. When the cleaning process is complete, the collection port 670 is closed. Of course, the area of the belt 602 that is exposed to the recovered material is the area that will become soiled most frequently. Therefore, the cleaning operation will typically be performed with the blade 610 in its rearmost position (i.e., with the most soiled part of the belt 602 positioned adjacent the collection chamber 660 for cleaning).

Preferably, the volume of the collection chamber 660 is significantly smaller than the volume of the main pontoons 664. As will be appreciated by persons of ordinary skill in the art, each of the main pontoons 664 should be provided with its own bilge pump (not shown). As shown in FIG. 38, the engines 558 are located in the main pontoons 664.

In order to facilitate loading and off loading of the material transportation vessel 550, the vessel 550 is provided with automatic couplers 680. As shown in FIGS. 26-28 in the illustrated vessel 550, the automatic couplers 680 are each implemented by (1) a capture arm 682 which is pivotally mounted to the deck of the vessel through a conventional hinge and (2) a pin mounted on another structure. Each capture arm 682 defines a bore 184 which is sized to receive a vertically positioned, tapered pin mounted on an adjacent structure, such as a vessel. Preferably the pins captured by the capture arms 682 are sized to permit the capture arms 682 to move vertically relative to the pins as the vessel 550 is loaded or unloaded to accommodate changes in draft caused by such processes.

Figure 41:
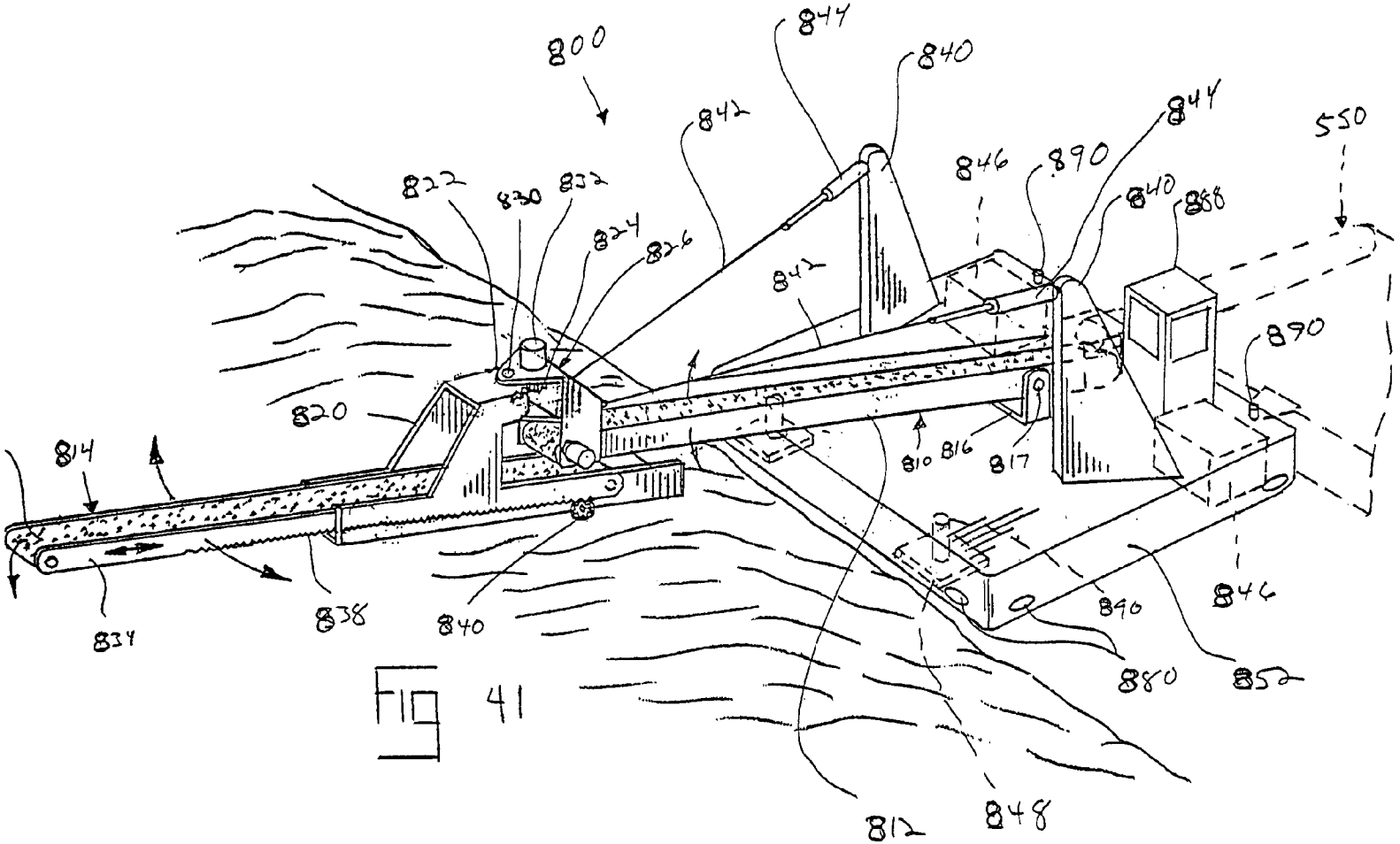
FIG. 41 is a left, front perspective view of a material distribution vessel constructed in accordance with the teachings of the invention.

As mentioned above, the material transportation vessel 550 is particularly adapted to transport recovered material from a dredging vessel such as the vessel 10 shown in FIG. 23 to a material distribution vessel such as the vessel 800 shown in FIGS. 41-42. Preferably, the automatic couplers 680 of the material transportation vessel 550 are designed to cooperate with both the dredging vessel 510 and the material distribution vessel 800. Therefore, if the material transportation vessel 550 is provided with capture arms 680, the dredging vessel 510 and the material distribution vessel 800 are both provided with mating pins. Conversely, if the transportation vessel 550 includes pins, the dredging vessel 510 and the material distribution vessel 800 include capture arms 680. In the example shown in FIGS. 36 and 37, the dredging vessel 510 is provided with the capture arms 680 and the transportation vessel 550 is provided with the vertical pins 690.

Regardless of the arrangement of the arms 682 and pins 690 the couplers 680 are preferably operated automatically. In particular, each capture arm 682 is provided with a small hydraulic (or, alternatively, an air) cylinder (not shown) that pivots the corresponding arm between a stored position (shown in solid lines in the upper left corner of FIG. 26) and a capture position (shown in dotted lines in that same figure). Automatic operation enables an operator in the cab 88 to dock the vessel 550 without assistance from a crew member.

To facilitate docking the material transportation vessel 550 to the dredging vessel 510 and/or the material distribution vessel 800, the transportation vessel 550 and/or the dredging vessel 510 and the material distribution vessel 800 are provided with bumpers 694. Although persons of ordinary skill in the art will readily appreciate that the bumpers 694 can be implemented in many ways without departing from the scope or spirit of the invention, in the illustrated vessels 510, 550, 800, the bumpers 694 are implemented by rubber tires, either pneumatic or solid, mounted for rotation in substantially horizontal planes and extending from the sides of the vessels 550, 800. Rolling bumpers 694 are preferred because they facilitate movement of adjacent vessels 550, 800.

Figure 25:
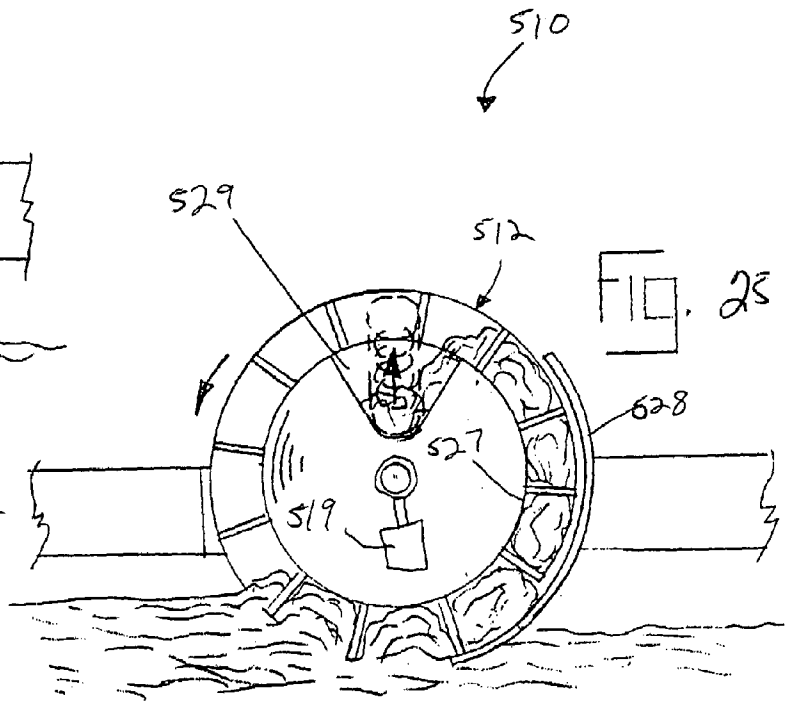
FIG. 25 is a view similar to FIG. 3, but showing the dredging wheel in a second state of operation.

While for purposes of illustration the bumpers 694 are shown on both the dredging vessel 510 of FIGS. 23-25 and the transportation vessel 550 of FIGS. 23-25, preferably only one of these vessels 510, 550 is provided with bumpers 694. If the dredging vessel 510 includes bumpers 694, the material distribution vessel 800 preferably also includes bumpers 694 and the transport vessel 550 does not. Conversely, if the transportation vessel 550 includes bumpers 694, the dredging vessel 510 and the material distribution 510 vessel 800 do not include bumpers.

Figures 39, 40:
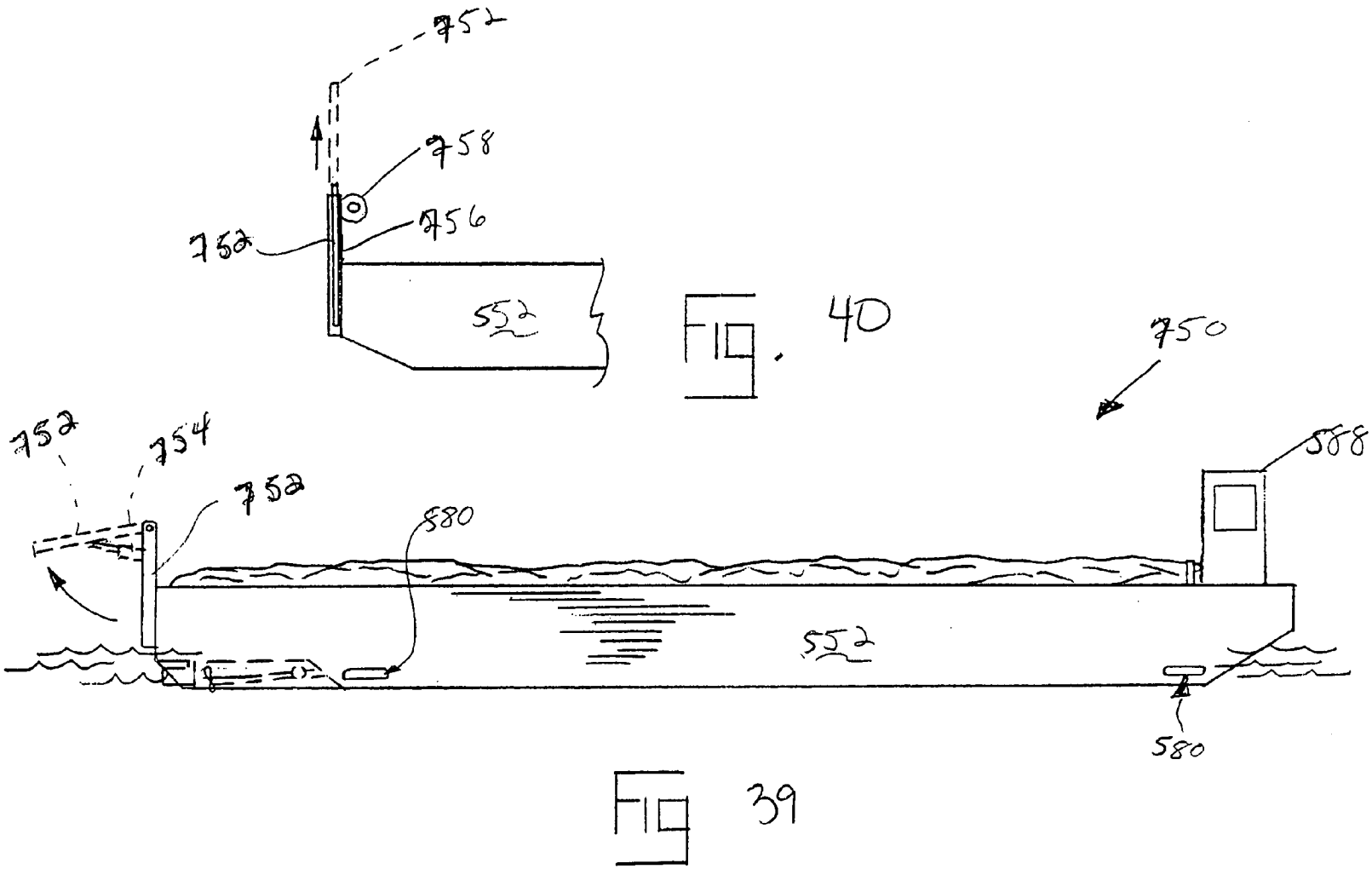
FIG. 39 is a side view of another vessel constructed in accordance with the teachings of the invention for transporting and off-loading material recovered in a dredging operation.
FIG. 40 is a side view of an alternative tailgate configuration for the vessel of FIG. 39.

A material distribution vessel 850 constructed in accordance with the teachings of the invention but employing a different hopper discharge technique is shown in FIG. 39. The vessel 750 of FIG. 39 is substantially identical to the vessel 550 shown in FIGS. 26-35 except that, instead of including an auger 640, the vessel 750 is provided with a tailgate 752 which forms the proximal side of the hopper 556. As shown in FIG. 39, the tailgate 752, which preferably extends the width of the hopper 556, is movable from a storage position wherein the tailgate prevents recovered material from exiting the hopper 556 to a discharge position wherein the tailgate 752 permits discharge of the recovered material out of the hopper 556. In the vessel 750 shown in FIG. 39, the tailgate 752 is pivotally mounted and can be pivoted up and away from the vessel 550 by a hydraulic cylinder 754 when unloading of the hopper 556 is desired. With the tailgate 752 moved, the ejector blade 610 and floor 600 can simply push the recovered material out of the back of the vessel 750 to empty the hopper 556.

Persons of ordinary skill in the art will appreciate that other tailgate configurations can also be used without departing from the scope or spirit of the invention. By way of examples, not limitations, the tailgate 752 can pivot downward and away from the vessel 750. Alternatively, as shown in FIG. 40, the tailgate 752 can be mounted within vertical tracks and provided with a rack 756 and a driving gear or pinion 758 that cooperates with the rack 756 to raise the tailgate 752 to the discharge position (shown in phantom lines in FIG. 40) when it is desired to empty the hopper 556.

Figure 37:
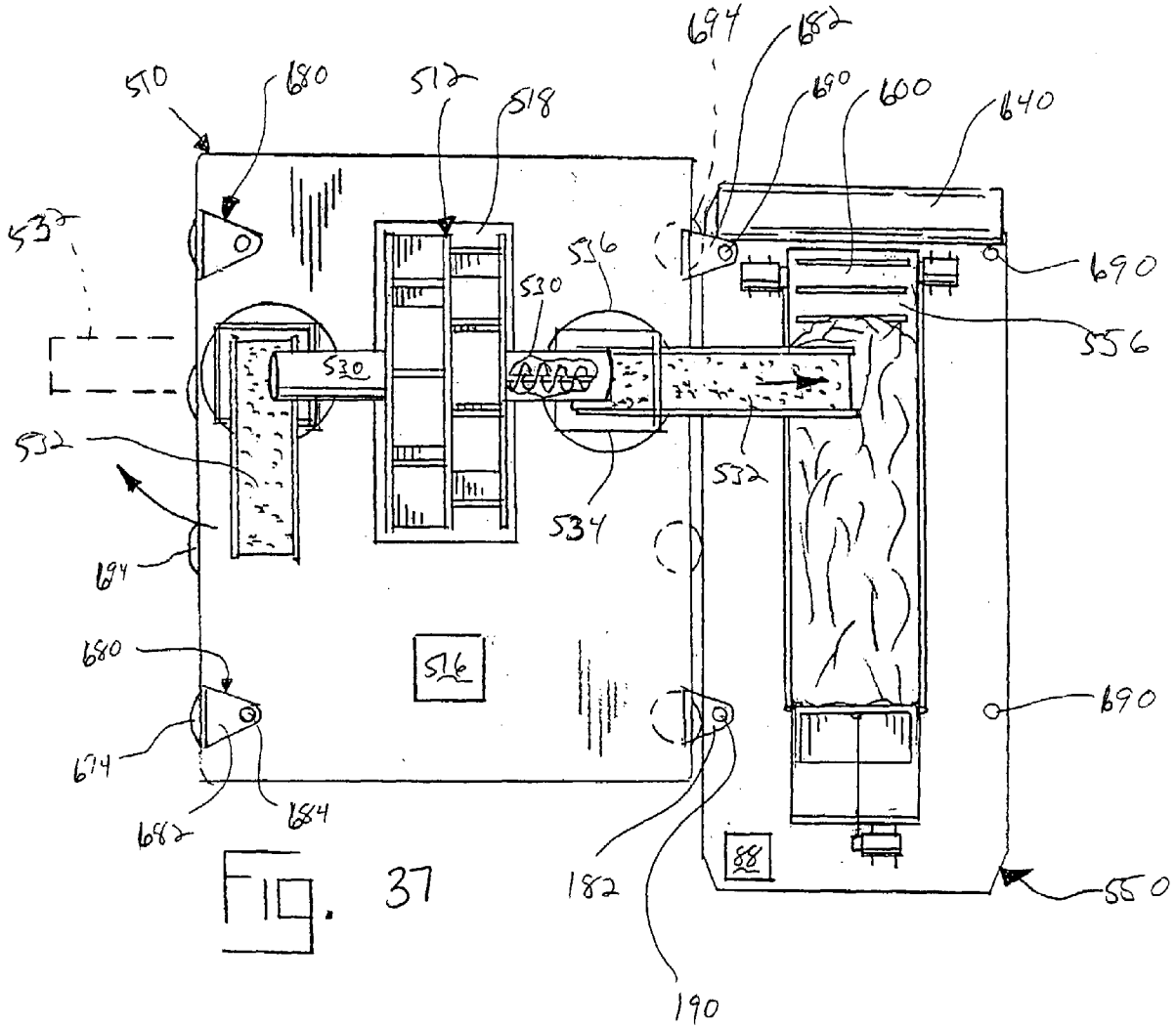
FIG. 37 is a top view of the dredging vessel of FIG. 23 loading the material transportation vessel of FIG. 26.

One possible way of loading the material transportation vessel 550 with the dredging vessel 510 is shown in FIG. 37. In this example, the automatic couplers 680 have been used to secure the transportation vessel 550 to the dredging vessel 510. The ejector blade 610 and the floor 600 are initially moved to a position wherein the ejector blade 610 is located immediately adjacent the end of a conveyor 532 of the dredging vessel 510. The auger 530 on the side of the dredging vessel 510 facing the transport vessel 550 is then run to deliver material from the hopper 529 of the dredging wheel 512 to the conveyor 532. The conveyor 532 also operates to transport the material received from the auger 530 into the hopper 556 on the stem side of 515 the ejector blade 610. When the area of the hopper 556 beneath the conveyor 532 becomes full. the return winch 632 is actuated to retract the ejector blade 610 and the movable floor 600 by an incremental amount to position an empty area of the floor 600 beneath the conveyor 532. This process continues until dredging is complete, and/or the hopper 556 is full (i.e., ejector blade 520, 610 has been completely retracted). In either event, the automatic couplers 680 are released and the material transportation vessel 550 departs from the dredging vessel 510 under its own power. An empty material transportation vessel 50 is then docked to the dredging vessel 510 to be loaded as explained above.

Although the dredging vessel 510 has the capacity to dock with and load a material transportation vessel 550 on either (or both) of its sides, typically, only one material transportation 550 will be loaded at a time. The material transportation vessel 550 operates on the deep water side of the dredging vessel 510. Although the illustrated dredging vessel 510 is shown with two augers 530, persons of ordinary skill in the art will appreciate that the wheel 512 can be provided with one auger 530 instead of two without departing from the scope or spirit of the invention. A single auger arrangement could be advantageous because a dual auger arrangement will typically require simultaneous removal of dredged material from both sides of the wheel 512. A single auger arrangement would off-load to the deep side of the vessel 510 at all times.

Persons of ordinary skill in the art will readily appreciate that, although the above-described method of loading the hopper 556 from the dredging vessel 510 is presently preferred, other techniques of loading the hopper 556 can be employed without departing from the scope or spirit of the invention. By way of example, not limitation, the material transportation vessel 550 can move the ejector blade 610 to its fully retracted position with the hopper 56 empty. Rather than actuating the automatic couplers 680, the material transportation vessel 550 can then move into contact with the side of the dredging vessel 510 and move slowly forward (remaining in contact with the rolling bumpers 694) as the conveyor 532 fills the hopper 556 from the end closest to the stem to the end closest to the bow. This method is not preferred, however, because of the possibility of interfering with the dredging operation by bumping the dredging vessel 510, and thus, moving it sideways, during the loading process.

Persons of ordinary skill in the art will readily appreciate that, regardless of the loading process employed, the dredging wheel 512 will preferably continue to operate during the loading process since the hopper 529 of the wheel 512 has a substantially smaller capacity than the hopper 556 of the material transport vessel.

C. Material Distribution Vessel

A material distribution vessel 800 constructed in accordance with the teachings of the invention is shown in FIG. 41. As will be discussed in greater detail below, the disclosed material distribution vessel 800 is particularly adapted for depositing material recovered in a dredging operation into a waterway to rapidly form an island or levy. Alternatively, the disclosed material distribution vessel 800 may be used to deposit recovered material directly into an onshore vehicle such as a truck or onto another material distribution center (either onshore or offshore). As will be described below, the disclosed material distribution vessel 800 is particularly adapted to cooperate with the material transportation vessel 550 discussed above.

The disclosed material distribution vessel 800 is a self-propelled, water borne vessel having two modes of operation. Specifically, in a first mode of operation (the "transport mode"), the material distribution vessel 800 floats upon a waterway to enable the vessel 800 to be propelled to a desired location. In a second mode of operation (the "distribution mode"), the material distribution vessel 800 is temporarily grounded on the bed of the waterway to provide a sturdy base for distributing material received from an adjacent structure such as the material transportation vessel 550 disclosed above.

Although the material distribution vessel 800 is particularly well suited for distributing material recovered in a dredging operation, persons of ordinary skill in the art will readily appreciate that the disclosed material distribution vessel 800 is not limited to use with any particular type of material. By way of example, not limitation, the disclosed vessel 800 can be used to distribute material gathered in an onshore operation to build an island and/or levy at a desired location in the waterway.

For the purpose of enabling the material distribution vessel 800 to operate in very shallow water, the material distribution vessel 800 is provided with a low draft hull 852. Like the material transportation vessel 550 disclosed above, the material distribution vessel 800 is provided with a propulsion system to enable the vessel 800 to move through a waterway. Although persons of ordinary skill in the art will readily appreciate that the propulsion system can be implemented in many ways without departing from the scope or spirit of the invention, in the illustrated material distribution vessel 800 the propulsion system is implemented with water jets or thrusters 880.

In particular, as most easily seen in FIG. 44, the bull 852 of the material distribution vessel 800 is generally rectangular in shape, and a thruster system is located at each of the corners of the hull 852.

Each of the four thruster systems 880 includes a conduit 881, and a bi-directional impeller (not shown). The conduits 881 of the thruster systems 880 are each arranged diagonally such that one open end of the conduit 881 exhausts on a first side of the hull 852, and the second open end of the conduit exhausts on a second side of the hull 852 as shown in FIG. 44. Each thruster system 880 can thus expel a jet of water through a first side of the hull 852 by rotating its impeller in a first direction and through a second side of the hull 852 by reversing the direction of the impeller. By operating the four thruster systems 880 cooperatively, one can thus maneuver the material distribution vessel 800 in any desired direction. Preferably, the material distribution vessel 800 can completely rotate within its own length.

As with the material transportation vessel 550, the propulsion system, as well as the other systems of the vessel 800 described below are preferably operated from a control panel located in a cab 888.

Persons of ordinary skill in the art will readily appreciate that, although the disclosed vessel implements its propulsion system via the thruster systems 880 described above, other types of propulsion systems can be utilized without departing from the scope or spirit of the invention.

In order to distribute recovered material or other substances, the material distribution vessel 800 is further provided with a conveyor system 810. As shown FIGS. 41-44, the conveyor system 810 of the disclosed material distribution 814. The main conveyor 812 is generally fixed relative to the hull 852. However, the main conveyor 812 is supported on the hull in a clevis 816 via a pivot pin 817 and is, thus, vertically pivotable about the pin 817. As shown in FIG. 42. the main conveyor 812 extends at an upward angle from the stem of the vessel 800 out past the bow of the vessel 800 where it is received in a support housing 818.

As most easily seen in FIGS. 41 and 44, the distal end of the main conveyor 812 is in substantial alignment with the proximal end of the distribution conveyor 814. Thus, material loaded onto the proximal end of the main conveyor 812 will generally be carried upward through the support housing 818 to the distal end of the main conveyor 812. Upon reaching the distal end of the main conveyor 812, the conveyed material will fall onto the proximal end of the distribution conveyor 814 and immediately be conveyed forward to the distal end of that conveyor 814. When the conveyed material reaches the distal end of the distribution conveyor 814, the conveyed material will fall off of the conveyor system 810 under the influence of 520 gravity.

In order to facilitate spreading of material conveyed by the conveyor system 810, the distribution conveyor 814 is mounted for pivoting movement with respect to the main conveyor 812. To this end, the distribution conveyor 814 is suspended beneath the distal end of the main conveyor 812 by a suspension housing 820. As shown in FIG. 41, the proximal end of the suspension housing 820 forms an arcuate rack 822 which meshes with a gear 824 suspended from the support housing 818. As most easily seen in FIG. 42, the proximal end of the suspension housing 820 is captured between an upper plate 826 and a lower plate 828 of the support housing 818 which together form a clevis. A pin 830 passes through the upper and lower plates 826, 828 and the proximal portion of the suspension housing 820 to secure the suspension housing 820 to the support housing 818. A motor 832 mounted above the upper support plate 826 is coupled to the gear 824. The motor 832, which may be implemented by an electric or hydrostatic motor, can be actuated to drive the gear 824, which responds by interacting with the arcuate rack 822 to cause the suspension housing 820 to pivot about the pin 830. The motor 832 is controlled from the cab 888 to slew the distribution conveyor 814 through an arcuate path of approximately 180° (see FIG. 44).

In order to further facilitate distribution of the recovered material carried by the conveyor system 810, the distribution conveyor 814 is longitudinally movable within the suspension housing 820. In particular, the distribution conveyor 814 is movable between an extended position (illustratively, the position shown in FIG. 42) and a retracted position (illustratively, the position shown in FIG. 42). When the distribution conveyor 814 is in its extended position, the material conveyed by the conveyor system 810 will fall somewhere along an arc defined by the distal tip of the distribution conveyor 814. When the distribution conveyor 814 is in its retracted position, the conveyed material will fall off of the main conveyor 812 directly down without contacting the distribution conveyor 814.

In the illustrated vessel 800, the distribution conveyor 814 is rendered longitudinally movable with respect to the suspension housing 820 by a rack and pinion system. In particular, the suspension conveyor 814 includes a frame 834 and a conveyor belt 836. The underside of the frame 834 is provided with a linear rack of teeth 838. A gear 840 is rotatably mounted below the suspension housing 820 in meshing engagement with the linear rack 838. The gear 840 is coupled to a drive motor (not shown). The drive motor, (which can be implemented by a hydrostatic or electrostatic motor of conventional design), can be actuated from controls in the cab 888 to rotate the gear 840 to cause the rack 838 to move in a desired direction to thereby extend or retract the frame 834 and, thus, the distribution conveyor 814.

Although persons of ordinary skill in the art will readily appreciate that the conveyors 812, 814 can be implemented in many ways without departing from the scope or spirit of the invention, in the illustrated vessel 800 both the main conveyor 812 and the distribution conveyor 814 are implemented by commercially available belting material such as steel or nylon reinforced rubber wrapped in endless loop fashion around a frame comprising side plates and a plurality of idler gears. Similarly, although persons of ordinary skill in the art will readily appreciate that the conveyors 812, 814 could be driven in many ways without departing from the scope or spirit of the invention, in the illustrated vessel 800 the conveyors 812, 814 are driven by electrostatic or hydrostatic motors in a conventional fashion.

In order to support the suspension housing 820 and the support housing 818, the material distribution vessel 800 is further provided with a pair of stanchions 840. As shown in FIG. 41 the stanchions 840 are mounted on opposite sides of the deck of the vessel 800. A support cable 842 is attached between each of the stanchions 840 and the proximal end of the support housing 818. For the purpose of rendering the lengths of the cables 842 adjustable, each of the cables 842 is coupled to its respective stanchion 840 through a hydraulic cylinder 844. As mentioned above. the main conveyor 812 is pivotally mounted to the hull 852 via a clevis 816 and a pivot pin 817. The distal end of the main conveyor 812 is journalled in the support housing 818. Therefore, the main conveyor 812 can be pivoted about its pivot pin 817 by extending or retracting the hydraulic cylinders 844. Because the distribution conveyor 814 is mounted in a plane that is fixed parallel to the main conveyor 812, adjusting the pitch of the main conveyor 812 will similarly adjust the pitch of the distribution conveyor 814.

Persons of ordinary skill in the art will appreciate that, in order to facilitate movement under bridges and the like, the vessel 800 preferably has a low profile.

As will be appreciated by persons of ordinary skill in the art, when loaded with material the conveyor system 810 will apply a substantial moment to the hull 852 of the material distribution vessel 800. Therefore, to ensure the vessel 800 provides a stable base for distributing material, the hull 852 is provided with ballast tanks 846 near its stem (i.e., opposite the distal end of the main conveyor 812). These ballast tanks 846 are serviced by pumps (not shown) that are controlled to selectively pump water from the waterway into the tanks 846 to provide mass counteracting the large moment present during the distribution operation of the vessel 800. To further ensure that the material distribution vessel 800 provides a sturdy base for the distribution operation, the vessel 800 is further provided with support pads/stabilizer jacks 848 which are mounted to the bottom of the hull at each of its corners. The support pads 848 are implemented by large plates suspended from hydraulic cylinders 890. Each of the cylinders 890 is independently operable to enable leveling of the hull 852 on an uneven waterway bed. When the vessel 800 is to perform a distribution operation, the hydraulic cylinders 890 are each extended until their corresponding pads 848 contact the bottom of the waterway as shown in FIG. 42. The engagement between the bed of the waterway and the support pads stabilizer jacks 848 lifts the hull 852 such that it is no longer floating to ensure that the hull 852 provides a stable work base during the distribution operation. When the distribution operation is completed and it is desired to move the vessel 800 to a new location, the stabilizer jacks 848 are raised, and the ballast tanks 846 are evacuated such that the material distribution vessel 800 can be transported to a new location under the force of its propulsion system. To provide the vessel 800 with enhanced stability during transportation, the distribution conveyor 814 is preferably moved to its retracted position during movement of the vessel 800.

As mentioned above, the material distribution vessel 800 is particularly adapted to cooperate with the material transportation vessel 550 discussed above. In particular, the material distribution vessel 800 is provided with docking pins 890 such as those discuss above. These docking pins 890 are adapted to cooperate with the capture arms 782 of the transportation vessel 550 to secure the vessels 550, 800 together during the distribution operation.

In particular, the material transportation vessel 550 cooperates with the material distribution vessel 800 in the following manner. The loaded material transportation vessel 550 pulls alone side the stem of the material distribution vessel 800. The rolling bumpers 694 operate to permit relative movement between the vessels 550, 800 during the docking operation. Once the vessels 550, 800 are aligned, the automatic couplers 880 are actuated to secure the vessels 550, 300 together. The auger 640 is then moved to its extended position (see FIG. 44) such that the discharge opening of the auger 640 is suspended above the proximal end of the main conveyor 812. The auger blade 644, the ejector blade 610 and the movable floor 600 of the transportation vessel 550 are then actuated to begin discharging the recovered material from the hopper 556. The conveyers 812, 814 of the material distribution vessel 800 are also actuated. The auger 640 of the transportation vessel 550 then deposits material from the hopper 556 onto the main conveyor 812. The main conveyor 812 carries the deposited material forward to the distribution conveyor 814 which, in turn, carries the material forward and drops it off of its distal end. The distribution conveyor 814 can be extended, retracted and/or slewed to deposit the material in desired location(s).

Figure 49:
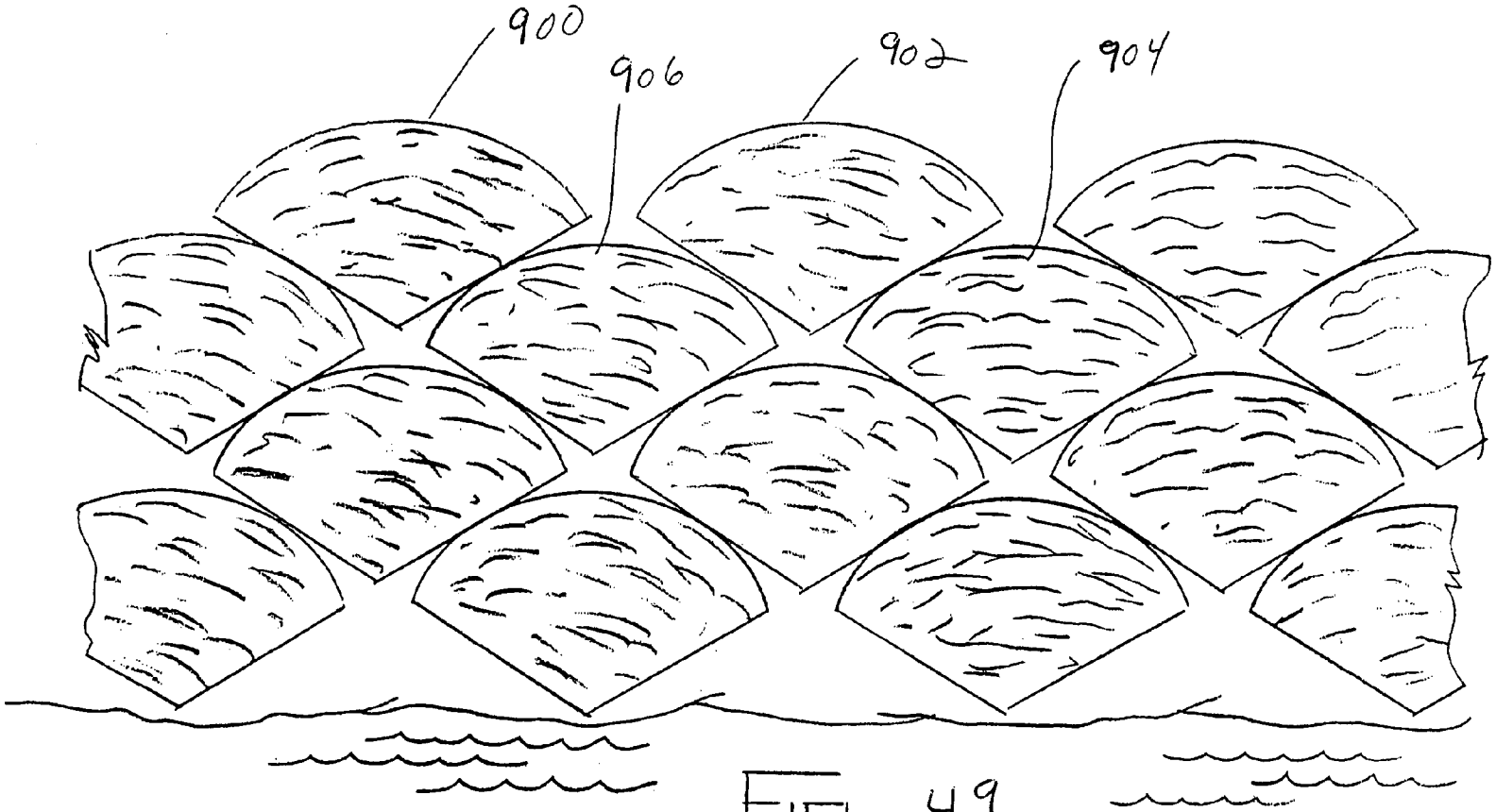
FIG. 49 is a top view of an exemplary island or levy constructed with the material distribution vessel of FIG. 41.

In an operation to create an island waterway from the recovered material, the distribution conveyor 814 is preferably initially positioned in a fully extended and fully slewed position. As material is conveyed by the conveyor system 810, the distribution conveyor 814 is slowly slewed to deposit an actual pile of material in the waterway to a desired height. After the distribution conveyor 814 has been completely slewed through one complete stroke, the distribution conveyor 814 is partially retracted to allow formation of a second arcuate pile at a smaller radius from the first arcuate pile. The distribution conveyor 814 is then slewed through another stroke as it deposits material into the waterway. Upon completion of the second arcuate pile, the distribution conveyor 814 is again retracted to initiate another slew stroke. This process continues until the distribution conveyor 814 reaches its fully retracted position. At this point, an entire island building area 900 (see FIG. 49) will have been completed.

If the island is to comprise more than one island building area 900, the ballast tanks 846 are emptied by their pumps, the stabilizer feet 848 are retracted and the island distribution vessel 800 is moved to a second island building area 902 using its propulsion system. Upon reaching the desired location, the ballast tanks 846 are again fitted, the stabilizer feet 848 are extended, and the distribution conveyor 814 is extended. A material transportation vessel 550 can then be coupled to the material distribution vessel 800 and the island building process repeated to create another island building area 902.

If the island is to be wider than one island building area 900, after a first series of adjacent island building areas are completed for the intended length of the island, the material distribution vessel 800 is moved out away from the newly created island and a second row of island building areas 904, 906 is created adjacent the first row of island building areas 900, 902. The vessel 800 can be used to create as many island building areas (adjacent or non-contiguous) as desired. Once an island of the general desired shape is created, bulldozers can be used to shape and level the island. If desired, trees and/or other vegetation can be planted on the newly formed island.

Figure 47:
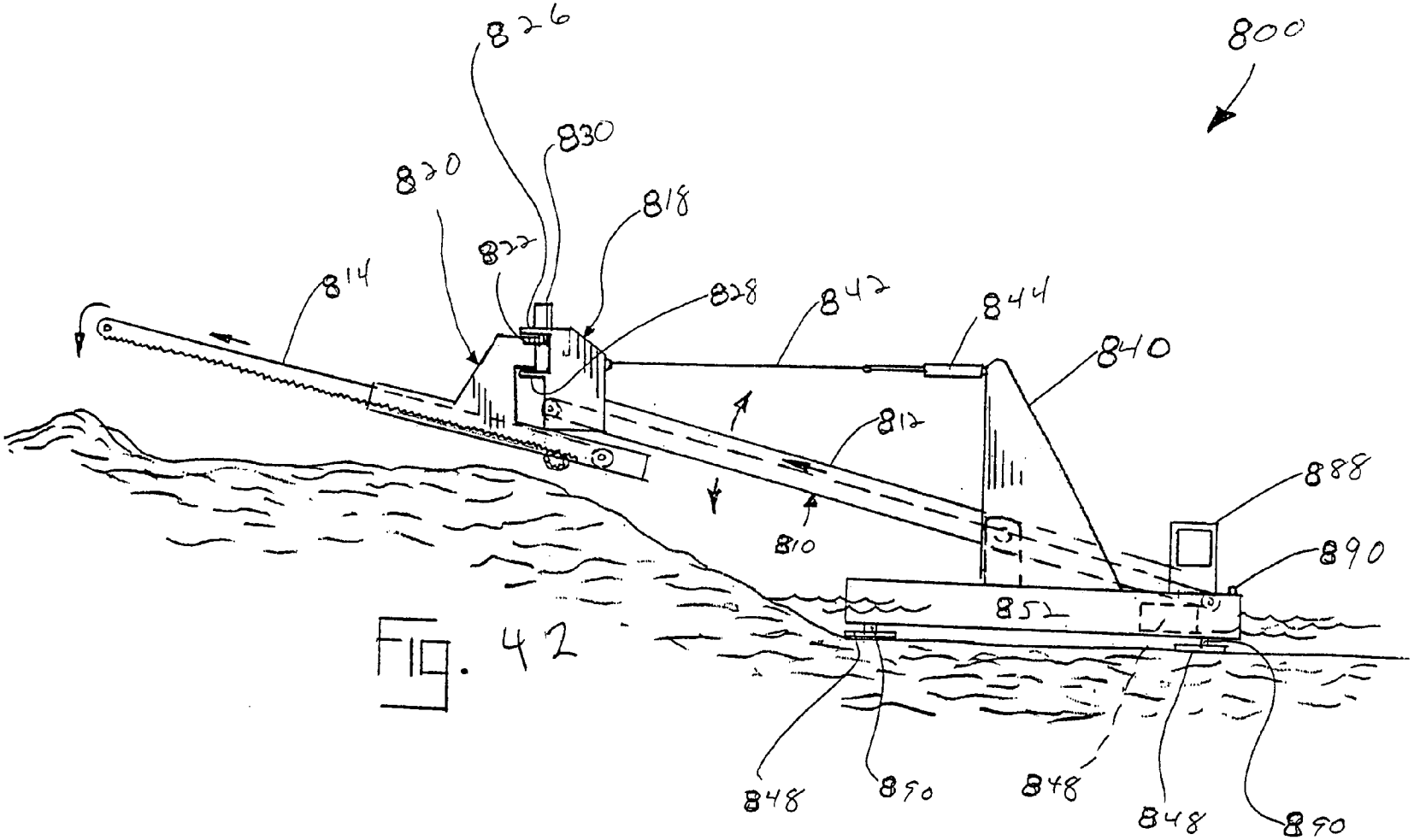
FIG. 47 is a side view of the material distribution vessel of FIG. 41 cooperating with the material transportation vessel of FIG. 36.
Figure 43:
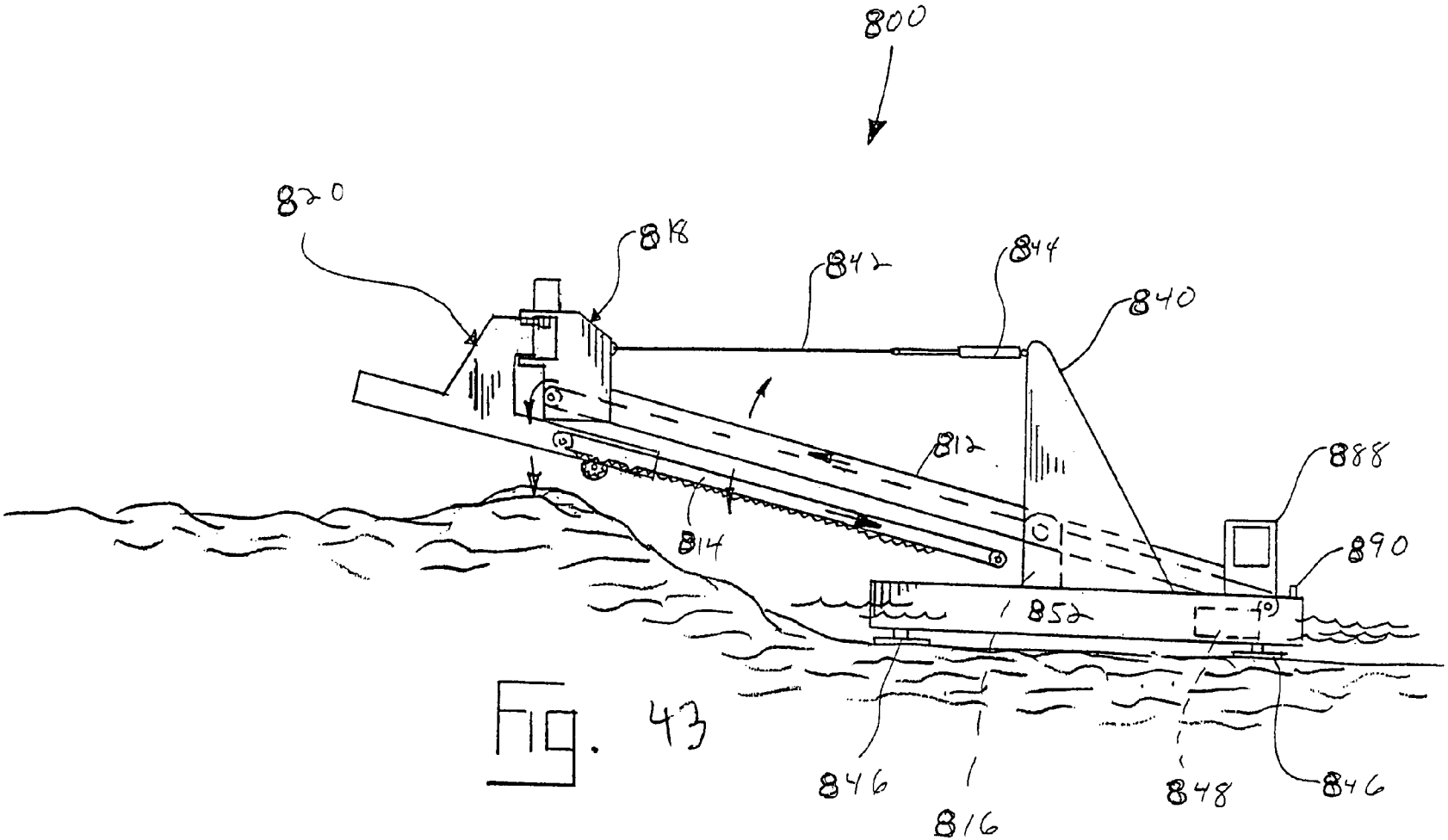
FIG. 43 is a view similar to FIG. 42, but showing the distribution conveyor in the retracted position.
Figure 45:
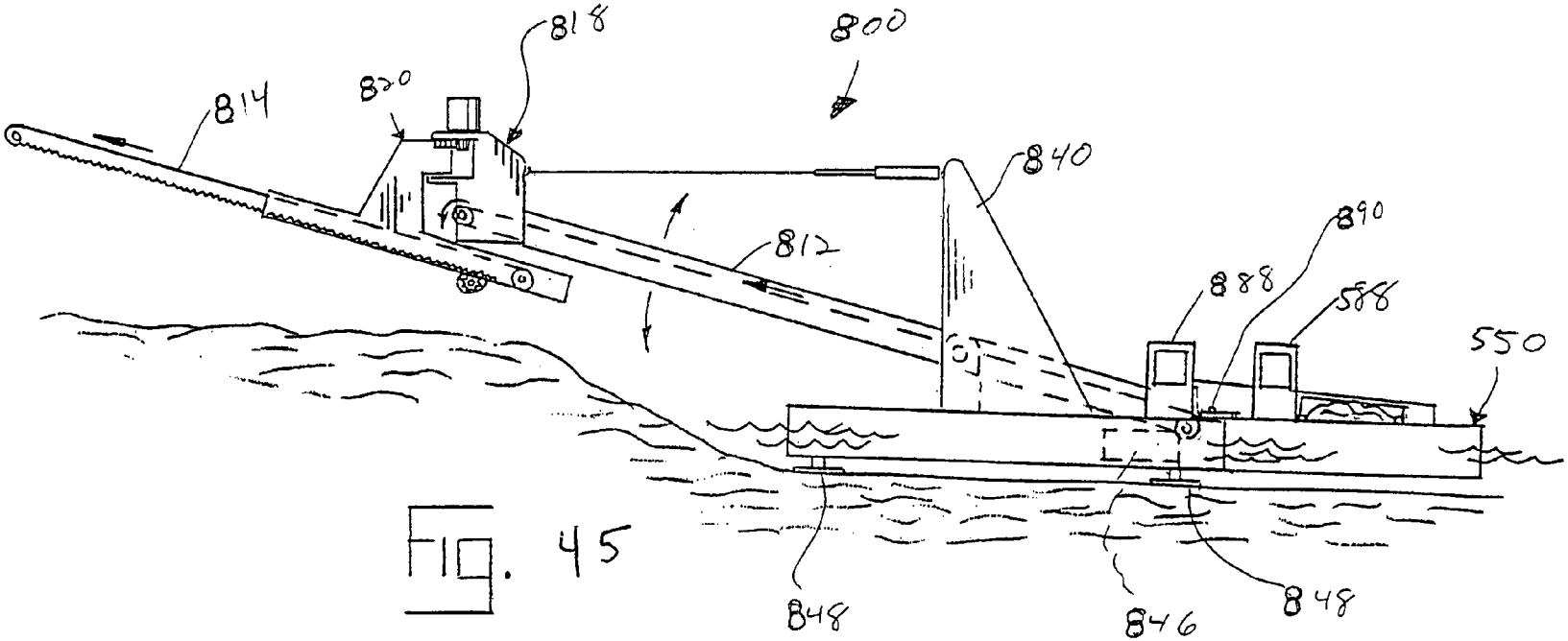
FIG. 45 is a side view of the material distribution vessel of FIG. 41 cooperating with the material transportation vessel of FIG. 26.
Figure 46:
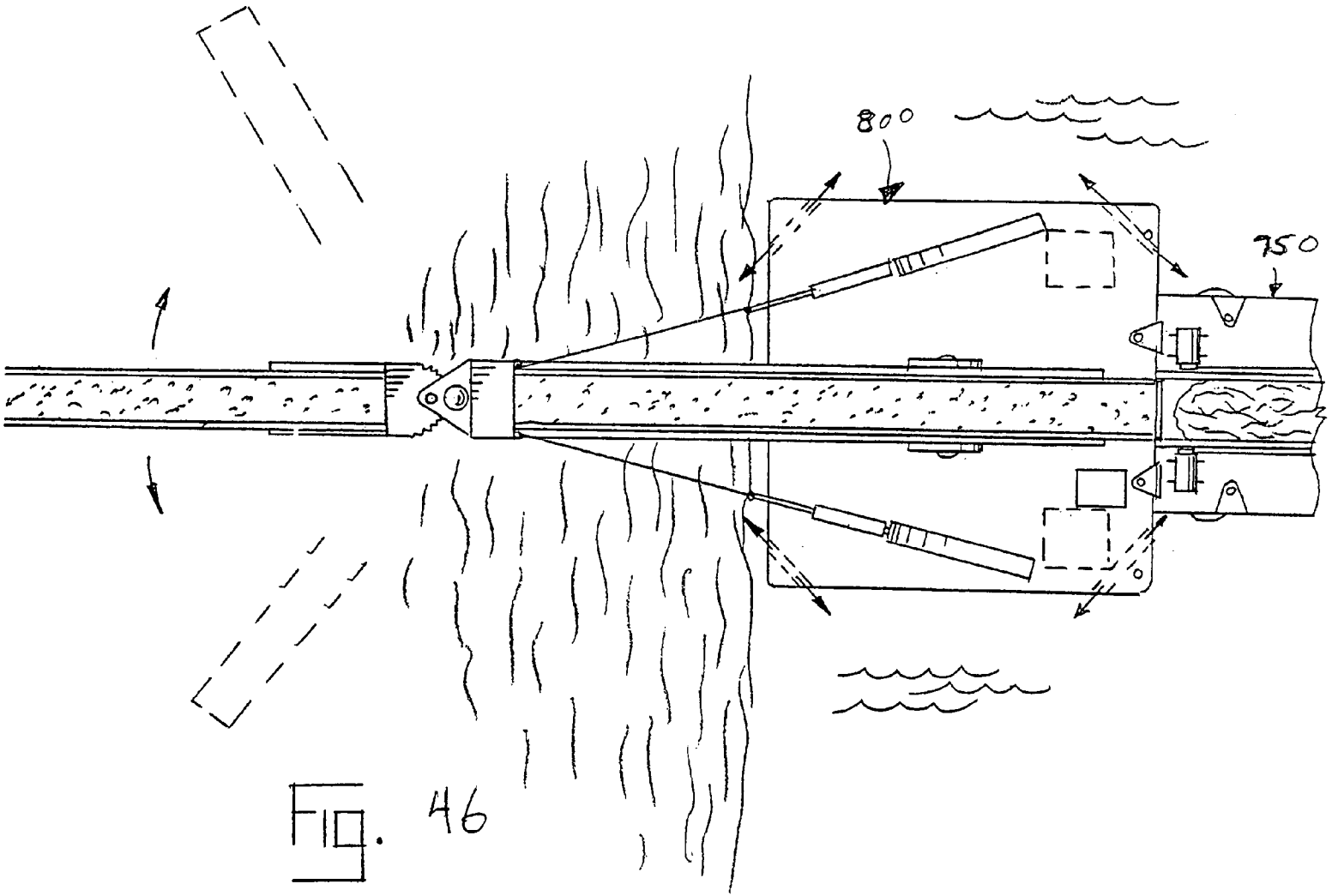
FIG. 46 is a top view of the material distribution vessel of FIG. 41 cooperating with the material transportation vessel of FIG. 36.

The material distribution vessel 800 is adapted for use with any of the material transportation vessels 550, 750 discussed above. Use of the material distribution vessel 300 with the material transportation vessel 550 is illustrated in FIGS. 44 and 45. Use of the material distribution vessel 800 with the material transportation vessel 750 shown in FIG. 39 is illustrated in FIGS. 46 and 47. In the later example, capture arms 682 are located on the stem 510 of the transportation vessel 750 to secure the vessels 550, 800 together during a distribution operation.

Figures 47, 48:
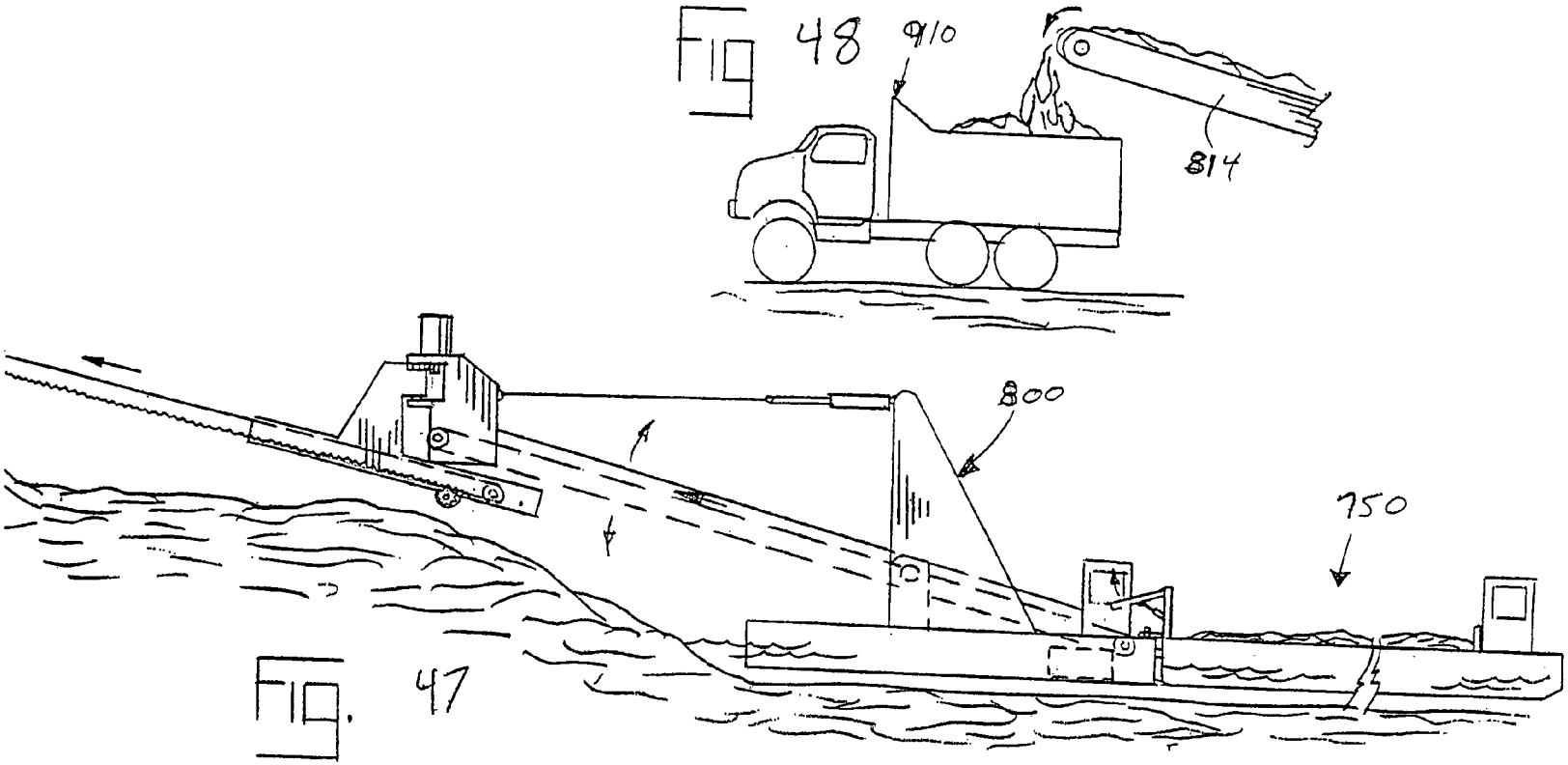
FIG. 48 is a partial side view showing the material distribution vessel of FIG. 41 loading an onshore vehicle.

Although the above description focused on employing the material distribution vessel 800 to deposit the recovered material within a waterway to create an island or levy, persons of ordinary skill in the art will readily is appreciate that the teachings of the invention are in no way limited to island or levy building. On the contrary, the material distribution vessel 800 could be used in other ways without departing from the scope or spirit of the invention. For example, the distribution conveyor 814 can be used to deliver the recovered material to an onshore station such as a truck 910 as shown in FIG. 48 without departing from the scope or spirit of the invention.

From the foregoing, persons of ordinary skill in the art will readily appreciate that a new method of dredging a waterway has been provided. In particular, in the disclosed method, a dredging vessel such as the vessel 510 shown in FIG. 23 is used to dredge recovered material from a waterway in a first location. The recovered material is loaded from the dredging vessel 510 into a material transportation vessel 550, 750 which transports the material to a material distribution vessel 800 at another location in the waterway. The recovered material is then transferred from the material transportation vessel 550, 750 to the conveyor system 810 of the material distribution vessel 800. The conveyor system 810 is then controlled to deposit the recovered material from the conveyor system 810 into the waterway (or alternatively to an onshore location) at another location.

Persons of ordinary skill in the art will readily appreciate that the material distribution operation of the material distribution vessel 800 may be controlled either manually or automatically without departing from the scope or spirit of the invention. In one preferred implementation, the material distribution vessel 800 is adapted to cooperate with the global positioning satellite system (GPS) to locate and construct an island at a predetermined location. Under such an approach, the slewing, extension and retraction of the distribution conveyor 814 is completely automated to locate an island at a predetermined location with great accuracy. To facilitate automated operation, the slewing speed of the distribution conveyor 814 is preferably tied to the rotational speed of the conveyor belts. Optionally, load sensors (not shown) can be located beneath one or more of the conveyor belts to provide feedback information as to how much material is being deposited by the distribution conveyor 814 at any given time and location.

Persons of ordinary skill in the art will further appreciate that the 520 disclosed material distribution vessel can be advantageously used to create levies in an emergency flooding situation. Under such circumstances, the dredging vessel 510 together with a material transportation vessel 550 and a distribution vessel 800 can cooperate to Quickly construct a levy using on-site materials, namely, materials dredged from the bottom of the waterway threatening to flood. In view of the large volumes of material that can be Quickly moved by the cooperating vessels 510, 550, 750 and/or 800, levies can be constructed in a very short time frame to address a potentially dangerous situation.

Although certain instantiations of the teachings of the invention have been described herein, the scope of coverage of this patent is not limited thereto, On the contrary, this patent covers all instantiations of the teachings of the invention fairly falling within the scope of the appended claims either literally or under the doctrine of equivalents.

What is claimed is:

1. A method of building a levee or an island, said method comprising:

dredging material from a body of water with a dredge assembly mounted to a hull, said dredge assembly having a sectioning apparatus and a capture plate, said capture plate being disposed to separate a portion of the material being dredged from the bottom of the body of water;

supporting a hopper with said hull, the hopper being adapted to receive the material, said hopper including a floor, at least a portion of the floor being moveable to permit movement of the material in the hopper;

depositing a first portion of dredged material at a desired island or levee location from said dredge using a transfer conveyor belt, said transfer conveyor belt being pivotably mounted on the hull and being shiftable between a first position in which the transfer conveyor belt receives dredged material from the dredge assembly and not said hopper, and conveys the material off the vessel to at least an island or levee loction and a second position in which the transfer conveyor belt receives dredged material from the dredge assembly and conveys the dredged material into said hopper;

depositing a second portion of said dredged material into said hopper with said transfer conveyor in said second position; and depositing dredged material at said desired island or levee location from said hopper.

2. The method of claim 1 further comprising the step of selectively depositing dredge material into said hopper by using said transfer conveyor in a second position, said second position being operable to convey material into said hopper.

3. The method of claim 1 wherein said desired location for deposit is in a second vessel.

4. The method of claim 3 further comprising securing said second vessel to said hull during deposit of said material by said transfer conveyor.

5. The method of claim 3 further comprising securing said second vessel to said hull with docking pin, said docking pin being dimensioned and configured to operatively engage a capture arm on one of said hull or said second vessel such that said hull and said second vessel are secured.

6. The method of claim 1 further comprising slewing said transfer conveyor.

7. The method of claim 1 wherein one of said steps of depositing a first portion or depositing a second portion further comprises constructing an island.

8. The method of claim 1 wherein one of said steps of depositing a first portion or depositing a second portion further comprises constructing a levee.

9. The method of claim 1 wherein said obtaining step further comprises said transfer conveyor obtaining said material from said hopper through an auger.

10. The method of claim 1 wherein said obtaining step further comprises feeding the material from said hopper with an ejector blade.

11. The method of claim 1 wherein said depositing a first portion and said depositing a second portion steps form a levee.

12. The method of claim 1 further comprising depositing a second portion of said dredged material from said hopper to said desired island or levee location.

13. The method of claim 1 further comprising depositing a second portion of said dredged material to a different island or levee location.

14. The method of claim 1 further comprising depositing a second portion of said dredged material from said hopper to said desired island or levee location with a second conveyor.

15. A method of constructing an island in a waterway with material recovered in a dredging operation comprising the steps of:

positioning a hull at a first island building area in a waterway, said hull including a dredge system, said dredge system including a sectioning assembly and a capture plate, said capture plate being disposed to separate a portion of the material being dredged from the bottom of the body of water, and a conveyor system;

supplying the conveyor system with dredged material from said dredge, said conveyor system comprising a first conveyor belt and second conveyor belt pivotably coupled to the first conveyor belt such that dredged material is conveyed from the sectioning assembly to the first conveyor belt and from the first conveyor to the second conveyor belt;

depositing dredged material from the second conveyor of the conveyor system into the waterway at a first location in said island building area;

moving the second conveyor of the conveyor system by at least one of slewing, retracting, extending, raising or lowering the second conveyor relative to the first conveyor of the conveyor system;

depositing dredged material from the second conveyor at a second location in said island building area;

moving the second conveyor by slewing retracting, extending, raising or lowering to a third location such that the second conveyor belt receiving dredged material from first conveyor deposits the material in a hopper of the hull; and conveying the dredged material to said second location with a third conveyor, said third conveyor receiving dredged material from said second conveyor; and retaining at least a portion of the dredged material in a hopper, said step of depositing at one of said first location or said second location being with dredged material from said hopper.

16. The method of claim 15 further comprising the step of moving the hull to second island building area in the waterway and depositing dredged material at said second island building area.

17. The method of claim 15 wherein the second location is adjacent to the first location.

18. The method of claim 15 wherein said depositing at said first location step and said depositing at said second location step form a single island.

19. A method of building a levee or an island, said method comprising:

dredging material from a body of water with a dredge assembly mounted to a hull, said dredge assembly including a capture plate, said capture plate being disposed to separate a portion of the material being dredged from the bottom of the body of water;

supporting a first hopper with said hull, the hopper being adapted to receive the material, said first hopper including a material moving apparatus, said material moving apparatus being disposed to permit movement of the material in the hopper;

conveying the material to a second hopper, said conveying being with a conveyor being positionable to move dredged material from said dredge assembly to either said first hopper or said second hopper, said second hopper being in a second hull;

depositing at a desired island or levee location dredged material using a transfer conveyor, said transfer conveyor being disposed to receive material from the second hopper and being operable to convey the material out of the second hopper;

moving the transfer conveyor by at least one of slewing, retracting, extending, raising or lowering the transfer conveyor; and depositing the dredged material from the transfer conveyor at a second location.

20. The method of claim 19 wherein said material moving apparatus is at least one of a moveable floor portion, a movable blade, or an auger.

21. The method of claim 19 further comprising a second conveyor on said hull, said second conveyor being positionable to move dredged material from said first hopper off of said hull.

* * * * *